US007881593B2

(12) United States Patent
Grassi et al.

(10) Patent No.: US 7,881,593 B2
(45) Date of Patent: Feb. 1, 2011

(54) GAS COOKING APPLIANCE WITH REMOVABLE BURNERS AND USEABLE WORK AREA

(75) Inventors: Michael J. Grassi, Somerset, PA (US); Anne C. Sullivan, Somerset, PA (US)

(73) Assignee: CFOM Inc., Cleveland, OH (US)

( * ) Notice: Subject to any disclaimer, the term of this patent is extended or adjusted under 35 U.S.C. 154(b) by 601 days.

(21) Appl. No.: 11/985,692

(22) Filed: Nov. 16, 2007

(65) Prior Publication Data

US 2009/0126715 A1 May 21, 2009

(51) Int. Cl.
*F24H 1/10* (2006.01)
*A47J 31/00* (2006.01)

(52) U.S. Cl. ..... 392/480; 99/279

(58) Field of Classification Search ..... 392/304–496; 99/279–323.3; 222/146.1–146.6; 29/428
See application file for complete search history.

(56) References Cited

U.S. PATENT DOCUMENTS

| | | | |
|---|---|---|---|
| 1,148,639 | A | 8/1915 | Van Wie et al. |
| 2,815,035 | A | 12/1957 | Eskin et al. |
| 3,812,839 | A | 5/1974 | Helgeson |
| 3,870,457 | A | 3/1975 | Perl |
| 3,968,785 | A | 7/1976 | Perl |
| 4,457,293 | A | 7/1984 | Berlik |
| 4,705,018 | A | 11/1987 | Beach |
| 4,705,019 | A | 11/1987 | Beach et al. |
| 4,705,021 | A | 11/1987 | Beach |
| 4,736,729 | A | 4/1988 | Beach |
| 5,046,477 | A | 9/1991 | Bennett et al. |
| 5,209,217 | A | 5/1993 | Beach et al. |
| 5,213,091 | A | 5/1993 | Beach |
| 5,295,476 | A | 3/1994 | Herbert |
| 5,640,947 | A | 6/1997 | Shute |
| 5,791,336 | A | 8/1998 | Helm |
| 5,983,884 | A | 11/1999 | Lee |
| 6,032,662 | A | 3/2000 | Taplan et al. |

(Continued)

FOREIGN PATENT DOCUMENTS

WO WO 01/27537 A1 4/2001

OTHER PUBLICATIONS http:/www.fisherpaykel.com/press/, Fisher & Paykel Appliance—Innovative Living, 3 pages, Sep. 19, 2007.

(Continued)

*Primary Examiner*—Daniel Robinson
(74) *Attorney, Agent, or Firm*—Fay Sharpe LLP

(57) ABSTRACT

A gas cooking appliance for use with at least one removable burner, the cooking appliance including a structural housing supporting a cooktop surface having at least one convertible area for use with the at least one removable burner. When the at least one removable burner is operable with the cooking appliance, it resides above the convertible area and is supplied a fuel mixture from the cooking appliance by a gas-to-air type fuel supplier. According to various preferred embodiments there are provided a gas shutoff device for stopping the flow of gaseous fuel to the removable gas burner when the burner is relocated or not properly installed to the appliance proper; and an interlock so that during cooking, the removable burner does not move about in an unsafe way.

25 Claims, 36 Drawing Sheets

U.S. PATENT DOCUMENTS

| | | | |
|---|---|---|---|
| 6,148,811 | A | 11/2000 | Miller |
| 6,170,479 | B1 | 1/2001 | Taplan |
| 6,173,708 | B1 | 1/2001 | Arntz et al. |
| 6,209,534 | B1 | 4/2001 | Taplan |
| 6,257,228 | B1 | 7/2001 | Braccini |
| 6,435,173 | B1 | 8/2002 | Miller |
| 6,505,621 | B2 | 1/2003 | Gabelmann |
| 6,515,263 | B2 | 2/2003 | Mitra et al. |
| 6,742,995 | B1 | 6/2004 | Wood et al. |
| 2005/0142511 | A1 | 6/2005 | Yam et al. |

OTHER PUBLICATIONS

International Preliminary Report on Patentability for International Application No. PCT/US2008/083211 dated May 18, 2010.

Written Opinion of the International Searching Authority for International Application No. PCT/US2008/083211 dated May 18, 2010.

GAS COOKING APPLIANCE WITH REMOVABLE BURNERS AND USEABLE WORK AREA

FIELD OF THE INVENTION

The present disclosure relates to cooking appliances and the like. Particularly, this disclosure relates to rangetops or cooktops for gas appliances. More particularly, this disclosure relates to a next generation of gas cooking appliances with removable burners and a useable work area beneath.

BACKGROUND OF THE INVENTION

Studies have indicated that in the selection of cooking appliances, consumers value three factors of relatively equal importance: aesthetics, cleanability and performance. The popular electric smoothtop ranges, i.e. those having a cooktop surface that is flat and uninterrupted, score well in all three factors. They have been available for several years now. With their smooth uninterrupted cooktops, such electric smoothtops satisfy consumer aesthetics by giving these appliances their sleek, modern appearances. Cleanability needs are met by these smooth electric tops in which the cooking areas have no apertures and/or surface irregularities. Without apertures or irregularities, spilled matter and/or other debris can not collect within these types of rangetops.

For years, chefs and other cooking experts have preferred the performance of gas over electric cooking. However, because no gas surface rangetops have adequately addressed aesthetic and cleanability, the general consumer market has tended away from gas rangetops. There has been a gradual decline in gas cooking appliance sales despite their performance advantage.

Gas surface rangetops typically incorporate a cooking vessel support or grate on which a cooking pot or pan rests over a gas burner projected through an opening in such rangetops. These gas burners are loosely or rigidly secured to a chassis of the appliance. In most modern applications, burners are typically fixedly or loosely secured to the cooktop with a burner seal arrangement that enhances cleanability. Such gas burner arrangements are similar to those of conventional (i.e. non-smoothtop) electric cooking ranges where an open heating element protrudes through an aperture in the cooktop surface for both heating and supporting the cooking pot or pan.

In the past few decades, there have been several different attempts to duplicate an electric smoothtop with gas equivalents. They include using: 1) a gas burner under the cooktop surface, i.e. a gas smoothtop; 2) a gas burner assembly that passes through an aperture in a planar cooktop surface with a separate grate above; 3) a gas burner that passes through an aperture with an integral grate in the cooktop surface; 4) a full or partial burner assembly that is integral with the cooktop surface, the grate being: (a) part of the cooktop surface; (b) a non-integral portion of the burner or (c) a separate component; and 5) an aperture in the cooktop surface for a full or partial burner assembly with the grate and/or burner being a part of that cooktop surface.

Perl U.S. Pat. Nos. 3,870,457 and 3,968,785 disclosed a gas smoothtop range or cooktop having a powder blue flame rather than a radiant type burner beneath their glass ceramic top. Herbert U.S. Pat. No. 5,295,476 disclosed a radiant burner below the cooktop plate to enable a gas radiant smoothtop that might compete more effectively with conventional open flame burners.

Schott Glas developed a 'gas-under-glass' smoothtop that intended to address the cooking application, control and venting issues with radiant burner heating. That arrangement offered no distinct advantage compared to electric smoothtops, however. Such configurations actually raised the price of gas smoothtops significantly as compared to electric smoothtops due to: (i) the complexity of combustion venting; and (ii) the need for additional safety controls. Also, with a gas burner under a smoothtop surface, the cooking performance advantage of being able to visually identify heat output and make rapid adjustments thereto was lost.

Bennett et al U.S. Pat. No. 5,046,477 disclosed a glass cooktop having a burner opening with an arrangement for supporting the gas burner independent of the cooktop. The cooktop apparatus of Taplan et al U.S. Pat. No. 6,032,662 included a cooktop panel of glass ceramic, glass or ceramic in a structural housing. That cooktop panel had a cutout for accommodating a gas burner held by an assembly with a collar that annularly overlapped a portion of panel at the cutout. The aforesaid collar had an inner edge which defined a first abutment for gas burner engagement. A resilient metal element attached to that burner and extended outwardly therefrom for engaging with a lower side of the panel. That lower side defined a second abutment against which the metal element applied force to hold the burner on the panel via the collar and resilient element. A seal clamp between the collar and panel prevented spillage from reaching the structural housing through the cutout.

Taplan et al U.S. Pat. No. 6,170,479 disclosed attaching an atmospheric gas burner to an opening in a glass or glass-ceramic cooking surface for reducing assembly time, the number of components required and easier cleaning of an assembled unit. Arntz et al U.S. Pat. No. 6,173,708 disclosed a gas burner mounting assembly with an injector whose main body portion was positioned between a chassis member of the appliance and a ceramic based cooktop. That injector was mechanically secured to the cooktop for allowing its gas injector to flex with that cooktop.

Taplan U.S. Pat. No. 6,209,534 disclosed a glass-ceramic, molded cooktop plate with a covered, upwardly projecting portion that formed a gas/air mixing chamber for a burner. Between the cover and projecting portion, burner ports were provided to burn a gas/air mixture. Miller U.S. Pat. No. 6,148,811 showed a combined burner and grate structure integral with its cooktop surface.

With any cooktop made from glass, breakage can occur during its manufacture. Defects start as micro-cracks, which lead to stress risers unavoidable in the normal processes for drilling an aperture in such products. Breakage can also occur during usage, especially with a grate located near or on the burner proper. Impact with the burner/grate causes a high bending moment for such cooktops. With cooktops made from thermally- or chemically-tempered soda lime glass, thermal shock from high temperatures proximate the burner can also cause breakage. For the latter glass, a maximum temperature limit must be observed to retain its temper and mechanical—thermal loads.

Braccini U.S. Pat. No. 6,257,228 addressed micro-crack breakage and cleanability by creating a molded, raised part above the surface. That part prevented liquid food from falling through and reaching the burner proper. However, additional thermal processing raised the cost of such cooktops, and holes still have to be drilled therethrough.

Other solutions for preventing the glass from overheating and breaking use large diameter borings and place a sheet metal pan underneath. The edge of each boring sits in a collar. With that practice, aesthetics is lost and cleaning these large borings becomes an issue.

Gabelmann U.S. Pat. No. 6,505,621 addressed thermal breakage for a cooktop having at least one gas burner cutout by applying a reflective coating to the upper side of his cooktop plate. While reducing the thermal load to the plate, it added manufacturing costs.

Both gas and electric cooktops suffer from the disadvantage of requiring a dedicated burner/heating position for cooking. And while burners of different power or heating characteristics are available, they are still relatively fixed in number, variety and location on a given cooktop. This limits the user in choice of cooking style or function. Electric smoothtops have tried to partially address this problem with "bridge burners", i.e., two non-concentric circular burners morphed into an oblong or ovular burner ring useful for griddles, long fish pans and the like. Such a combination has been disclosed for gas cooktops in Yam et al Published U.S. Application No. 2005/0142511. These gas burners tend to heat individual segments unevenly when the bridge is deactivated, however.

To compensate for dedicated heating positions, commercially available gas rangetops (as well as electric) such as that disclosed in Berlik U.S. Pat. No. 4,457,293 have modular burner cartridges, otherwise known in the art as "modular cooking units", "surface burner units", "drop-in" or "plug-in" cartridges. Such rangetops have recessed burner boxes or burner pans otherwise known in the art as "compartments" in the rangetop's top surface (cooktop surface). These units or cartridges are dropped into a compartment to form an arrangement similar to conventional gas surface rangetop. For example, one rangetop may include a gas burner cartridge for a first compartment and a grilling cartridge for a second compartment.

While permitting a change in burner types, these cartridges still require a complete "unit", i.e., cooktop surface, burner, and housing in which all components are fastened together. As such, these cartridges tend to be bulky and therefore cumbersome to switch between. In addition, the burner cartridge system also offers no significant burner performance especially when compared to a dedicated, fixed-position gas-burner rangetop. This is partially due to the cartridge/rangetop configuration, which places more overall constraints on the gas circuit's performance.

Beach et al U.S. Pat. No. 4,705,019 disclosed a range with selectively interchangeable burners. The latter burners were lighter in weight as they did not require a complete "unit". Instead, these burners were installed in the compartment (burner box). Such compartments would be difficult to clean as the compartment bottom is significantly below the cooktop surface. The compartments are below countertop level, relatively deep, and permanently fixed in place. Switching between surface burner cartridges could also be quite cumbersome for similar reasons. Regardless, the burner well area, i.e. that portion of the burner cartridge, or the bottom of the burner pan into which the modular burner cartridges drop, precludes its use as a food preparation or work area.

Modularity is a good marketing strategy and a useful concept. It addresses the fundamental need that various cooking styles require different burners. Modularity frees the user from the limitations of a fixed-position rangetop while allowing one to add (or change) burners to match the cooking functions needed. Modularity is also beneficial during the initial purchase. It allows consumers to buy only what they need with the option of adding more burners later to meet changing needs or preferences.

For any smoothtop (electric or gas) made from a brittle plate, damage to the flat cooking surface can result by the mere dropping of a cook pan. Such damage may require replacing the whole cooking surface. The ability to change cooktop surfaces in case of breakage, while adding greater modularity with changing smoothtop colors and/or design motifs would be desirable. It would also supply an advantage not present with current cooktops having glass-ceramic top surfaces.

Hence, there remains a need for gas cooktops that: (a) provide the performance characteristics of conventional gas cooking; (b) improve modularity; (c) rival the cleanability and aesthetics of an electric smoothtop without having the burner hardware mounting issues at the manufacturing level; and (d) permits using the area in the vicinity of the burner head, when not used for cooking, as a work surface area without burner hardware obstructions.

SUMMARY OF THE INVENTION

There is provided a cooking appliance for use with one or more removable gas burner assemblies. The cooking appliance comprises a cooktop surface having a convertible area for use with a plurality of selectively removable burner assemblies. When made operable, these burner assemblies reside atop the convertible area and are supplied gas from the appliance proper. Preferred embodiments add means for a normally "closed" fluid flow device that stops gas flow to the burner when the burner is removed from the convertible area.

DETAILED DESCRIPTION OF PREFERRED EMBODIMENTS

Figure 1:
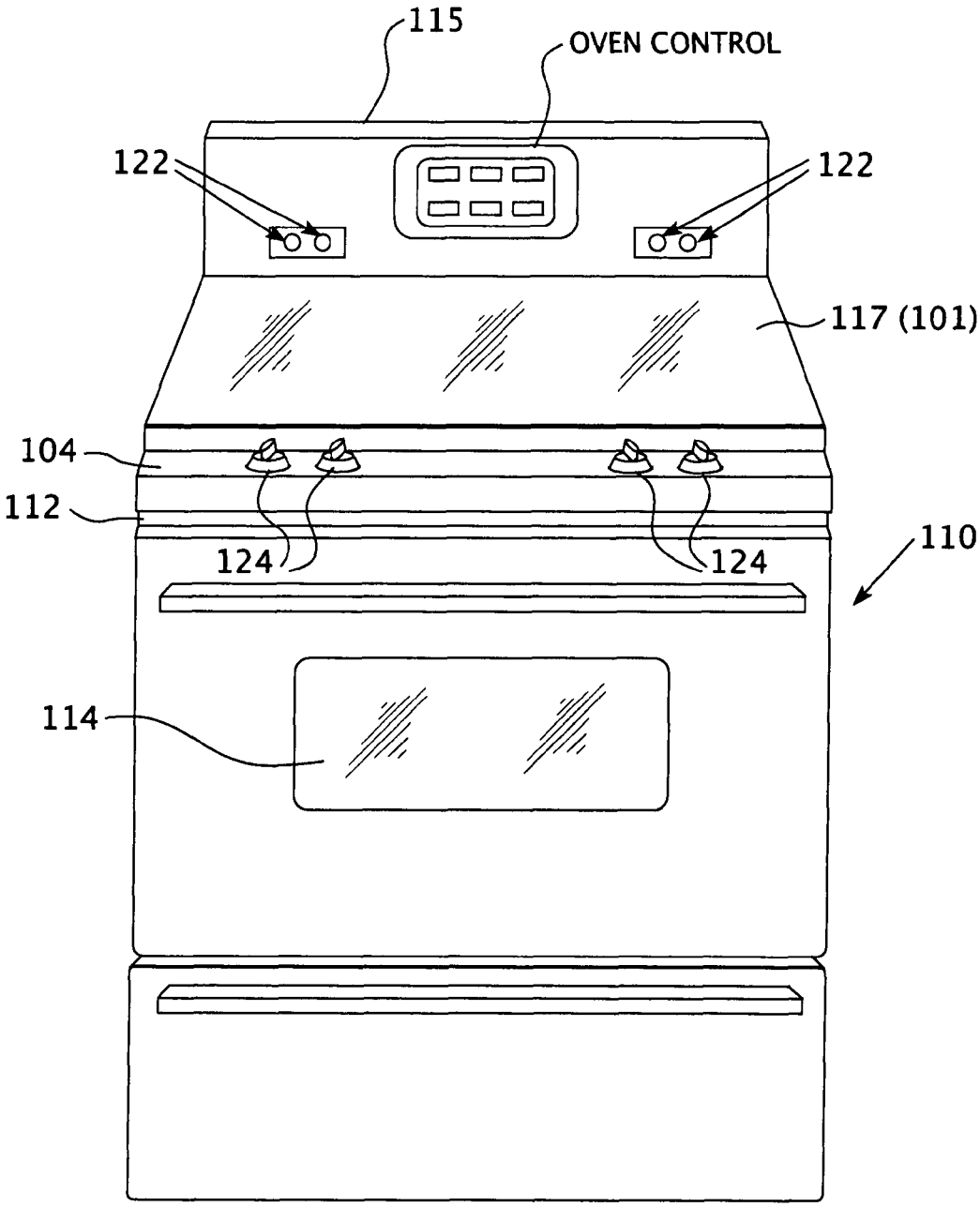
FIG. 1 is a perspective view schematically showing one embodiment of the disclosure as a freestanding appliance.

As used herein, the terms "gas burner", "burner", and "burner assembly" are all synonyms that describe a "gas burner assembly" made of separate or integral components, which function adjacent to, operably over, on, atop or otherwise "above" a portion of a cooktop surface of an appliance. The 'burners' of this disclosure, in contrast to prior art 'burners' may be "removably" installed and are not intended to protrude or mount through an area on the cooktop surface that has apertures extending therethrough for supplying gas to the burner.

Unless otherwise stated, these gas burners have the ability to:

a. receive and combust fuel (natural gas, propane, butane, European category I, II, or III gas mixes, etc.) for cooking food; and b. support a cooking vessel; and c. manage the energy released from combustion, not only for cooking, but also to prevent overheating the cooktop surface, if necessary, using a heat shielding device for keeping areas of the cooktop surface cooler during cooking; and d. be washed, in whole or in part, in a typical dishwasher.

"Burner" means a gas burner, gas burner assembly, or burner assembly.

"Convertible area" means an unimpeded area bounded by a single perimeter that is functional as a kitchen countertop area and is appropriate for such tasks as food preparation or even preparing a written grocery list, when a burner is not mounted above (including "over", "on", "atop" and "to") this convertible area; and, that area has no apertures extending therethrough for supplying gas to the burner.

"Removable burner" means a burner which may be fully or partially relocated from being above, over, or on a convertible area, so that when the burner is relocated, even temporarily, the convertible area can be used as work area.

"Imperforate" means having no opening or aperture; specifically lacking the usual or normal opening that a fuel mixture must pass through in conventional gas cooktops with one or more apertures beneath their respective burners.

"Interlock" means 'to make a connection' or is 'a connection' between a burner and a cooking appliance, so as to prevent the burner from moving about with respect to the cooking appliance in an unsafe way during cooking when the burner is mounted over, mounted on, mounted above, or mounted to a convertible area. When 'interlocked' the fuel supplier is able to properly deliver gas to the removable burner.

"Support" means to fasten, hold, secure, connect, attach, join, suspend or the like, a first element directly or indirectly to a second element; and if indirectly, then any intermediary elements between the first and second element are fastened, held, secured, connected, attached, joined, suspended or the like to each other.

"Structural housing" means a chassis, frame, housing, casing, body or the like, to which elements may be connected so as to form a whole or partial appliance structure.

"Fuel supplier" means a fuel circuit outlet having one or more components, which delivers a fuel mixture to a mating component of the removable burner. The fuel supplier need not be physically connected to the mating component of the burner assembly but may be functionally connected such as for a gas-to-air type connection.

"Fuel supplier mate" means a portion of a removable burner which permits fuel mixture to be received from one or more fuel suppliers.

"Fuel mixture" is a single gas or mixture of gases with or without an oxidizer component.

"Fuel circuit" means the combination of gas piping that is fluidly connected by being in serial, being in parallel, or being in a combination of serial and parallel connections; the gas piping having one or more inlets, and one or more outlets; and, between the inlets and the outlets having one or more fluid control devices in fluid communication with the gas piping for controlling fuel delivered to the inlets and supplied to the outlets so that the mass flow of fuel into all the inlets equals the mass flow of fuel out of all the outlets.

"Proper fluid communication" means the inlet mass flow of the fluid equals the outlet mass flow of the fluid, such that there are no leaks of the fluid.

"Properly installed to the appliance" means being able to cook with the removable burner; that is, the removable burner is in proper fluid communication with the respective fuel supplier and must be mounted atop, mounted over, mounted above, or mounted on the convertible area.

"Cooktop surface" means the top or upper surface of a cooking appliance structure, which when used for cooking, accommodates at least portions of one or more burners. The cooktop surface excludes lids or covers mounted to the appliance. When the appliance is properly installed for use in a kitchen, the cooktop surface is located at, or spaced nearest to, the height of a kitchen countertop. The cooktop surface may have sidewalls; but the sidewall height is less than about half a burner assembly height. The cooktop surface may include apertures for other functions such as a fan duct, or area for operator controls. The cooktop surface of this disclosure has one or more convertible areas. A convertible area may be a pan-like area extending parallel to the cooktop surface. If present, pan sidewalls and a pan bottom require no apertures extending through either of them for supplying fuel to a burner.

"Smoothtop" means the planar, relatively impermeable, pore-free top surface of a cooking appliance structure. The smoothtop has one or more defined cooking vessel support areas for supporting a cooking vessel during cooking, and has a heating source located beneath the bottom surface of the smoothtop in this area. The cooking vessel support area is apertureless. The cooking vessel support area may also be a cooking area if the smoothtop transfers heat from the cooking vessel area in contact with the cooking vessel. Conventional electric smoothtop appliances, or previously developed gas-under-glass appliances, have this arrangement. Induction smoothtops do not have a cooking area, as that area is part of the cooking vessel. All smoothtops have a cooking vessel support area located on the top surface, and a heating source located below the bottom surface. When a cooking vessel is not mounted on the cooking vessel support area, the latter can be used as a work area or work surface.

"Cooking area" means the area at which heating takes place for cooking. Based upon the principles of heat transfer, the cooking vessel receives heat flux. The cooking appliance generates this heat flux by radiation, conduction, or convection at the cooking area. Alternatively, electromagnetic waves can generate eddy currents at a cooking vessel, which also creates "heat", as in induction heating, but those eddy currents still indirectly generate a heat flux to the cooking vessel. Based on the type of heating source and the burner location, the cooking area may vary in location. For a conventional gas burner of the "blue-flame" type, the cooking area consists of the flames themselves, and indirectly both the burner head, which may radiate, and the cooking vessel support, which may conduct heat to the cooking vessel.

A "rangetop" is synonymous with a surface cooktop, surface rangetop, cooktop, cooker, cook stove, flat top, top flat, hob and/or stovetop. They all describe an appliance used to cook foods in a cooking vessel over a heat source. An "appliance" has a "rangetop" but may include still other appliance features, in combination, like an oven, microwave or even a refrigerator unit.

In the accompanying Figures, common features among the various embodiments are commonly numbered, with the same or substantially similar components being assigned the same last two digits in the series. Referring now to the drawings, FIG. 1 schematically depicts a free standing cooking appliance 110. Otherwise known as a range, cooking appliance 110 includes a structural housing 112 in which an oven 114 may also be housed. Range 110 includes a cooktop surface 117 for gas cooking. Cooktop surface 117 has at least one convertible area 101. In some views, the convertible area is shown separately, with a phantom line. In other examples, the convertible area may be considered all of cooktop surface 117 as per FIG. 1. Regardless of its size and relative dimensions, convertible area 101 is apertureless, i.e. has no apertures extending through said area, or having no apertures through which other appliance components must pass. In that instance, an apertureless convertible area may also be said to be "imperforate", as defined above.

FIG. 1 shows what a cooking appliance 110 might look like when not in use for cooking. Particularly, gas burners could be completely disconnected from the appliance and removed and stored leaving convertible area uncluttered, thereby having a similar appearance to that of a conventional electric smoothtop range. Fuel suppliers 122 for cooking appliance 110 are shown as being located external to the convertible area. A fuel supplier 122 supplies gas to a burner head that is part of a removable burner assembly. Fuel supplier 122 can be located in several areas provided that the fuel supplier 122 is not located in the convertible area when not used for cooking. This results in a convertible area having an apertureless surface. A fuel supplier can be movable as will be later described more fully for FIGS. 14G and 14I, or fixed to the structural housing 112 and external to the convertible area. An exploded schematic and a more detailed schematic of a fixed fuel supplier is shown and described later for FIGS. 3B and 3C. As shown, fuel suppliers 122 are fixedly located at panel 115 that extends along the back of cooktop surface 117. A control panel 104 with operator controls 124 is shown external to convertible area 101. As will be shown in FIG. 2, when a removable burner assembly is positioned over, onto or above cooktop surface 117, its burner head (or heads depending on burner style) will be located within the convertible area 101. Fuel supply to the removable burner from the supplier will be more fully explained in FIG. 6A. However, in FIG. 1, removable burner is properly and selectively located for being supplied gas from a fuel supplier 122, and operator control 124 adjusts the amount of fuel flowing through that fuel supplier and hence to the gas burner. The schematic at FIG. 1 shows operator control 124 as an integral part of cooking appliance 110.

Oven 114 is controlled by an oven control on panel 115. Oven control can also be located in other areas including with control panel 104. Although a removable burner assembly is required for cooking with this appliance, it need not be sold with same, especially for modular applications. Consumers may purchase a range like element 110 with separate removable burner assemblies that best suit their cooking styles.

Figure 2A:
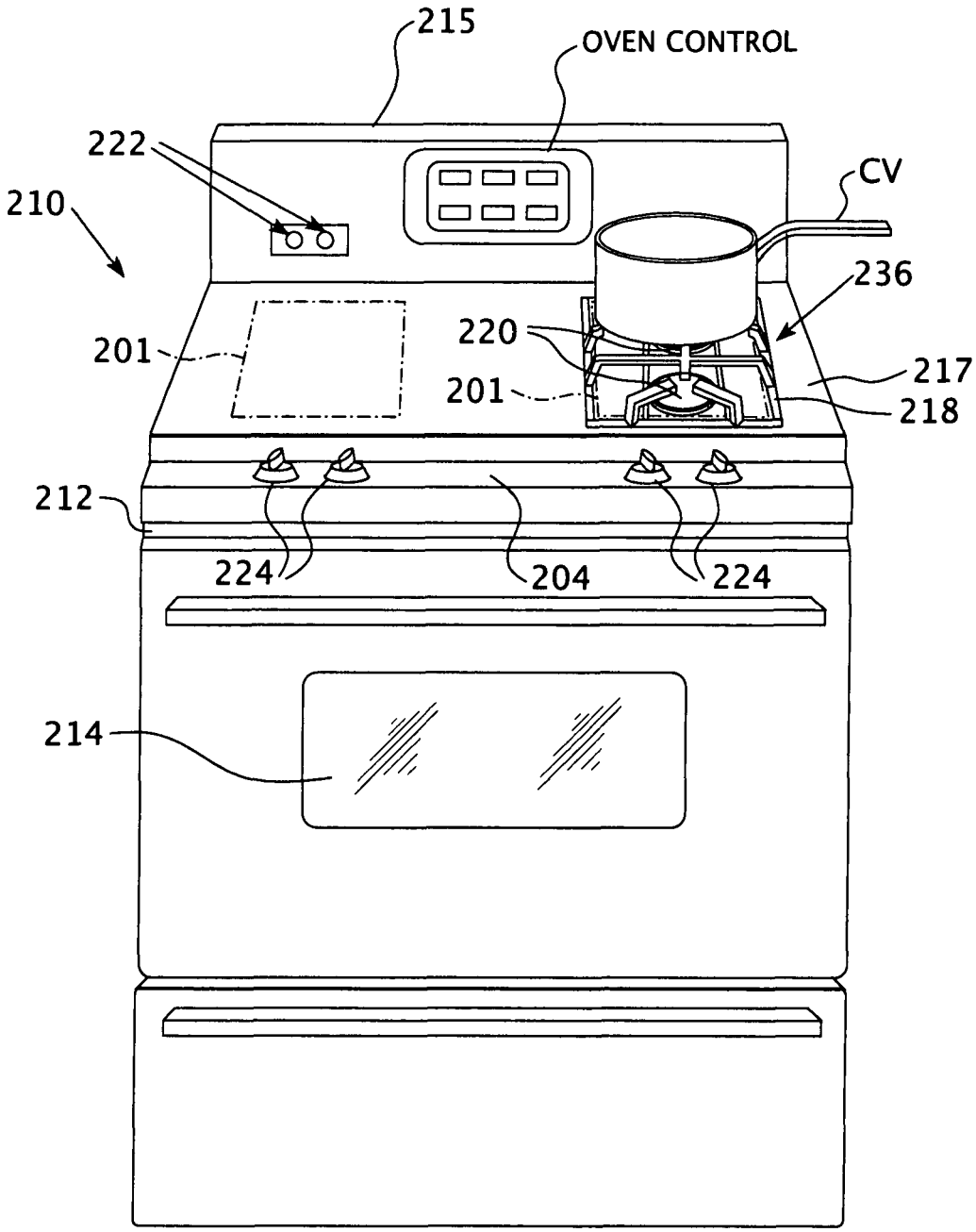
FIG. 2A is a perspective view of the appliance from FIG. 1 with a removable burner installed on its right side.

In FIG. 2A, the same cooking appliance as depicted in FIG. 1 is shown, but with cooking appliance 210 having an interlocked removable burner assembly 236 with a rear and front burner head 220 located on the right side of cooktop surface 217. Removable burner 236 is supplied gas from its fuel suppliers 222. Removable burner 236 rests above or over cooktop surface 217 which has no apertures in or through its convertible area 201. In this particular view, two convertible areas are shown for clarity. It is to be understood, however, that an appliance according to this disclosure may have just one convertible area, or more than two separate convertible areas as well.

Burner 236 covers a significant portion of the right side to cooktop surface 217. For illustrative purposes, a cooking vessel (CV) is shown resting on cooking vessel support or grate 218 above rear burner head 220. Optionally, a heat shield (not shown) for removable burner 236 may be used to reflect radiant energy during cooking. A heat shield located on removable burner 236 would help keep cooktop surface 217 relatively cooler. That will enable manufacturers to make such cooktops from less heat resistant materials, and include decorations and/or painted areas.

Figure 2B:
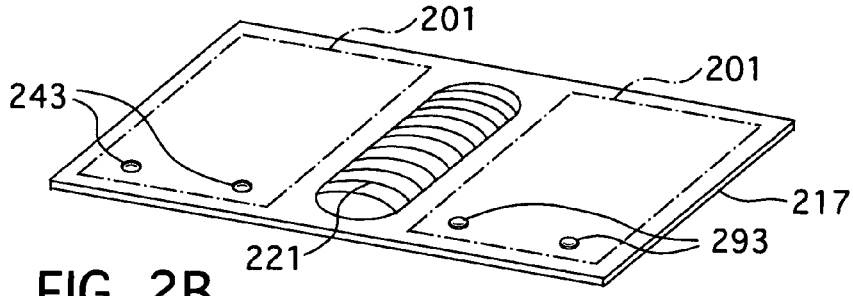
FIG. 2B is a schematic view of the cooktop surface having a fan duct.
Figure 2C:
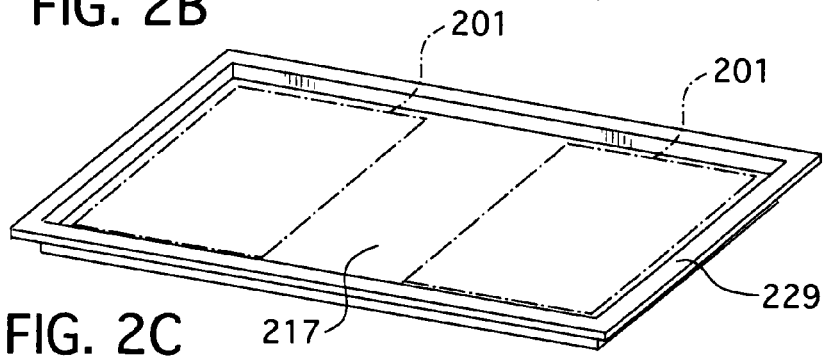
FIG. 2C is a schematic view of the cooktop surface having a peripheral lip.
Figure 2D:
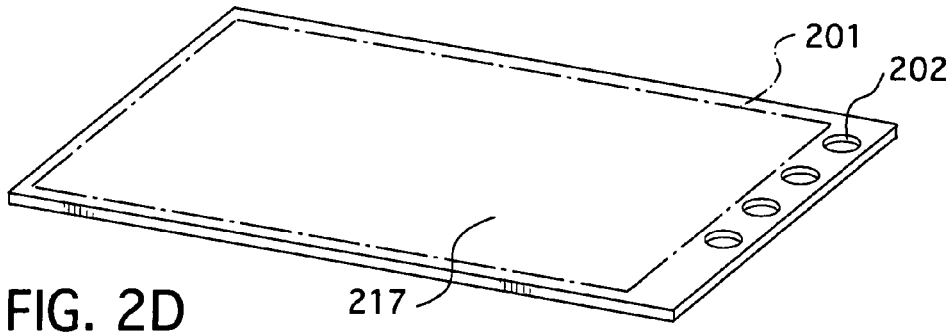
FIG. 2D is a schematic view of the cooktop surface having apertures.
Figure 2E:
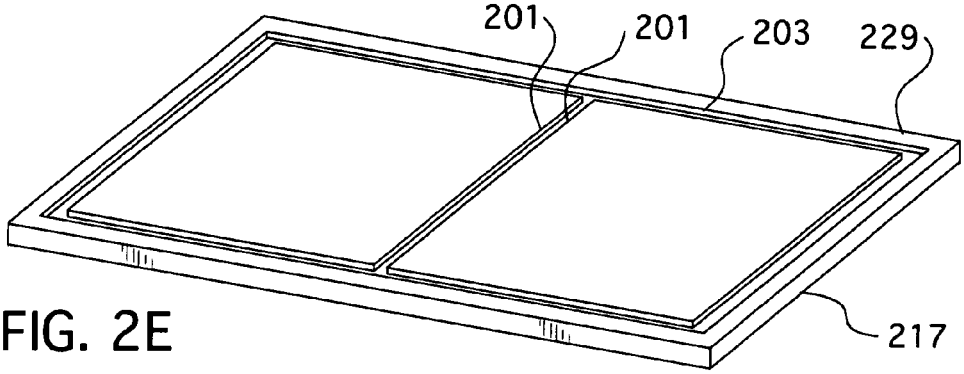
FIG. 2E is a schematic view of a 'cutting board' type cooktop surface.
Figure 4A:
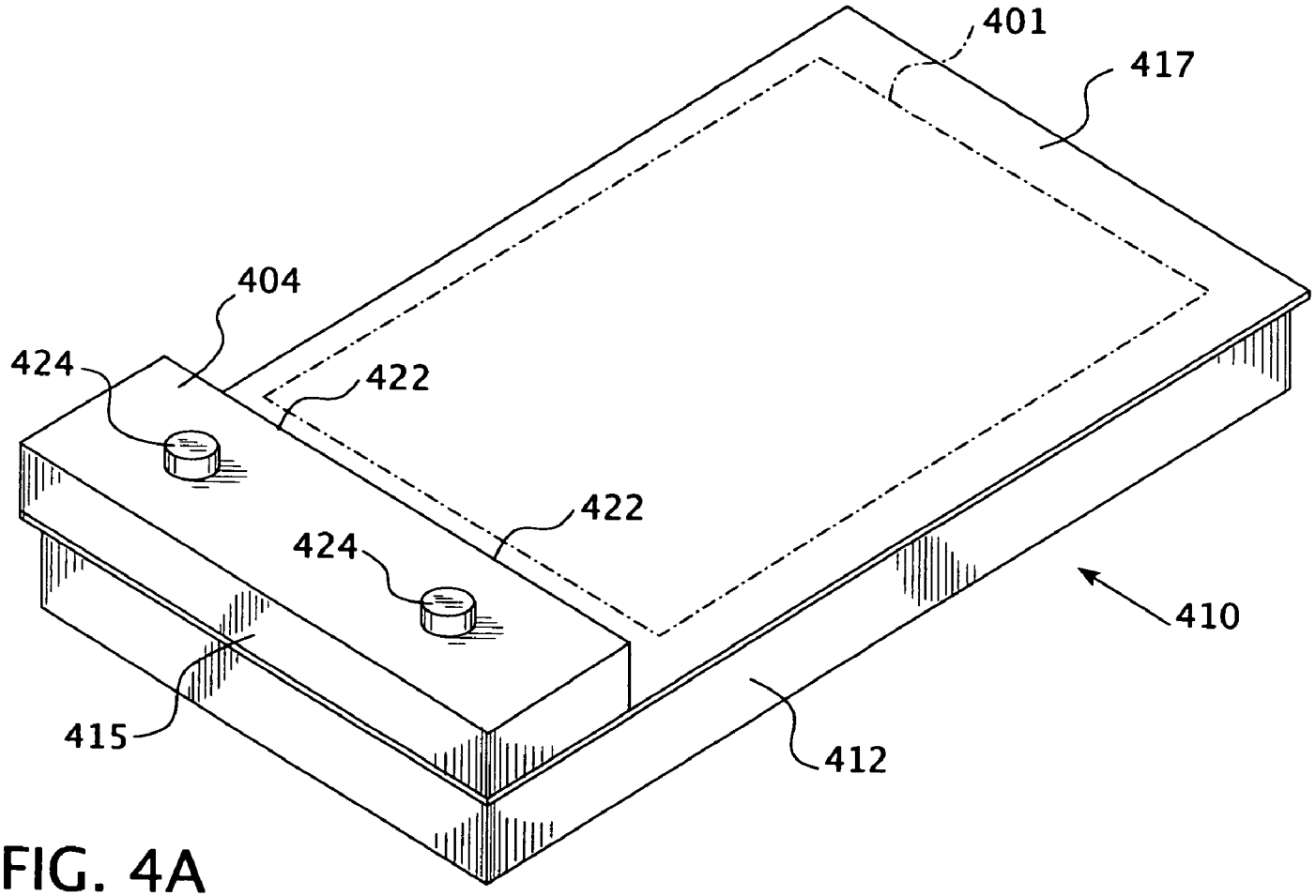
FIG. 4A is a perspective view of a third embodiment schematically showing the disclosure as a drop-in cooktop.
Figure 4B:
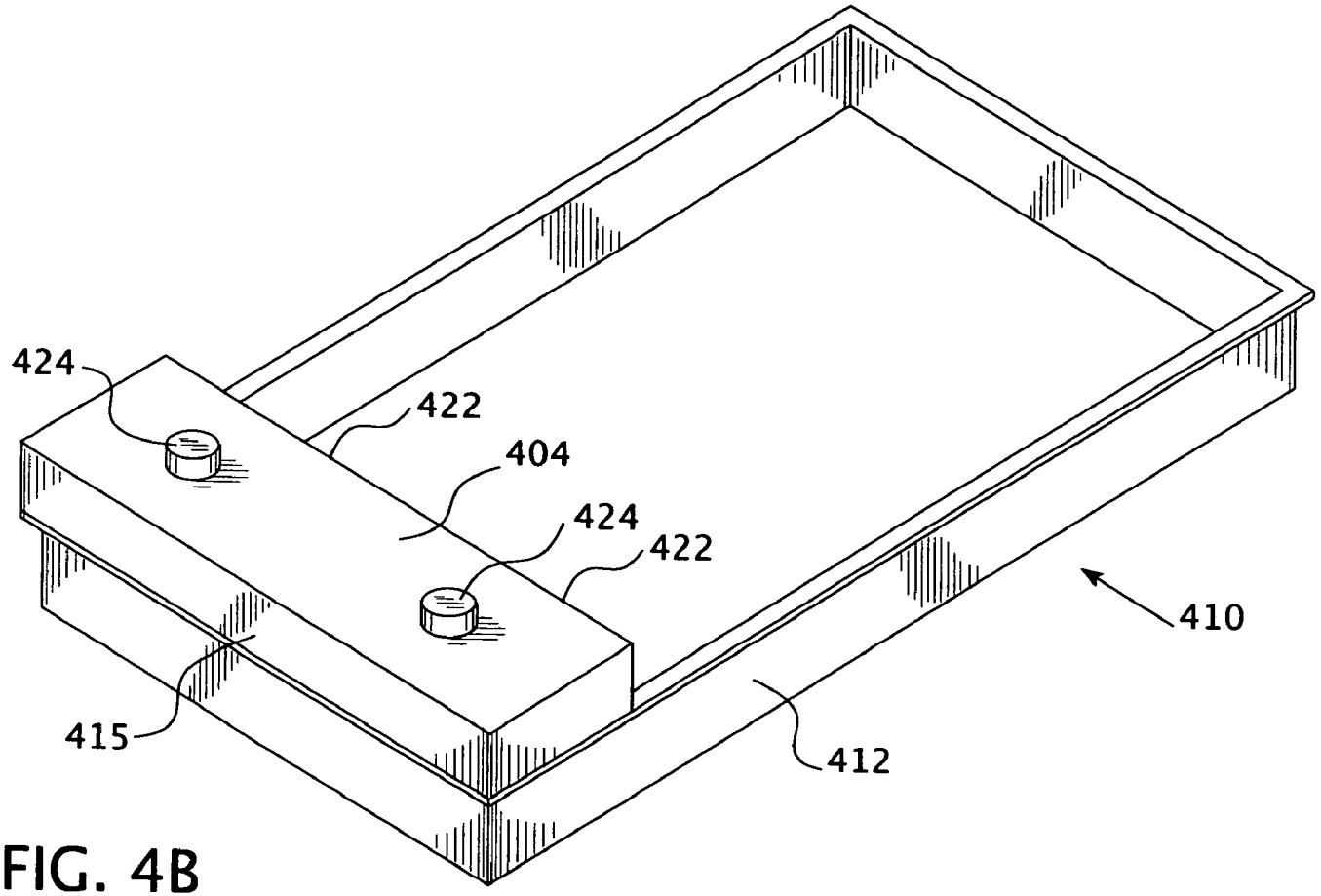
FIG. 4B is a schematic view of the FIG. 4A embodiment with its cooktop surface removed.
Figure 5:
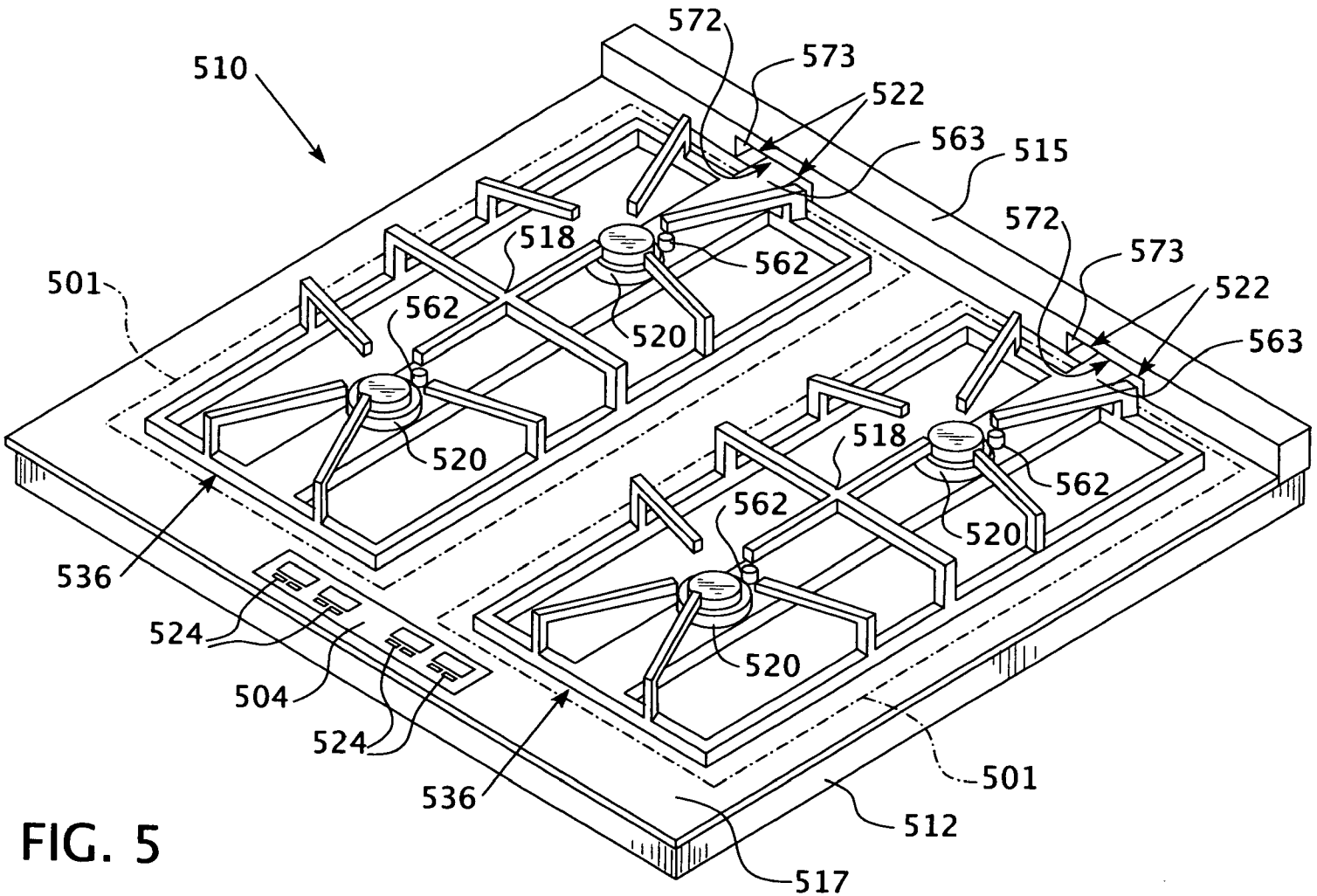
FIG. 5 is a perspective view of a fourth embodiment schematically showing a drop-in cooktop with electronic controls.

For clarity, cooktop surfaces in FIGS. 1 and 2, and later in FIGS. 3-5 are all shown with a planar cooktop surface. Cooktop surface need not be completely planar or apertureless, provided that a convertible area may serve as a work area. FIGS. 2B through 2F show alternative cooktop surface configurations. None of these alternative configurations is completely planar or featureless, though. FIG. 2B shows that a fan duct 221 is located in the cooktop surface, but the cooktop surface 217 still has convertible areas 201 which permit a work area. Convertible area 201 also has dimples 243 and/or protuberances 293 that do not impede cleaning but may be used for burner location or other for other functionally reasons. FIG. 2C shows cooktop surface 217 with an outer lip 229 at its periphery, but having a convertible area 201 (two areas shown, but equivalently can be encompassed by one) located internal to the lip. FIG. 2D, shows a cooktop surface 217 having a convertible area 201 (one shown) but also having operator control apertures 202 for mounting operator controls therethrough. FIG. 2E shows a 'cutting board' style cooktop surface 217 having one or more convertible areas 201 with a recessed area 203 for drips on the outer periphery of the convertible areas 201. The cooktop surfaces in FIGS. 1 and 2A-2E are for illustration. The cooktop surfaces of this disclosure can take many forms provided the cooktop surface has at least one convertible area.

Figure 3A:
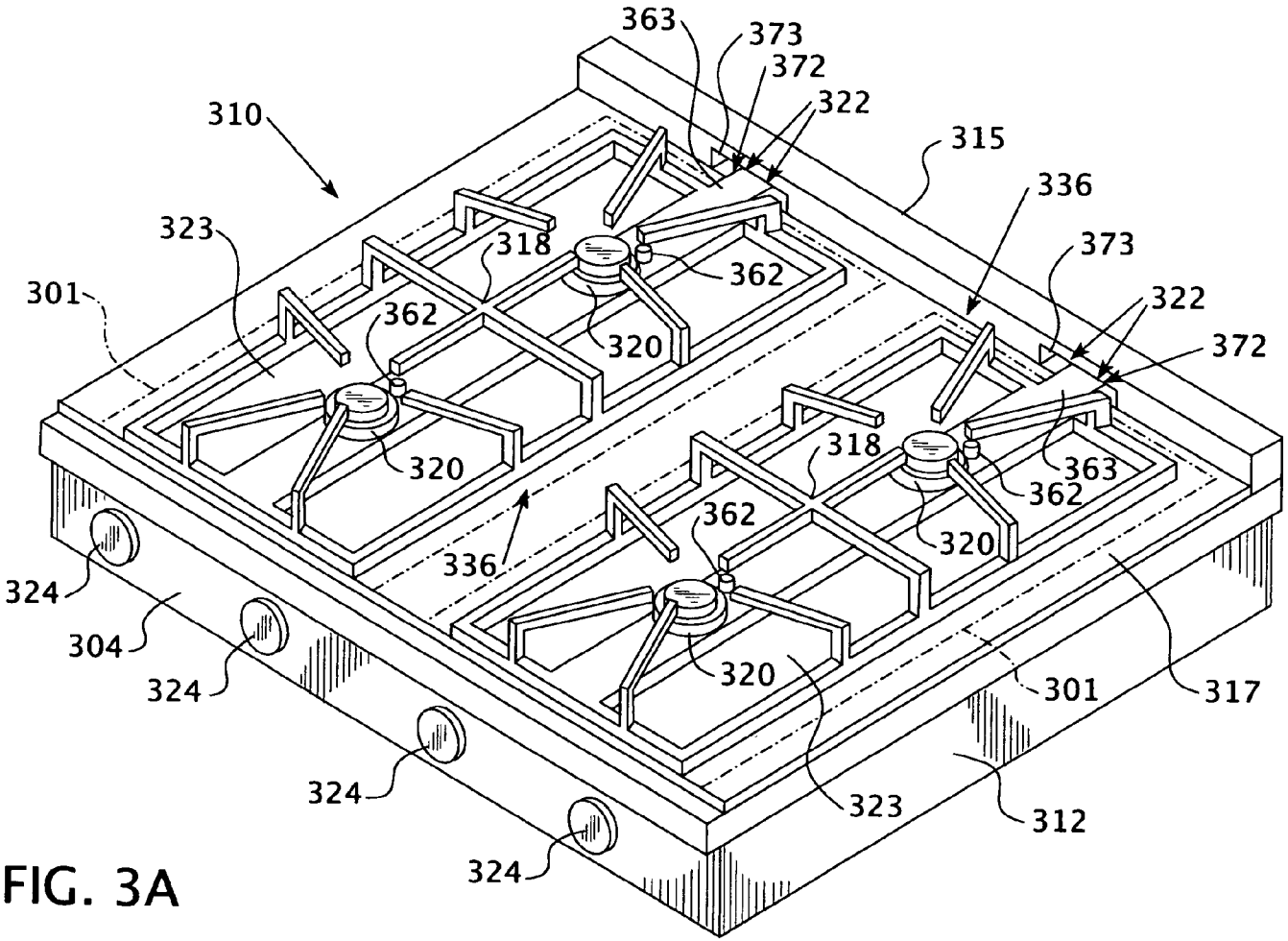
FIG. 3A is a schematic view of a second embodiment showing the disclosure as a slide-in cooktop.

FIG. 3A depicts a schematic of a slide-in type cooking appliance 310 with a structural housing 312 and cooktop surface 317 for gas cooking. One or more removable burner assemblies 336 would be located in convertible area 301 of appliance 310 when used for cooking. When removable burner assembly 336 is removed, it is more evident the extent to which cooktop surface 317 is truly apertureless in convertible area 301 (two such areas shown) as in FIG. 1.

Figure 3B:
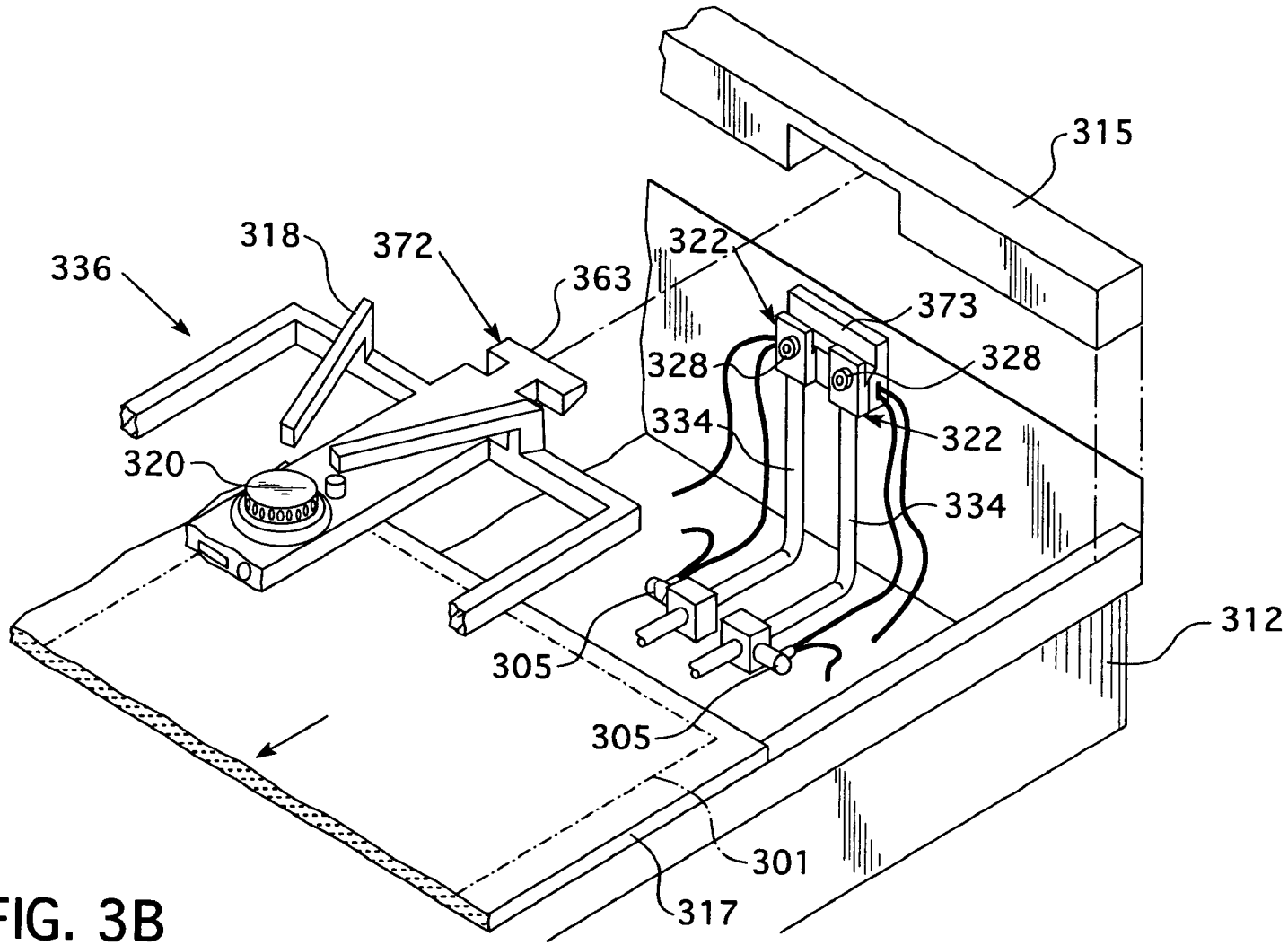
FIG. 3B is an exploded schematic view of a portion of the slide-in cooktop.
Figure 3C:
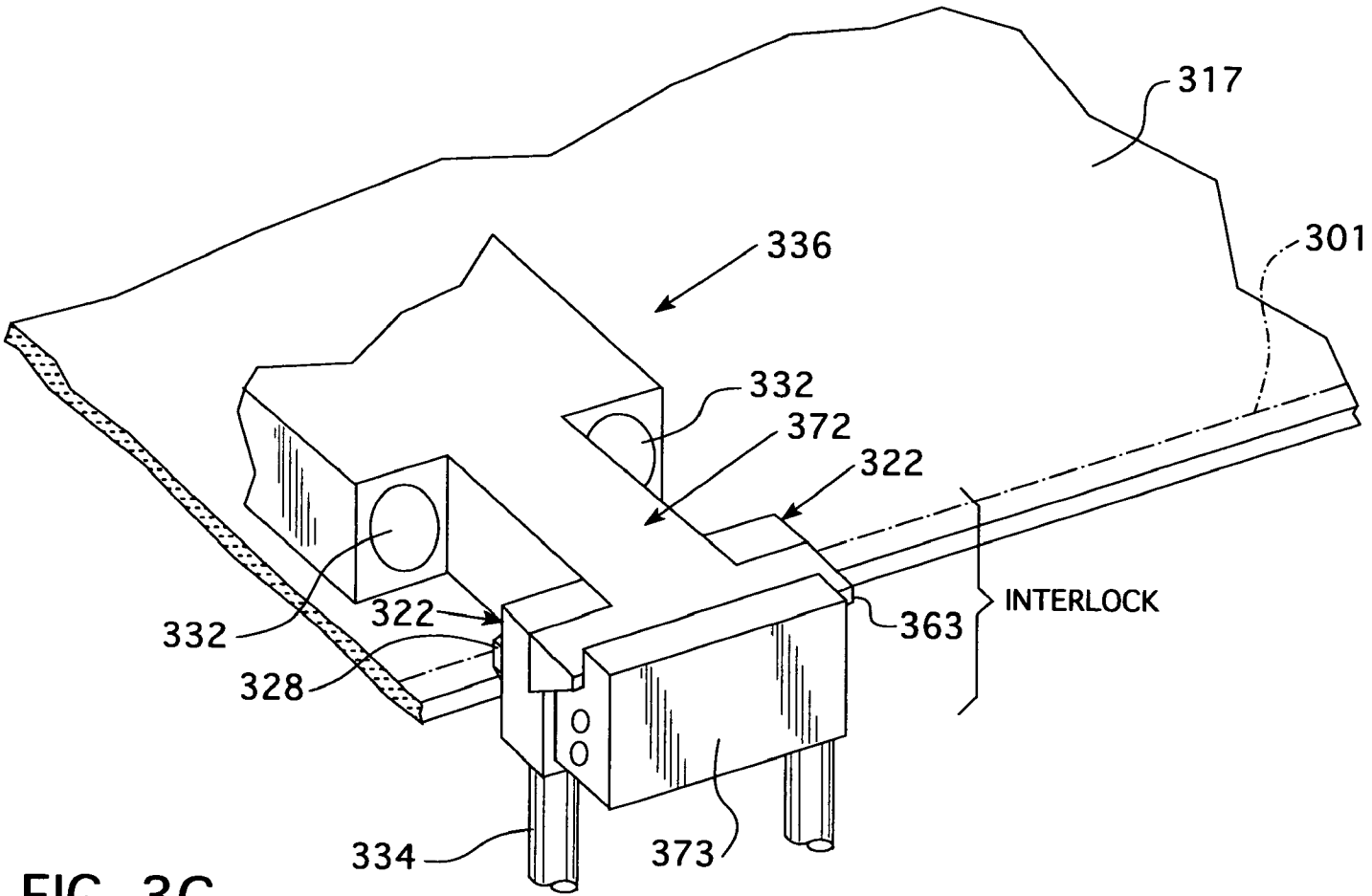
FIG. 3C is a schematic view of a fuel supplier and a fuel supplier mate.

Fuel suppliers 322, as better seen in exploded views in FIGS. 3B and 3C, supply gas to removable burner assembly 336 via fuel supplier mate 372. As shown, that supplier 322 is located external to periphery of convertible area 301 at panel 315 along the back of cooktop 317. It is to be understood, however, that other locations such as the side or front of cooktop 317 are also possible for fuel supplier 322.

A control panel 304 with operator controls 324 is located external to convertible areas 301 of appliance 310 in FIG. 3. Operator controls 324 may be used to adjust heat output for removable burner 336 when the latter is properly installed on cooktop 317 and operating. Removable burner 336 also includes a grate 318 for supporting a cooking vessel, and an igniter 362 for igniting the fuel delivered to burner head 320. As later described for FIGS. 10A, 10B and 12, an electrical connector 373 may supply power through a receiver 363 (better seen in FIG. 3C) on removable burner 336 to ignition element 362.

FIG. 3B shows in partial cross section an exploded view of the right rear section of appliance 310. FIG. 3C schematically shows another view of same, but showing how burner assembly 336 may be interlocked to the fuel suppliers 322. Also, both FIGS. 3B and 3C show a fuel supplier 322 of the gas-to-air type having an orifice 328 that supplies fuel to a removable burner having a gas distribution tube entrance 332. As schematically depicted, the fuel suppliers 322 and electrical connector 373 are connected in such a way as to form an interlock to electrical receiver 363, thereby keeping burner assembly from moving around when the removable burner is mounted above the convertible area 301. Also shown and will be further explained later, is gas shutoff device 305. As depicted, this gas shutoff device is an electrically-operated, normally-closed, gas valve. Gas shutoff device 305 is electrically activated to an open position by interlocking the removable burner 336 to the appliance 310 proper. Here, electrical receiver 363 and electrical connector 373, when connected, complete the electric circuit for device 305 which supplies gas to fuel supplier 322 through gas conduit 334. Alternatively, removable burner 336 could trigger an independent mechanically activated electrical switch or connection, or equivalent to complete the electric circuit for device 305.

The cooking appliance 410 in FIG. 4A is a drop-in type that has one convertible area 401 and at least one operator control 424 and fuel supplier 422. It should be understood that alternate configurations for appliance 410 may include additional operator controls and fuel suppliers as shown for the appliances 110 of FIG. 1, 210 of FIG. 2A, and 310 of FIG. 3A. Such an appliance can be mounted on a kitchen countertop, as long as it has a suitable gas conduit extending therein to which the appliance can be connected.

Drop-in cooking appliance 410 has a structural housing 412 and cooktop 417 for gas cooking. Different types of removable burner assemblies will be located on convertible area 401 during normal operation, i.e., when that appliance will be used for cooking. After such burners are removed however, convertible area 401 of cooktop 417 is effectively apertureless and uncluttered. In this state, convertible area 401 can be used for other purposes including food preparation. A fuel supplier 422 at panel 415, external to convertible area 401, supplies gas to its removable burner assembly, much in the same way as was shown in FIG. 3B. Other locations external to convertible area 401 are also possible for fuel supplier 422. A control panel 404 with operator control 424 can also be located external to convertible area 401, said control adjusting the amount of fuel flowing through fuel supplier 422 for when a removable burner is installed over cooktop 417 so as to receive gas from fuel supplier 422. The aforementioned control panel 404 and fuel supplier 422 are both shown extending from one side of the appliance in this view. It is to be understood, however, that the control panel and/or fuel supplier in this view (and any variations thereof) may be extended from any side of an appliance in alternative embodiments.

In FIG. 4B, the drop-in appliance 410 from FIG. 4A is shown with its cooktop surface 417 removed from structural housing 412 thereby more closely resembling a box-type chassis. With that sort of configuration, the compartment beneath surface 417 can be kept empty for stowing an unused removable burner especially when a portion or all of surface 417 is hinged via conventional means (not shown). Alternately, a drawer, not shown, can be added to structural housing 412. For some applications, it may be desirable to minimize the relative depth of structural housing 412 for facilitating installation in a countertop having one or more cabinet drawers below. The schematic at FIG. 6G shows a fuel supply that would work well for a drop-in appliance like the one shown in FIGS. 4A and 4B. Such an appliance would be ideal for mobile homes and campers.

FIG. 5 schematically shows another variety of drop-in cooking appliance 510 with structural housing 512 depicted as box type chassis having a low sidewall height, a cooktop surface 517 and a convertible area 501 (two are shown, but here again one area may encompass both). A fuel supplier 522 (hidden from view) delivers gas to fuel supplier mate 572 of removable burner assembly 536 of this appliance. The fuel supplier can be located at panel 515 along a back portion of cooktop 517. A control panel 504 with operator control 524 can be located external to convertible area 501 therein. Operator control 524 is depicted in this figure as an electronic control. Previously shown control elements 124, 224, 324 and 424 can also be electronic.

The grate 518 of FIG. 5 supports a cooking vessel and further includes an igniter 562 at burner head 520. In addition, an electrical connector 573 connects to igniter 562 and supplies power to receiver 563 therein.

The operator control, element 124, 224, 324, 424, and 524 in FIGS. 1 through 5, adjusts fuel flow to a fuel supplier respectively shown as 122, 222, 322, 422, and 522. Although not mandatory, it is desirable for operator safety to prohibit gas flow unless a removable burner (like elements 236 and 336 and 536 in FIGS. 2A, 3A, and 5, respectively), is: (a) in proper fluid communication with the appropriate selected fuel supplier; and (b) properly mounted above the convertible area.

Figure 6A:
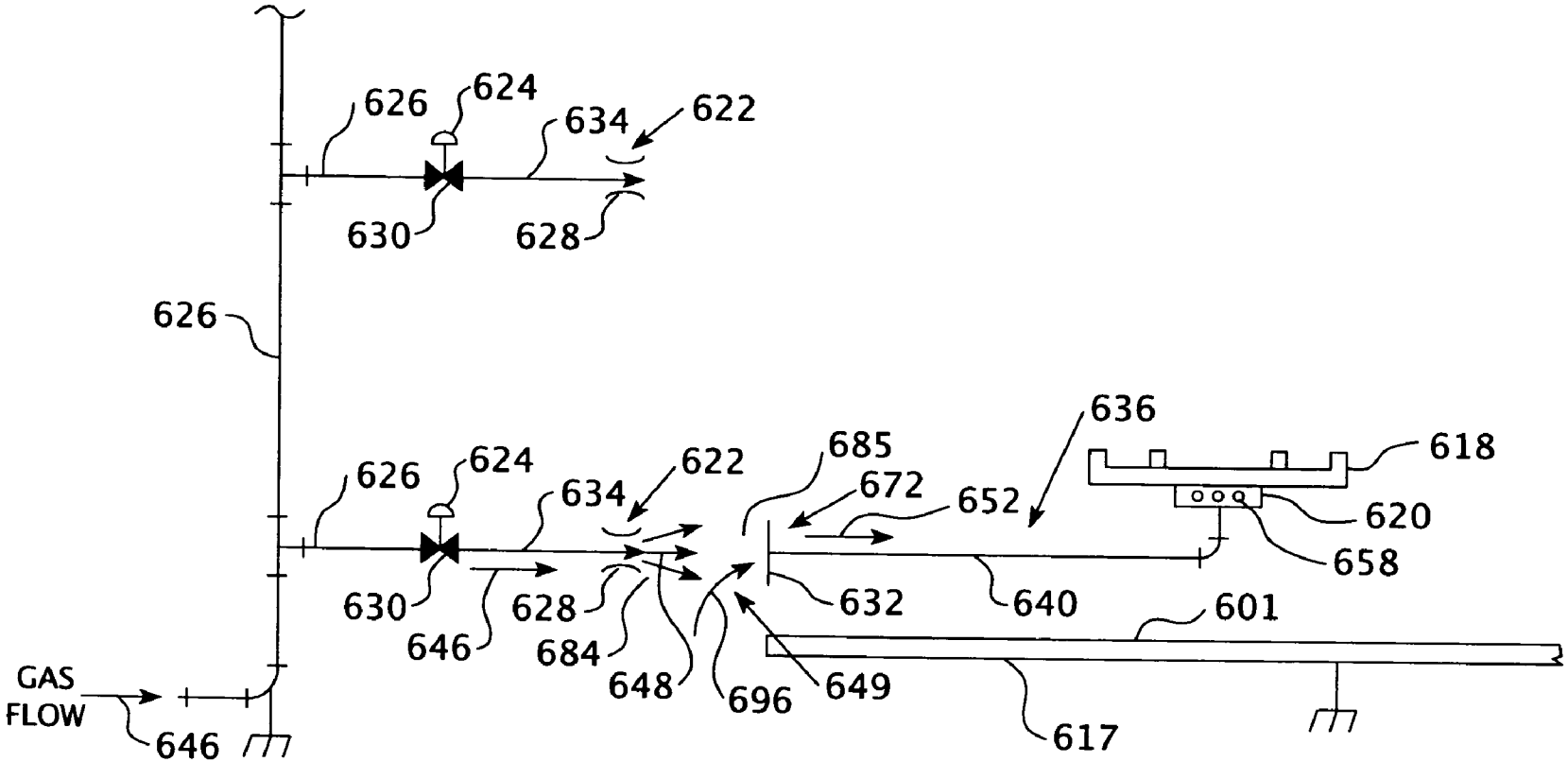
FIG. 6A is a detailed fuel circuit schematic showing a gas-to-air type fuel supplier delivering fuel mixture to a removable burner as per one embodiment of this disclosure.
Figure 6B:
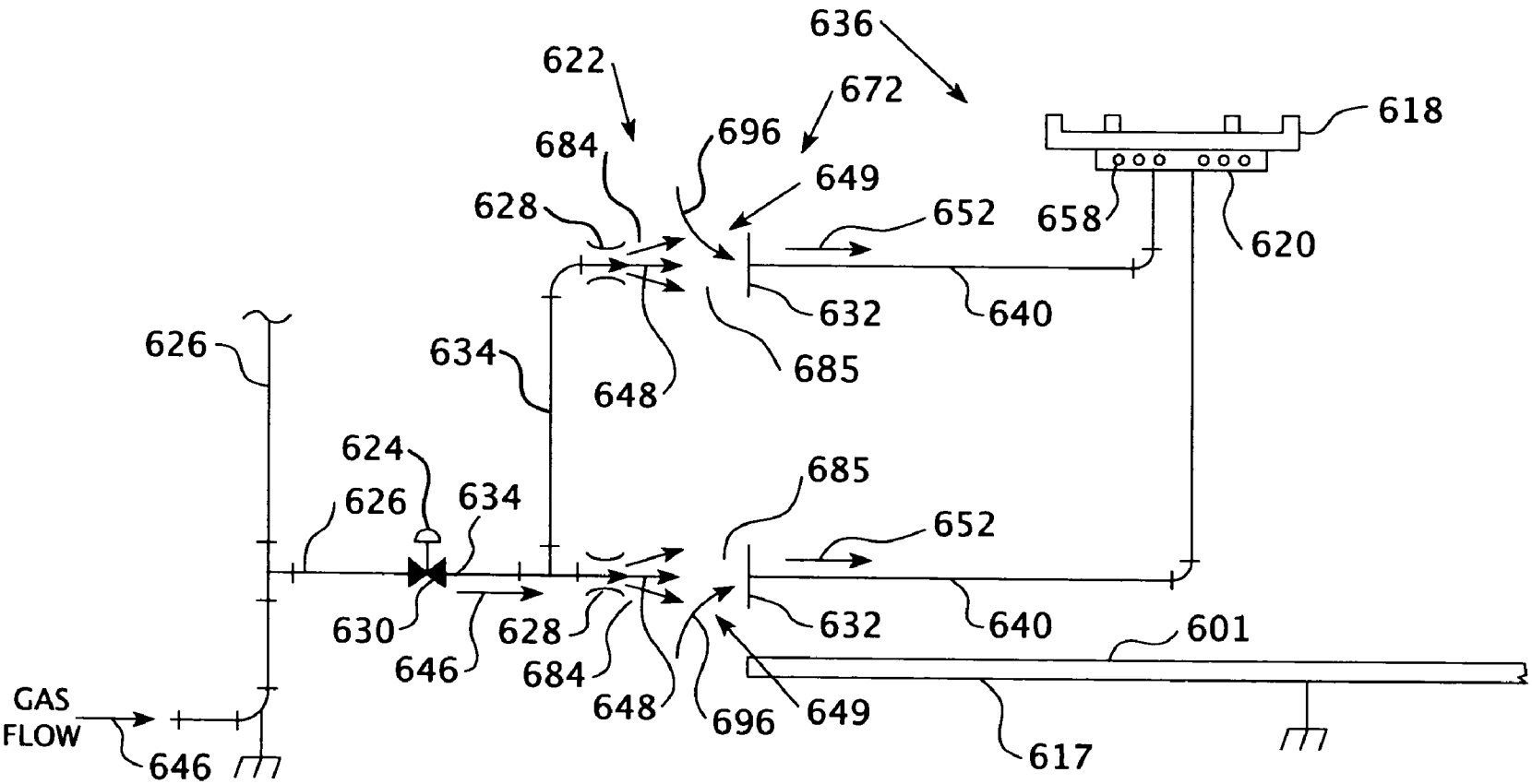
FIG. 6B is a fuel circuit having a gas-to-air fuel supplier having two orifices; delivering fuel mixture to a removable burner having one fuel supplier mate with two entrances.

In FIGS. 6A and 6B alternate representations for a fuel supplier component 622 are schematically shown. Fuel supplier 622 can be substituted for earlier counterpart suppliers 122, 222, 322, 422 or 522.

FIG. 6A schematically details the basic elements of a fuel circuit, otherwise known as a "fuel supply". Therein, a fuel mixture is supplied from supplier 622 to removable burner assembly 636 with its fuel supplier mate 672. As shown, fuel supplier 622 has an orifice 628 (like element 328) which need not fluidly seal or even mechanically connect to mate 672, so long as the latter's entrance 632 (like 332 in FIG. 3C) is properly located with respect to the outlet for orifice 628. Such locating may be performed directly by fuel supplier mate 672 as will be shown in FIGS. 6D and 6F, or indirectly via the removable burner assembly 636, similar to that shown in FIGS. 3B and 3C. Therefore, this type of fuel connection, referred to as a 'gas-to-air type' need not be a physical fuel connection per se, but may be more of a functional fuel connection.

A gas-to-air type fuel connection is explained by Bernoulli's Principle, i.e. that an orifice converts a gas stream under an initial pressure and velocity to a gas jet having higher velocity and lower pressure with higher momentum and near zero gauge pressure if that jet is released to atmosphere. The jet velocity and momentum causes surrounding oxidizer (air) to be entrained in the jet. That jet is more commonly called a 'free' gas jet since the gas therein is very near atmospheric pressure. That jet is made as gas egresses the orifice. And it persists until the jet enters the gas distribution conduit. Therein, the reverse takes place and a portion of gas stream velocity converts to higher than atmospheric pressure for overcoming pressure losses from fluid flow friction.

Preferably, gas manifold 626, or its functional equivalent, which is fluidly connected to gas control 630, is pressure pre-regulated. An operator control, shown as hand knob 624 in FIG. 6A, adjusts gas control 630 for regulating the flow of gas 646 flowing through this system. It is to be understood that still other types of operator control and gas valves may be used in conjunction with this disclosure such as the electronic operator control 524 shown in FIG. 5.

In the representative "fuel circuit", after receiving gas from manifold 626, gas control 630 regulates the flow of gas 646, through conduit 634, to orifice 628. That conduit 634, or manifold 626, can be rigid or flexible and may include a currently known swivel joint, rotating joint or the like. If a flexible conduit was desired, a fuel supplier like element 522 and/or panel 515 could be made retractable, rotatable or both. That would allow such a fuel supplier to be removed from its convertible area or cooktop surface when not in use. Depending on the type of gas control used, it may also be possible to completely eliminate the need for conduit-like items altogether.

When there is gas flow 646, orifice 628 creates a gas jet 648. The diverging arrows at the outlet of orifice 628 in FIG. 6A show such a gas jet entraining oxidizer (air) 696 from its surroundings before entering a mixing zone 649 between the outlet for orifice 628 and entrance 632 to gas distribution conduit 640. In this view, the place where oxidizer enters is designated by elements 684 and 685. Particularly at element 684, oxidizer is introduced from the fuel supplier 622 side and at element 685, from the fuel supplier mate 672 side. It is to be understood that said oxidizer can enter separately from either side, or simultaneously from both sides.

The manner in which fuel supplier 622 engages with fuel supplier mate 672 can take many forms. As described earlier, it does not require a fluid seal between entrance 632 to conduit 640 and fuel supplier 622. Instead, it may use a gas jet for fluid supply (or delivery). Since that gas jet need only be properly positioned at the conduit entrance, the term 'connection' is more broadly defined to also include a more functional versus just a physical connection.

The preferred fuel supplier for this disclosure supplies fuel mixture to the removable burner. This fuel supplier is a "gas-to-air" type and not a "gas-to-gas" type that must have a physical connection like the gas-to-gas type connection of Lee U.S. Pat. No. 5,983,884 that requires a physical fluid seal. Such a fuel supplier has no utility in this disclosure. That type of prior art connection is highly prone to sealing problems, and the location of primary aeration is forced to be nearer the burner head. The latter requires increased grate heights for an equivalent firing rate, or a de-rating of the burner. Further, consumer studies have shown an appliance user's reluctance to make a gas-to-gas connection as users tend to consider such connections unsafe.

FIG. 6B shows a fuel circuit similar to that shown in FIG. 6A but with the latter fuel supplier 622 having one or more orifices 628 that need not be identically sized. As shown, fuel supplier mate 672 has two gas distribution inlets 632 and gas distribution conduits 640 for receiving and delivering fuel mixture 652 to burner head 620. Note that fuel supplier mate 672 need not have two gas distribution inlets or gas distribution conduits. One may suffice depending on venturi and burner design.

Figure 6C:
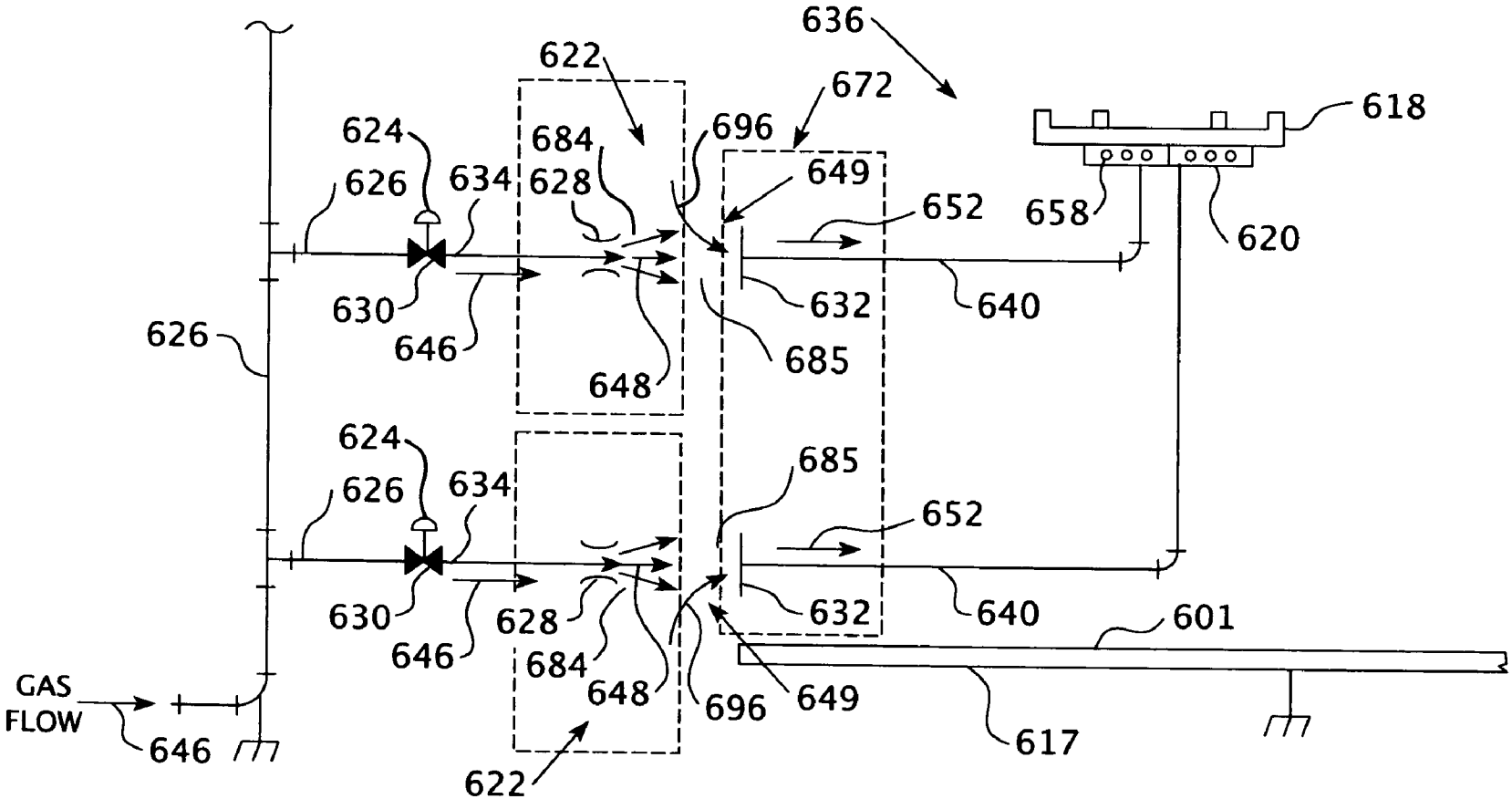
FIG. 6C is a fuel circuit showing two fuel suppliers delivering fuel mixture to a removable partitioned 'single' burner having one fuel supplier mate with two entrances.

FIG. 6C shows a fuel circuit similar to FIG. 6A, but with two fuel suppliers 622 driving a 'single' burner head 620 partitioned in two for receiving a fuel mixture from a fuel supplier mate 672 having two gas distribution inlets 632 and gas distribution conduits 640. When there are two or more fuel suppliers, a gas distribution inlet and gas distribution conduit will be needed for each fuel supplier. In addition, the burner head for such a configuration should not permit fluid communication between the two or more gas distribution conduits.

While no igniter is shown for removable burner 636 in FIG. 6A, 6B, or 6C, most any igniter can be adapted to work with same. The aforementioned removable burner 636 will also work with cooktop 410 or any other appliance variation from previous FIGS. 1 through 5. Alternately, it can be used without an igniter, such as in a recreational vehicle (RV) or marine application by igniting gas at the burner head 620 with a match or handheld lighter.

Figure 6D:
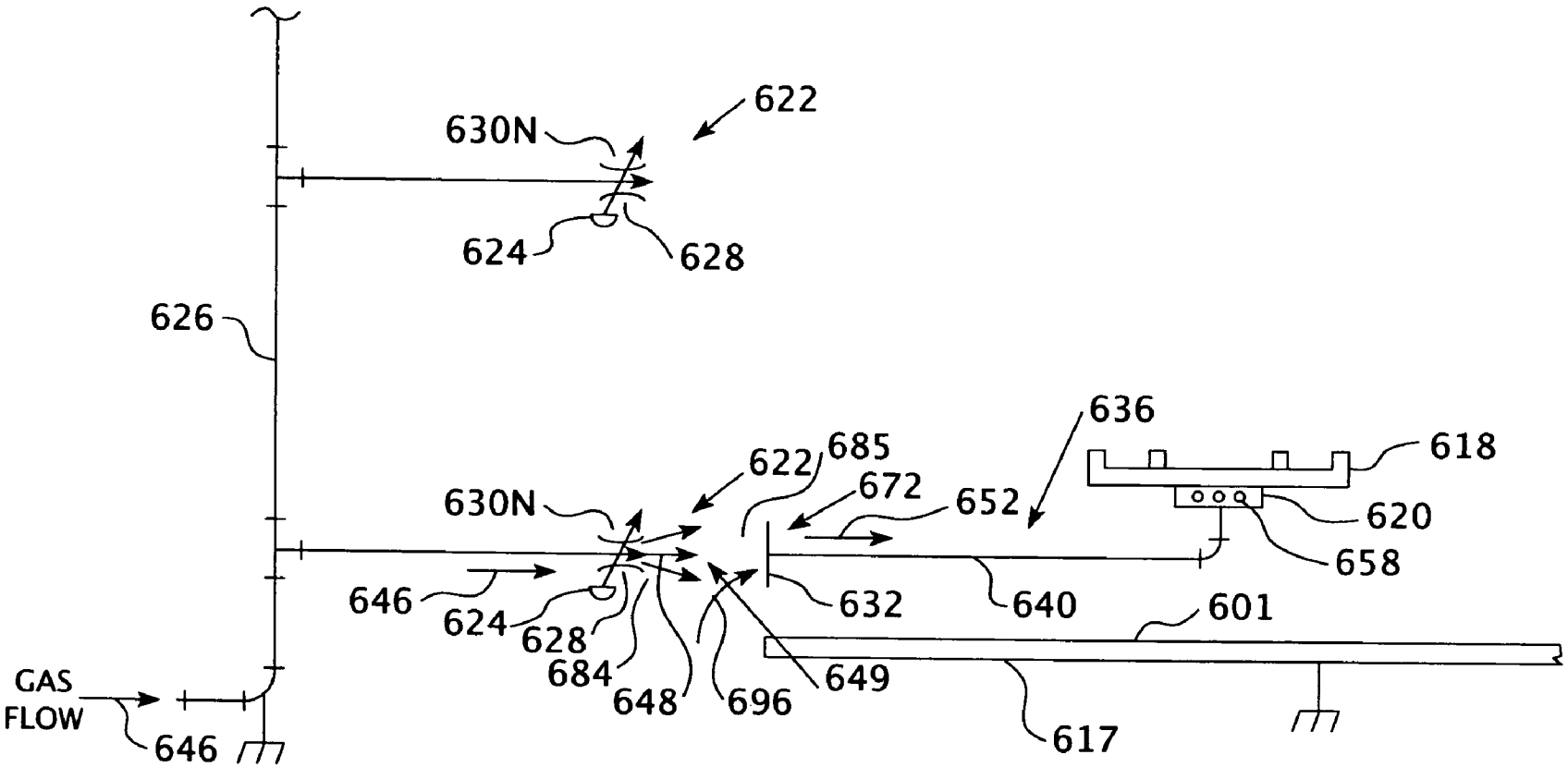
FIG. 6D is a fuel circuit schematic showing a gas-to-air type fuel supplier delivering fuel mixture to a removable burner as per a second embodiment of this disclosure.

While the gas control 630 in FIGS. 6A, 6B and 6C may be shown as a manual type valve, it will be understood that other known controls can be substituted for same. FIG. 6D, for example, is shown using a needle type valve for gas control. Such a valve operates by changing the effective area of orifice 628 while its gas velocity remains relatively constant. In that case, gas control 630 could serve as a valve that uses constant pressure upstream of a "variable-area". It could still have a fixed orifice 628 to control gas flow, thereby mating gas control 630 with orifice 628 and effectively eliminating the need for a conduit-like element 634. Said valve arrangement is schematically shown as element 630N in FIG. 6D with all other elements remaining functionally the same.

As shown, manual valves are used for gas control 630 (or 630N). But such valves can also be replaced with electronic or electrical-type equivalents. In other words, alternate embodiments can use alternate fluid flow devices to control gas flow. Representative of such devices include those where gas flow may be controlled by changing, independently or in combination, one or more of the following variables: fluid pressure differential, fluid flow cross-sectional area, velocity, viscosity, density, and/or conduit length. Such variables may be changed transiently (time dependent) and/or in a "steady state" condition (independent of time).

The above gas control 630 (or 630N), may be accomplished mechanically, electrically, or by both means as in a piezoelectric movement or by using a so-called stepper motor. Representative examples of electronic control valves include: a pulse width modulation ("PWM") valve that turns on and off; a proportional valve for which flow is controlled in proportion to voltage or current; a piezo-activated valve; a micro-electromechanical system ("MEMS") and the like. All such valves may be included with this disclosure and represented by element 630 (630N).

Operator control 624 can also be electronic, yet still compatible with the type of gas control 630 or 630N implemented. Representative examples of electronic operator controls 624 include: an electronic membrane switch; and an electromechanical, solid-state keyboard such as a capacitive, infrared, piezo-effect or field-effect device.

Figure 6E:
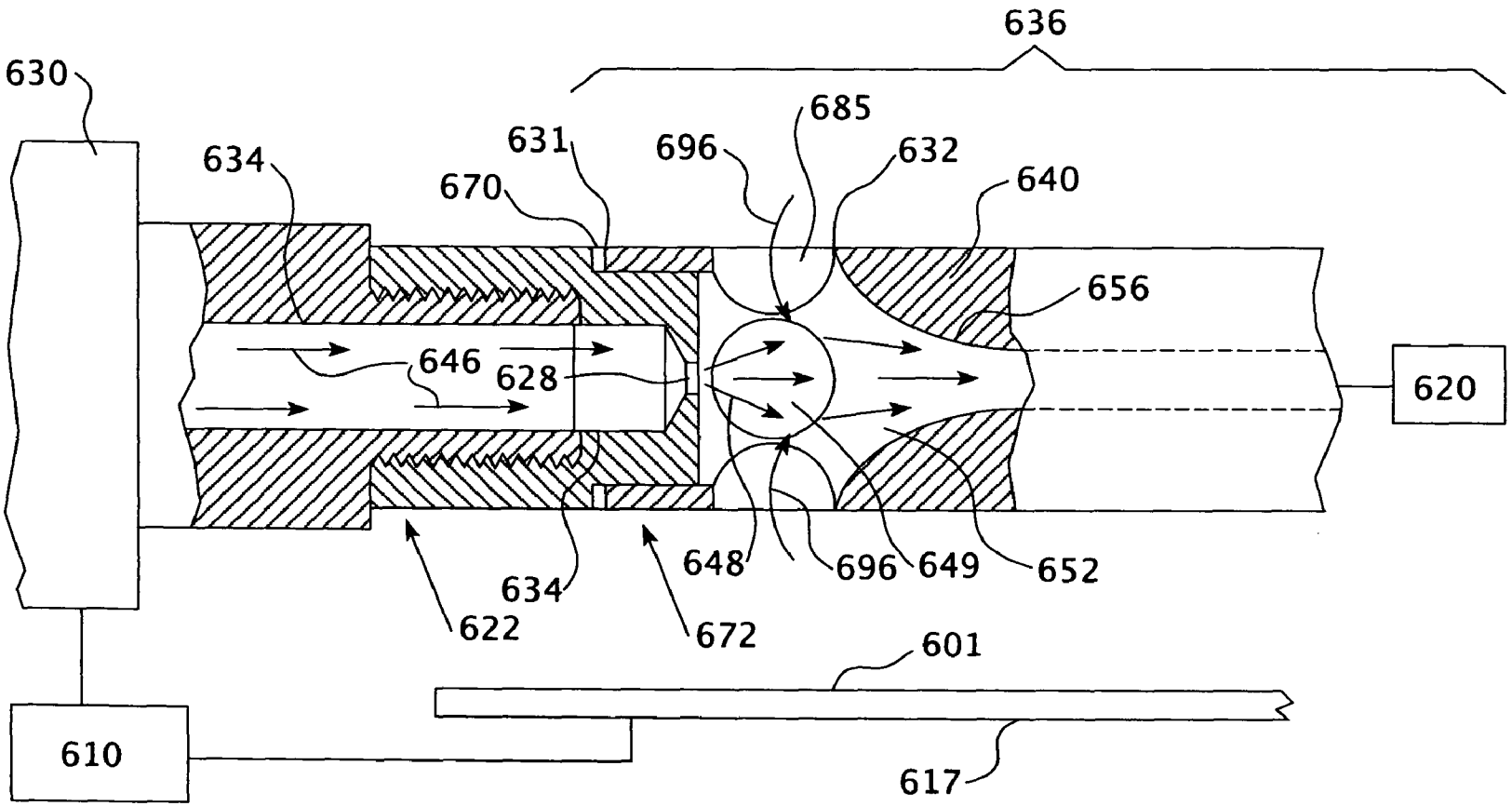
FIG. 6E is a close up, cross-sectional schematic view of the fuel supplier and fuel supplier mate from FIG. 6A having a partial interlock.

FIG. 6E is a cross sectional schematic of the fuel supplier 622 and fuel supplier mate 672 from FIG. 6A with an alternate way to manufacture same depending on the connection hardware employed. This fuel supplier would be similar to the one shown in FIG. 6A.

In FIG. 6E, a portion of manual gas controller 630 (shown indirectly supported by appliance 610) supplies gas 646 to orifice 628 at the terminal end of conduit 634 via a gas-to-air type fuel supply connection. Orifice 628 has an aperture with an axis parallel to the axial direction of conduit 634. A portion of conduit 634 has been made removable by incorporating a threaded seal therein. When gas 646 leaves orifice 628 during normal operation as a jet, oxidizer 696 enters the gas-oxidizer mixing zone 649 via oxidizer conduit 685. That conduit is shown as oxidizer openings into the sides of gas distribution conduit 640. A gas-oxidizer mixture 652 passes through the entrance 632 of gas distribution conduit 640. One end 631 of conduit 640 circumferentially surrounds gas conduit 634 before being stopped by the shoulder 670 on gas conduit 634 of fuel supplier mate 672. This effectively provides a "functional connection" for providing a removable burner a gas mixture over a convertible area (shown as element 601 on cooktop surface 617 indirectly supported by appliance 610).

In preceding FIG. 6A or 6D, elemental end 631 and shoulder 670 were not specifically shown, but such locating (or interlocking), may be performed, directly or indirectly, by fuel supplier mate 672. Oxidizer may enter mixing zone 649 via one or more holes in the vicinity of gas distribution conduit 640 near gas jet 648 and entrance element 632.

For "free gas" jets, the typical shape of gas distribution conduit 640 is a function of fluid flow characteristics for burner head 620. One typical shape known in the art is a bell shaped, mouth entrance 632 that necks down to a throat 656 before diverging for connection to a burner feed conduit like element 651 in FIG. 6H. Such an arrangement is typically referred to as a venturi. Alternately, gas distribution conduit 640 can have a straight profile with no internal shape. Much of the shape of gas distribution conduit 640 depends on the fluid flow characteristics of burner head used, as is recognized by those skilled in the combustion art.

Figure 6F:
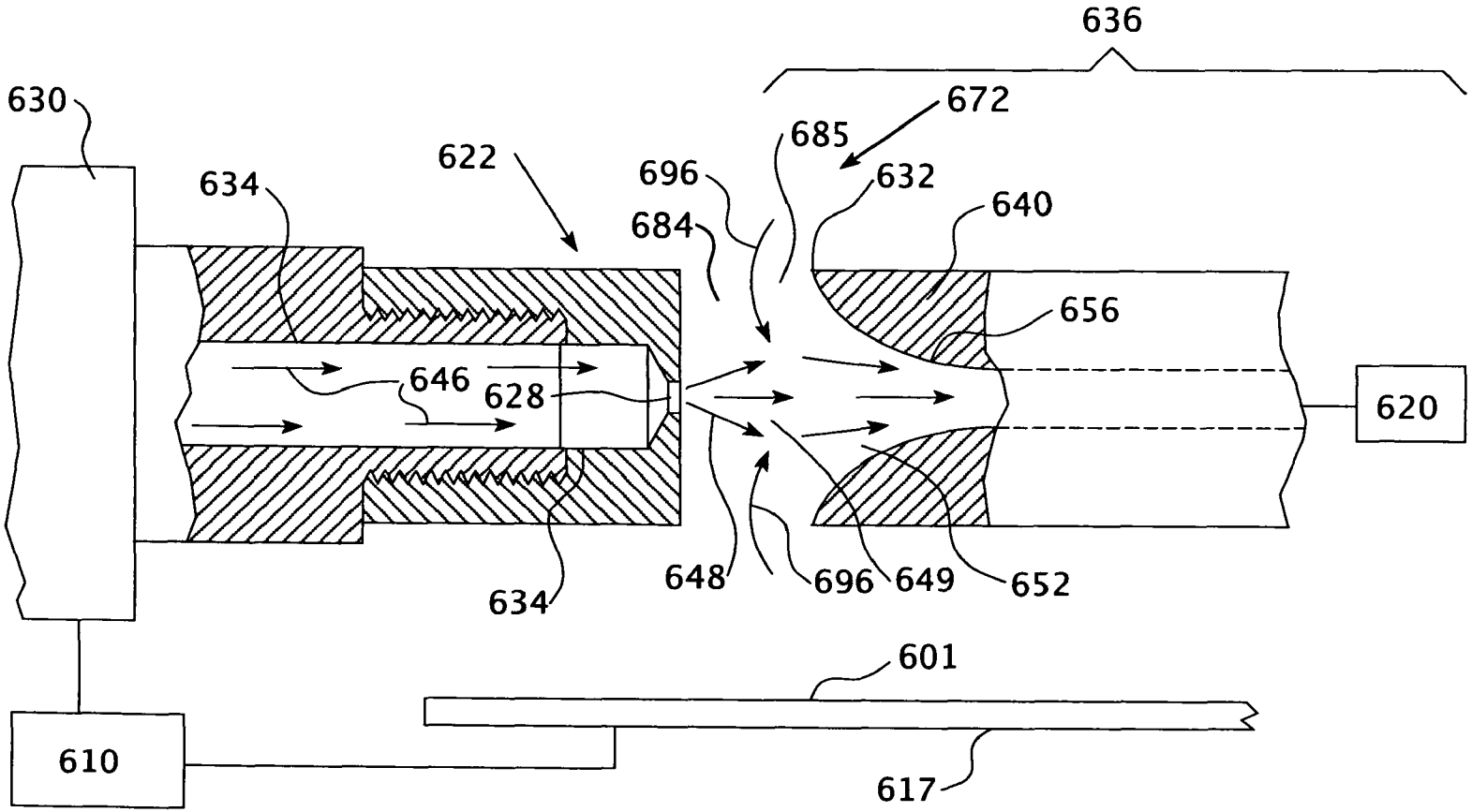
FIG. 6F is a close up, cross-sectional schematic view of the fuel supplier and fuel supplier mate from FIG. 6A.
Figure 6G:
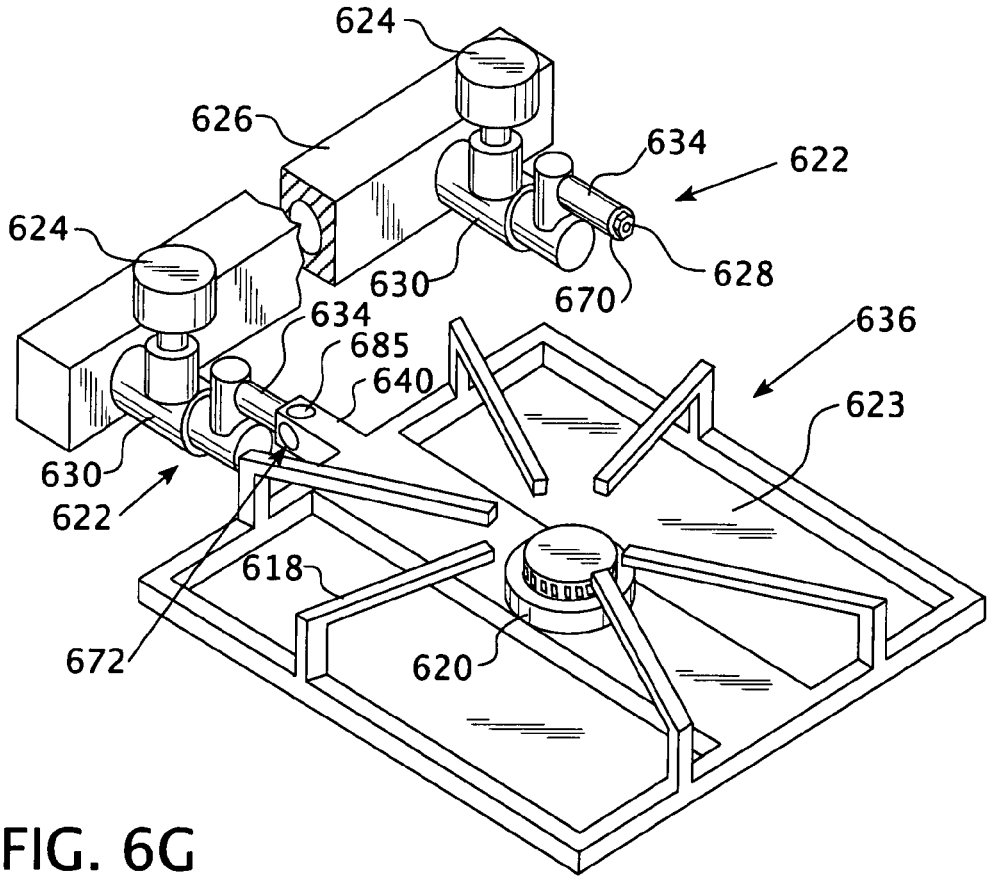
FIG. 6G is a perspective schematic view showing an embodiment of the fuel supplier and fuel supplier mate having a partial interlock shown in FIG. 6A.

FIG. 6F is a gas-to-air type fuel supply similar to FIG. 6E, but with no direct physical connection between fuel supplier mate 672 and fuel supplier 622. Instead, the alternative embodiment at FIG. 6F only shows a fuel supplier mate with a proper gap (much like a spark plug gap) between fuel supplier 622 and gas distribution conduit entrance 632. With just that gap, a fuel mixture may still properly enter entrance 632 of removable burner 636. FIG. 6F is yet another alternate way of manufacturing an appliance hereby, depending on the connection hardware employed. Fuel supplier 622 and cooktop surface 617 (with a convertible area 601 over which fuel mixture is supplied to a removable burner), are each indirectly supported by the appliance 610 as shown.

In FIG. 6G, fuel supplier 622 is schematically shown supplying fuel to a removable burner assembly 636 with its fuel supplier mate 672 connected to fuel supplier 622. This embodiment of removable burner assembly 636 includes a separately removable, heat shield 623 that can be made integral therewith. The latter can thermally protect a cooktop surface, especially when made from glass or other temperature-limited materials. Removable burner assembly 636 may further include a grate 618 and burner head 620, both of which may be separately removable. Meanwhile, manifold 626 is shown fluidly connected for supplying fuel to a manual type gas control valve 630 (or needle type valve 630N). It is common to mount a manifold like element 626 to a structural housing similar to element 412 in FIG. 4. The fuel circuit arrangement of FIG. 6G may be used in a free standing, slide-in, or drop-in appliance.

When adjusted by operator control 624, the gas control 630 of FIG. 6G supplies gas to fuel supplier 622 via conduit 634, then to orifice 628. The latter supplies gas to fuel supplier mate 672. Although not shown in this Figure, but shown in FIG. 6A, oxidizer would then enter through holes (element 685) before being entrained by gas jet and mixed with gas in mixing zone to form a gas-oxidizer mixture. After receiving the aforesaid mixture, the gas distribution conduit 640 for fuel supplier mate 672 delivers fuel mixture to burner head 620. As removable burner 636 is not shown with its own igniter, a manual lighting of gas-oxidizer mixture at burner head 620 would be required. Of course, various ignition means may also be used with the aforementioned configuration.

Figure 6H:
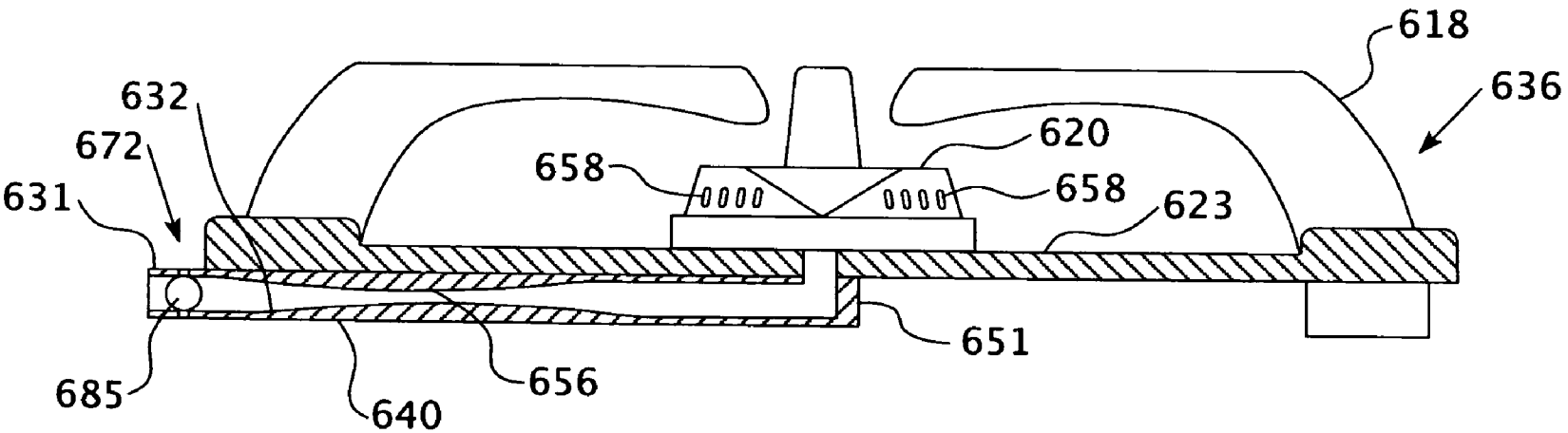
FIG. 6H is a close up schematic showing a side view of a removable burner having a fuel supplier with a partial interlock similar to that shown in FIG. 6G.

FIG. 6H is a cross-sectional schematic of a removable burner assembly 636 that includes a burner head 620 with cooking vessel support or grate 618. In this embodiment, gas burner head 620 is in fluid communication with the burner end 651 to gas distributing conduit 640. It is not essential that this burner head be "completely" sealed depending on the designs known in the art. In FIG. 6H, for example, burner head 620 contains burner ports 658 for flame stabilization. Fuel supplier mate 672 at end 631 could engage a fuel supplier like element 422 in FIG. 4A or element 622 in FIG. 6G to gas distribution conduit 640. Holes 685 in that conduit 640 permit oxidizer 696 (as shown in FIGS. 6A and 6D) to enter mixing zone 649 (also as shown in FIGS. 6A and 6D) when connected to a fuel supplier and operational. As shown, entrance 632 to gas distributing conduit 640 is a bell that necks down to a throat 656 before diverging to a connection with burner feed conduit 651.

Other internal gas distribution conduit shapes are also possible. They can vary with burner head 620 fluid flow characteristics as discussed above. As used herein, a "removable burner assembly" may consist of several, integrated components. In some of the figures, these components are depicted as separate items. They may be assembled together by a manufacturer, retailer, installer or the ultimate consumer/appliance purchaser. The removable burner assembly can also contain fewer physical components than depicted. For example, if burner feed conduit 651 is a part of grate 618 (i.e. each grate 'finger' is hollow and has burner holes 658) then the grate and the burner head are combined physically, but function in the same manner as described, such a grate would be considered integral with burner head 620.

Returning briefly back to FIG. 3A, removable burner assembly 336 is shown with an igniter 362. Similarly, removable burner assembly 536 in FIG. 5 has an igniter 562. An integrated (i.e. other than manual) flame ignition is preferred for most removable burner configurations especially when used in larger cooking apparatus/appliances. Various integrated ignition types can be included with the removable burner assembly, fuel supplier, and fuel supplier mate assemblies previously shown for FIGS. 1 through 6H.

Figure 7:
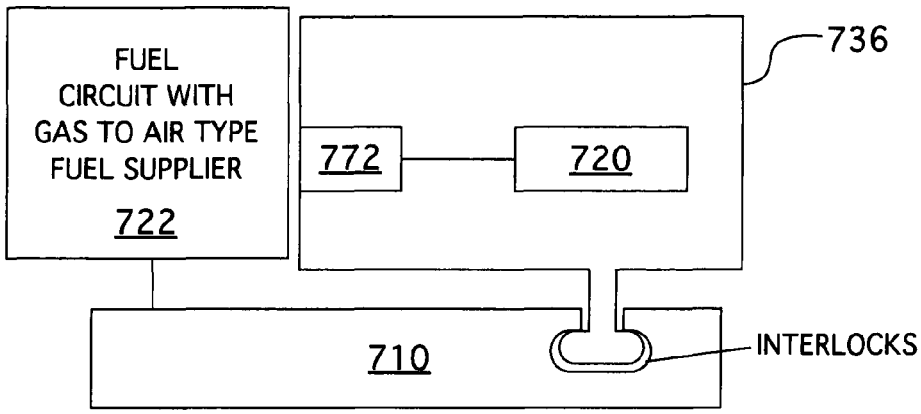
FIG. 7 is a first block diagram schematic showing an interlock interrelationship between the elements of the disclosure.
Figure 8:
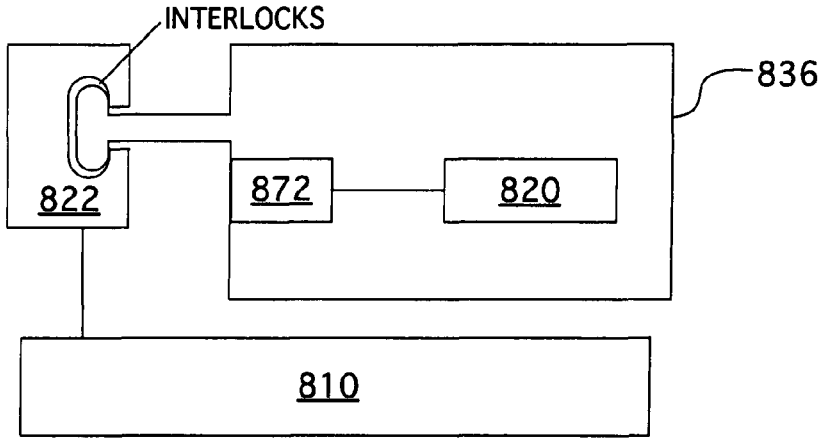
FIG. 8 is a second block diagram schematic showing an alternative interlock interrelationship between the elements of the disclosure.
Figure 9:
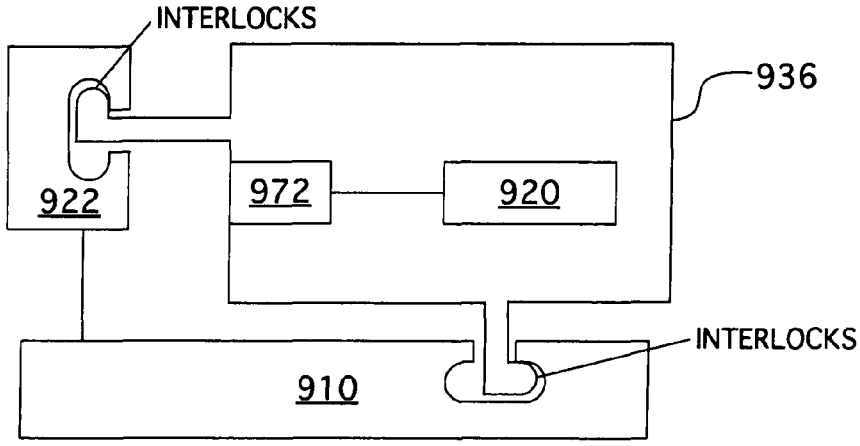
FIG. 9 is a third block diagram schematic showing an interlock with partial interlocks and interrelationship between the elements of the disclosure.

FIGS. 7, 8, and 9 all show block diagrams of the disclosure to clarify the relationship of the elements of the disclosure. FIG. 7 shows that when the removable burner assembly is properly installed to the appliance (as defined above), an interlock prevents the burner from moving about during cooking. Such an interlock would be mandatory for the fuel supplier mate shown in FIG. 6F. An interlock can assume many different forms. It need not be one element of the appliance or burner, as shown in earlier FIGS. 3B and 3C. In FIG. 7, an interlock is positioned between removable burner assembly 736 and the appliance 710. Removable burner assembly 736 has at least one burner head 720 and a fuel supplier mate 772 located by the interlock for properly receiving fuel from a gas-to-air type fuel supplier 622. In previous figures, the fuel supplier is part of the fuel circuit, in turn, a part of the appliance proper.

FIG. 8 is similar to FIG. 7 except the interlock occurs between the fuel supplier 822 and fuel supplier mate 872. FIG. 8 better depicts the earlier interlock from FIGS. 3B and 3C.

FIG. 9 is similar to FIGS. 7 and 8, except that instead of an interlock between any two elements, a portion of interlock occurs between: (a) fuel supplier 922 and fuel supplier mate 972; and also between (b) removable burner assembly 936 and the appliance 910. In other words, in FIG. 9, an interlock still occurs, but "in combination". FIGS. 6E, 6G, and 6H also depict such an interlock. Referring briefly back to FIG. 6E, a "partial" interlock therein, interlocks the fuel supplier mate to its fuel supplier, keeping the components in alignment (end 631 of conduit 640 circumferentially surrounding gas conduit 634). A removable burner can be moved horizontally away from the fuel supplier, thus only partially interlocking with same. For instance, a burner assembly with lower supports (or burner feet) can be blocked by a lip at the edge of the cooktop surface. That would constitute a partial interlock and such a burner would be effectively interlocked by the combination of two partial interlocks.

Figures 10A, 10B:
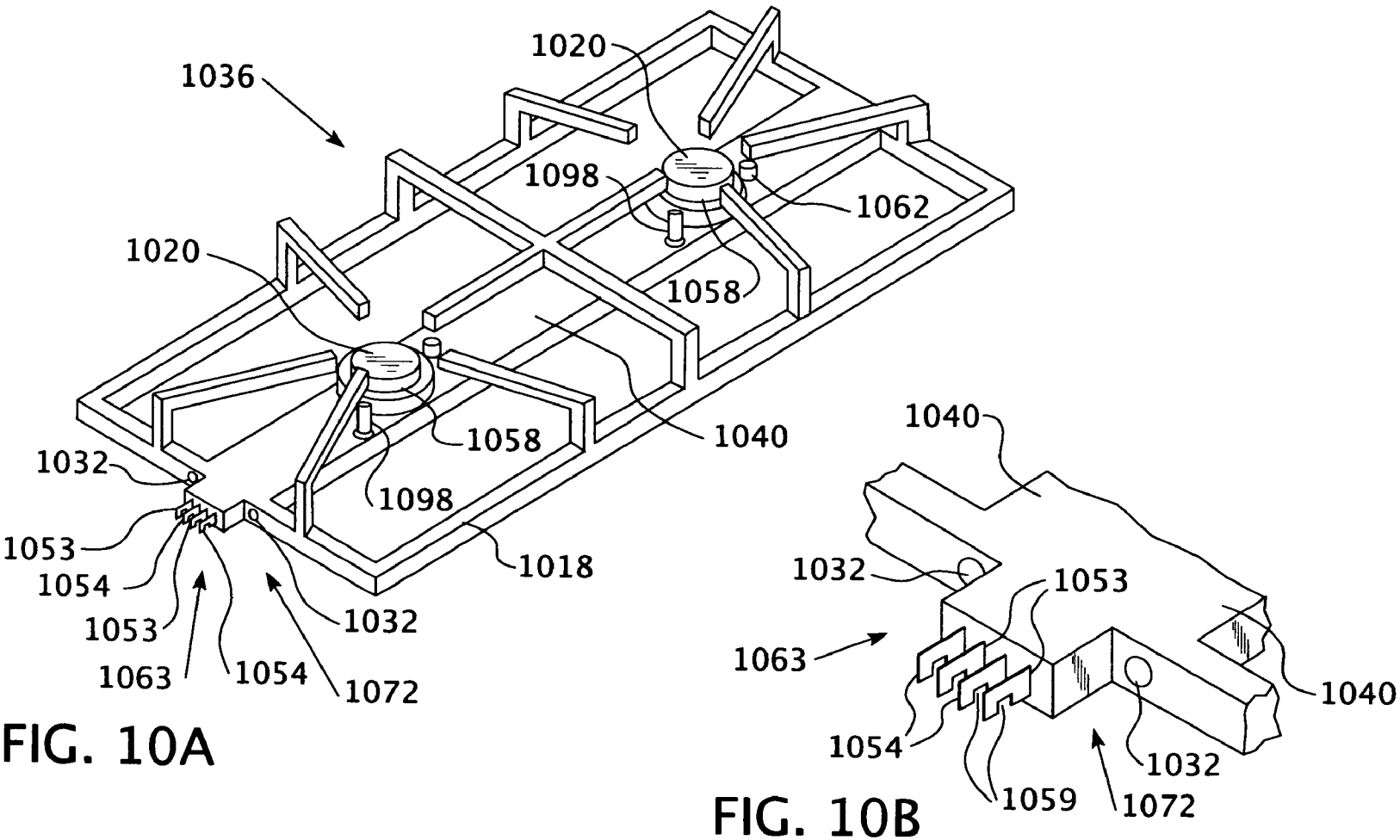
FIG. 10A is a perspective view of a representative removable burner assembly for use in the present disclosure.
FIG. 10B is an enlarged schematic of the electrical receiver from the removable burner assembly in FIG. 10A.

In FIG. 10A, there is shown an isometric schematic for removable burner assembly 1036, it is substantially similar to earlier burners 336 and 536. The representative igniter 1062 depicted is a spark igniter type. It is understood, however, that still other types may be used, including hot wire or hot surface-type igniters. Common to all such igniters is a requirement for electric power. Hence, at least one power lead (depending upon ignition circuit) will be required to complete the electric circuit when operably installed.

Still other types of igniters can also be used herewith. They include a standing gas pilot type which does not require electrical power. Such an igniter may be more beneficial for some situations. In later FIG. 11, a flash tube-type gas pilot is described in more detail.

Also in FIG. 10A, sensor 1098 is shown integral with removable burner 1036. Some agencies require an extra level of safety with an automatic termination of gas flow (or "shut-off") if the appliance flame is in an unsafe operating mode (known in the art as "flame proving means"). Means for automatically terminating gas flow may require adding a sensor 1098 to detect a flame presence at burner head 1020. And while it may be feasible to have just one igniter 1062 and sensor 1098 for a 'single' burner head 1020 supplied by one fuel supplier (with no internal partitions dividing the burner head), there can also be one igniter 1062 and sensor 1098 for each portion of a burner head 1020 if that burner head is proportioned to be supplied by multiple fuel suppliers (having internal partitions).

Sensor 1098 in FIG. 10A is shown as a separate element for clarity. It is known in the art to combine such sensors with an igniter 1062. In some cases, the igniter and sensor are the same component. A representative model is a spark igniter that also functions as an electrode when a sensing method is employed for flame rectification. Suitable types of non-igniter sensors include a thermocouple, an infrared sensor, a thermistor, and an optical, including fiber optic sensor, or separate non-sparking electrode for flame rectification.

In FIG. 10B, removable burner assembly 1036 has at least one electrical receiver 1063 with one or more electrical leads or connectors 1053. The latter are schematically shown as spade types for clarity. It is to be understood, however, that other types of leads can be employed for receiving power from a mating, electrical supply connector for igniter 1062. The same can also be located on the cooking appliance proper, such as an electrical connector in an aperture of the cooktop surface, the connector being flush with its surroundings. An electrical receiver 1063, and its corresponding electrical supplier mate, can help to locate fuel supplier mate 1072 for removable burner 1036, or can be a portion of an interlock as was shown in FIGS. 3B and 3C. This is especially true for the "gas-to-air type" connector described in FIG. 6A through FIG. 9 above.

Each burner head 1020 in FIG. 10A has an entrance 1032 to gas distribution conduit 1040 (normally one per burner head). Those burner heads 1020 can vary in size and the number of ports 1058 per head. Though not shown, one or more fuel suppliers, and their corresponding gas distribution conduits 1040, can supply a 'single' head 1020 when that head is duly proportioned. Should only a 'single proportioned' burner head be used, only one igniter 1062 is needed, much like a single grate 1018 is shared as shown. Such a 'single proportioned' burner head design might more closely resemble the types of burners used in woks, fish burners, griddles and the like.

A sensor, like element 1098, and its sensing circuit may communicate with an appliance via electromagnetic or photonic (i.e., non-contacting) means. The types of communications schematically shown in FIGS. 10A and 10B both use electrical contact leads. Of course, non-contacting means may also be used with same provided other means for connecting the removable burner assembly to the appliance is provided.

The sensor connector 1054 of FIG. 10A is a part of electrical receiver 1063. In FIG. 10B, that portion of removable burner 1036 of FIG. 10A having fuel supplier mate 1072 is more clearly shown. Two sensor connectors 1054 and two electrical connectors 1053 are shown, one for each burner head 1020. Since these electrical connections require a complete circuit, removable burner assembly 1036 must act as the ground (or neutral connection, burner assembly being electrical conductive) when the removable burner is in contact with an already grounded appliance. That ground need can be avoided, however, if the power supply to igniter 1062 and/or sensor 1098 is isolated and another connector is provided, or as is common practice in the art, two or more igniters share one common and power connection. Alternatively, one connector can be employed for all igniters on a burner assembly if the burner assembly itself completes the circuit by being ground or the neutral leg.

If other external switching circuitry is provided in the control for removable burner assembly 1036, one may reduce the number of connectors needed to just one per burner head. A separate 'sensing' electrical receiver can also be employed. That sensor need not be integral with the electrical receiver as shown, however. Connector 1054 represents a sensor communication to an appliance regardless of sensing type and/or communication means. Also note in this representation the notch 1059 in each connector 1054 and 1053. Such a notch represents in combination with other removable burner and/or appliance features an interlock for the removable burner when that removable burner is mounted above a convertible area that might be planar without an outer drip lip for completely stopping burner horizontal movement (i.e. interlocking).

Figure 11:
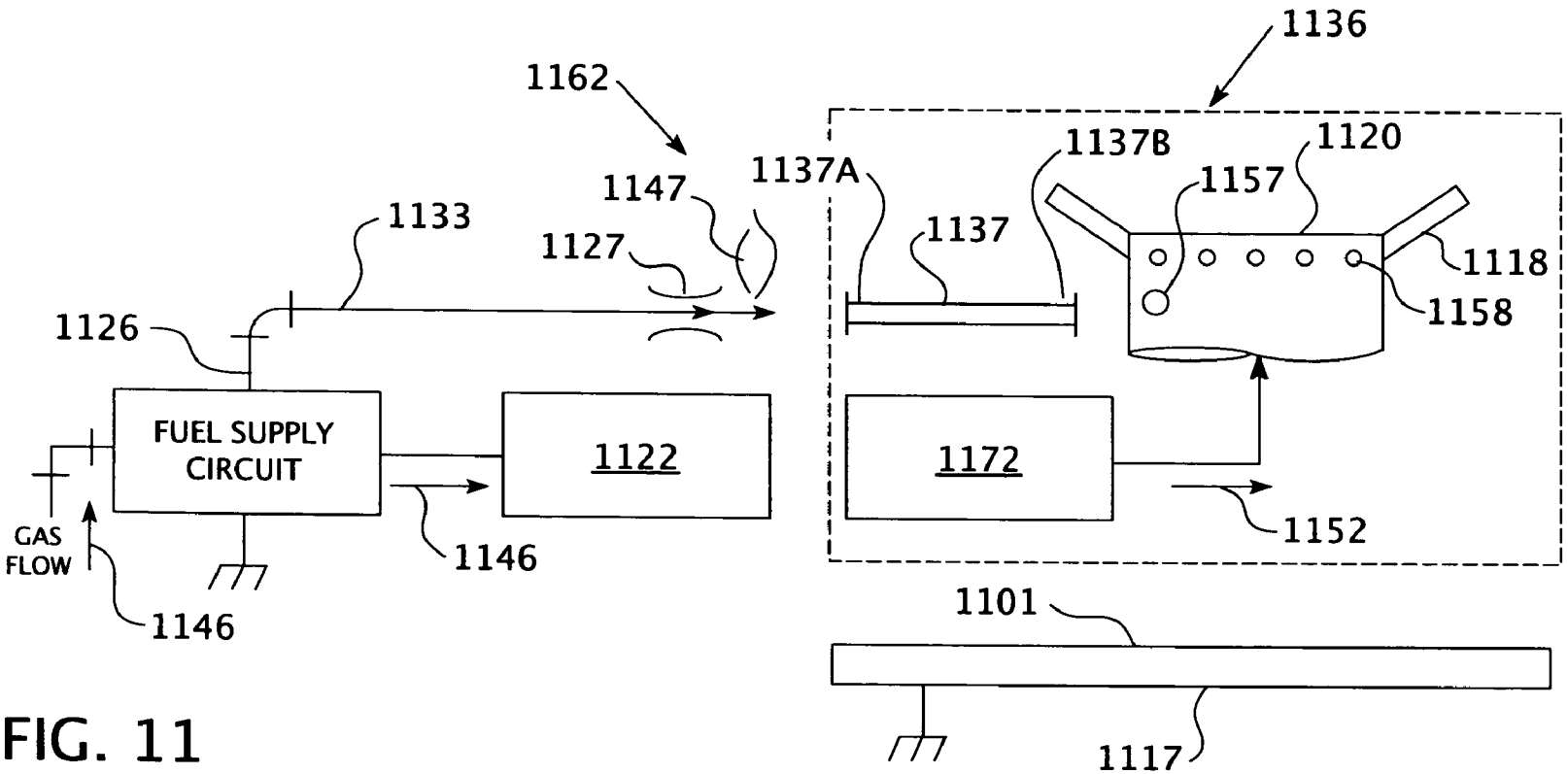
FIG. 11 is a detailed side view of one igniter embodiment for use with the present disclosure.

FIG. 11 shows an alternative ignition arrangement for removable burner assembly 1136 shown schematically in side view over cooktop surface 1117 with an imperforate convertible area 1101. Therein, igniter 1162 is depicted as a pilot 1147 (flame). Any previously shown fuel circuit having a fuel supplier (represented by element 1122) and a removable burner having a fuel supplier mate (represented by element 1172) can be used with such an ignition schematic. Still other components for gas pilot 1147 include a gas pilot conduit 1133 for supplying fuel 1146 from manifold 1126 to pilot orifice 1127. Once lighted (manually or otherwise), that pilot flame will ignite gas when a fuel mixture is supplied to burner head 1120 on removable burner 1136 mounted above cooktop surface 1117 in convertible area 1101. A small portion of gas-oxidizer mixture 1152 leaves that burner head unignited via pilot port 1157. That mixture enters a flash tube terminal end 1137B sufficiently spaced from pilot port 1157. Said terminal end 1137B should be duly sized for its mixture flame velocity to be greater than its flow velocity. Gas momentum will then force mixture 1152 to terminal end 1137A of flash tube 1137 for egress in the vicinity of igniter 1162 (here shown as pilot flame 1147). A portion of that fuel mixture 1152 will ignite. And the flame front, with greater velocity in flash tube 1137 than fuel mixture's 1152 flow velocity, will travel to port 1157. There, the flame front will stop either because burner port 1157 has a greater port velocity than its flame velocity; or burner port 1157 has a sufficient quench diameter for stopping flame front propagation. In either case, the flame will be ignited and maintained at head 1120 of burner port 1157.

Due to buoyancy and the gap between removable burner head 1120 and flash tube terminal end 1137B, the shape of the aforesaid flame will be sufficient for preventing it from impinging on the flash tube. As that flame shape is accessible to other ports 1158 on burner head 1120, it may ignite the gas-oxidizer mixture egressing from such ports, directly or indirectly, by igniting at least one such port 1158. In FIG. 11, pilot port 1157 is shown as a separate burner port. In practice, however, pilot burner port may be the same as burner port 1158. Such is the case with most commercial water heater burners.

Igniter 1162 can be other types, such as a spark, hot wire or surface igniters, can be used with flash tube 1137, should one desire to avoid using a gas pilot. Gas pilot line 1133 and pilot orifice 1127 would not be needed for alternative igniter types. And while removable burner assembly's flash tube 1137 need not be included with an appliance, the igniter 1162 can be included as an integral part of same.

Figure 12:
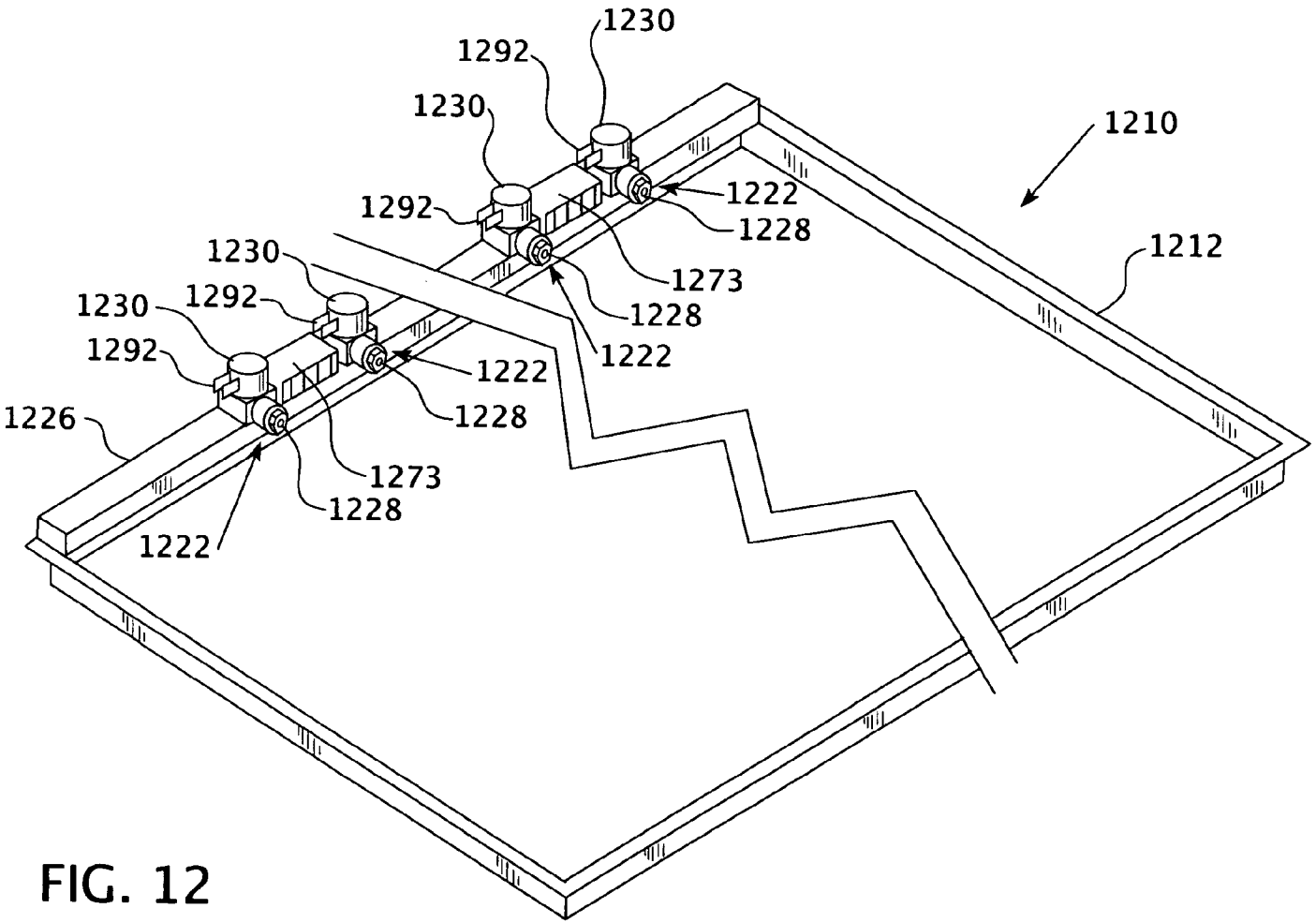
FIG. 12 is a perspective view of a partially dissembled, cooktop appliance according to one embodiment of the disclosure.

FIG. 12 shows schematically a cooking appliance 1210 that operates directly with a removable burner such as that which was shown in FIG. 10A as assembly 1036. Cooking appliance 1210 is similar to appliance 510 from FIG. 5, but with a cooktop surface 1217 (including electronic operator control 1224) and panel 1215 removed from structural housing 1212 for better illustrating its fuel suppliers 1222. In this particular embodiment, each 'gas-to-air type' fuel supplier 1222 includes an orifice 1228 and electronic valve-type gas control 1230.

As shown, gas control 1230 of FIG. 12 is an electric solenoid operated, PWM-type valve directly and fluidly connected to manifold 1226. It has electrical connectors 1292 for power control. Gas control 1230 can also connect directly and fluidly to orifice 1228, much the same as was shown as element 630N in FIG. 6B. Fuel supplier 1222 mates with the fuel supplier mate 1072 to removable burner assembly 1036, and electric supplier 1273 mates to electrical receiver 1063. The latter mate supplies electrical power to burner head igniter 1062. It further communicates with connector 1054 for sensor 1098. Electronic controls could similarly operate the sensor 1098 or igniter 1062 of removable burner 1036 from FIG. 10A. Yet, it is more typical to manipulate the gas control 1230, igniter and sensor from an operator control 1224 similar to the way in which operator control 524 is used over the cooktop 517 in FIG. 5. It is also possible to use separate controls for sensor 1098 and igniters 1062, herein.

Sensor 1098 provides flame sensing for an automatic gas shutoff device. Sensor 1098 in combination with gas control 1230 and electronic control for both elements, can stop gas flow to fuel supplier 1222. This provides gas shutoff automatically if an operator would attempt to relocate a removable burner while it is operating, or if the removable burner is not properly located on the appliance so as to properly receive fuel mixture from fuel supplier 1222. In addition, a second redundant gas shutoff device (not shown) could be placed in fluid communication with the fuel circuit shown here as manifold 1226 up to orifice 1228. Still other locations for an electrical supplier 1273 and electrical receiver, like element 1063 in FIG. 10B, are possible. For example, electrical supplier 1273 may be integrated with cooktop surface 1217 (an electrical connection made flush with the surface as described earlier) or its FIG. 5 equivalent 517, so as to contact an electrical receiver 1063 which may be alternatively located on the bottom of a removable burner assembly 1036.

A gas shutoff device can be combined with the previously shown fuel circuits having a gas-to-air fuel supplier so that when a removable burner is relocated, gas delivery will be stopped. One preferred shutoff device of this disclosure employs an 'electromagnetic valve' like those made and sold by Orkli, but for 'flame safety' (otherwise known as a flame safety valve). Such a valve, is placed in line with and in fluid communication with the fuel circuit and fuel supplier, and will require gas to flow through it before reaching the fuel supplier.

Figure 13A:
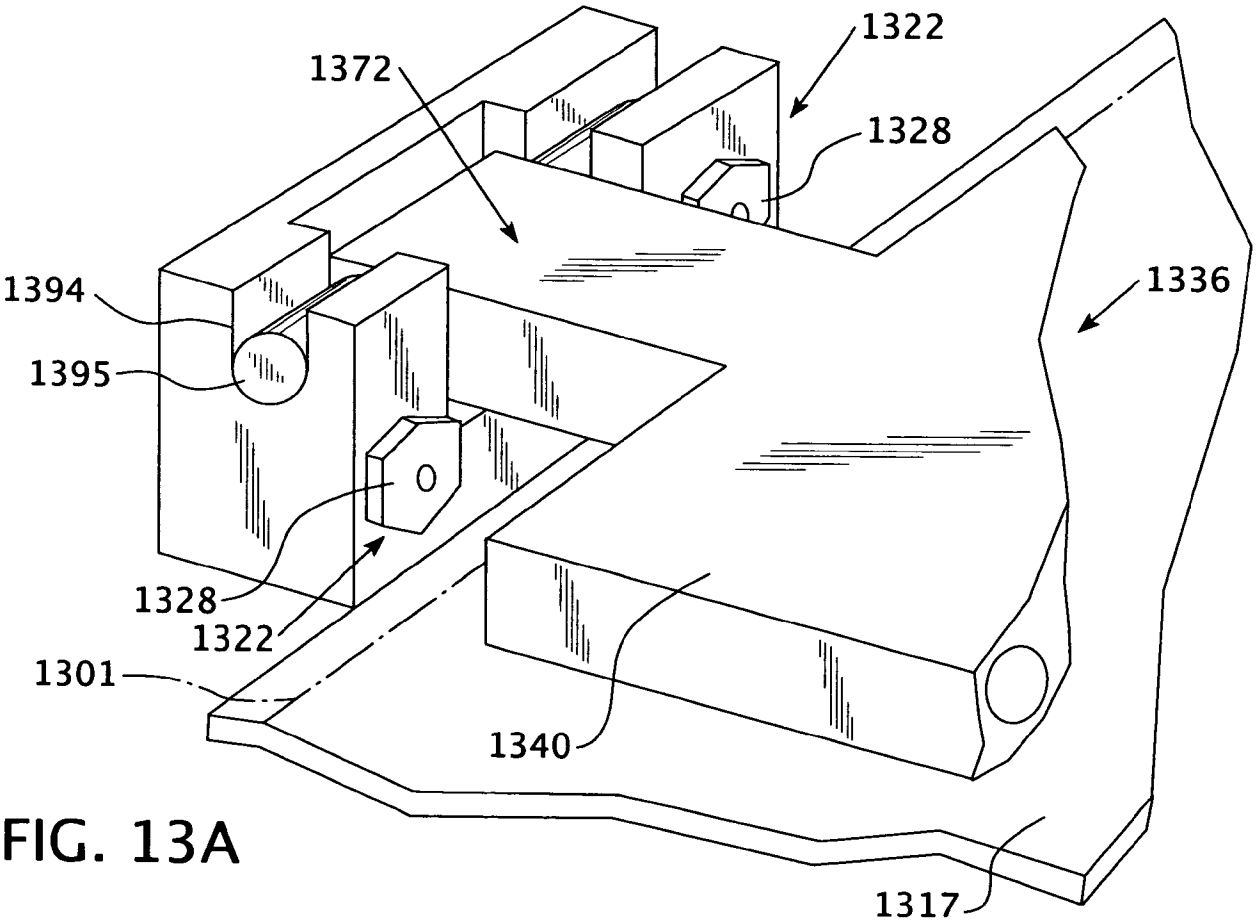
FIG. 13A is a perspective view showing a partial view of a preferred hinge assembly for the fuel supplier of this disclosure, said hinge assembly having multiple degrees of movement.
Figure 13B:
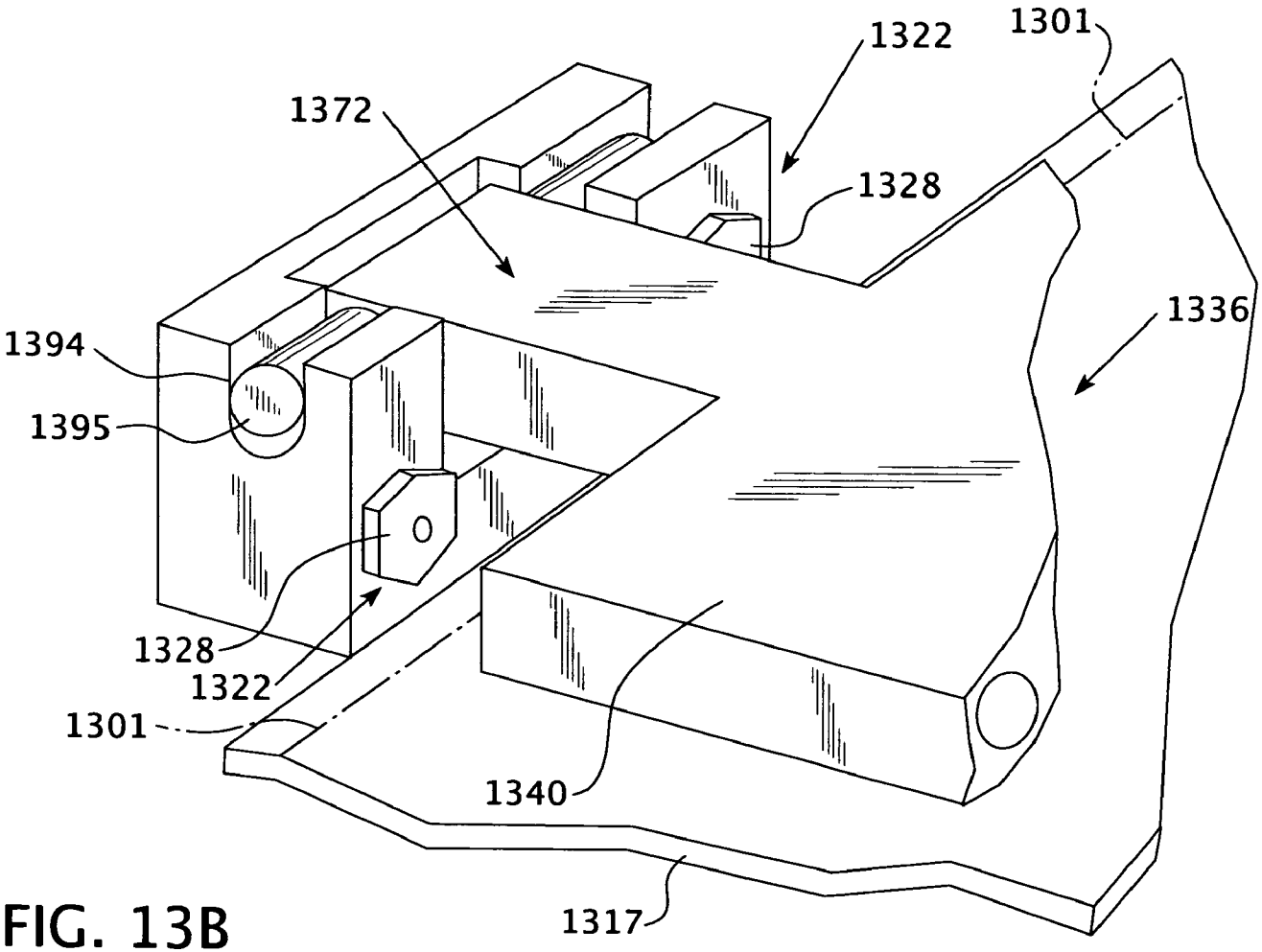
FIG. 13B is a perspective view showing the FIG. 13A fuel supplier mate moving vertically upward, in its first degree of movement.
Figure 13C:
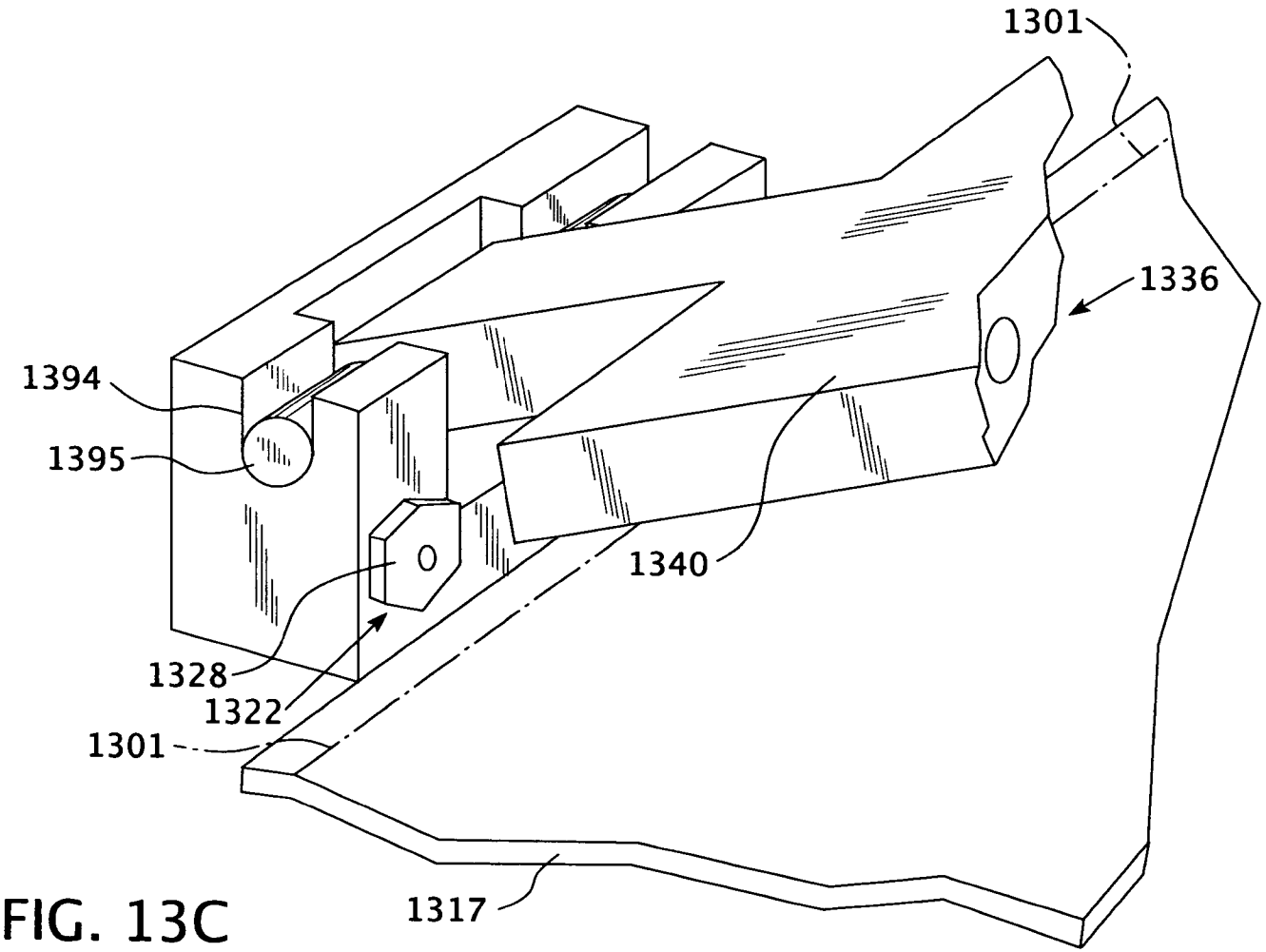
FIG. 13C is a perspective view showing the FIG. 13A fuel supplier mate moving in its second degree of movement, rotationally upward.

FIGS. 13A through C schematically show an interlock for a fuel supplier/removable burner assembly which may be moved by rotation and/or translation from the cooktop for better cleaning the convertible area beneath.

An advantage of this disclosure is that removable burners need not always occupy the convertible area of a cooktop. As such, that convertible area can be left devoid of apertures and/or other obstructions that impede cleaning. By "removing" such burners, this disclosure can allow the same convertible area to also be used as a food preparation work area. The disclosure does not require total removal of the burner by disconnecting and storage of that burner, however. A useful work area can also be accessed with burner relocation. From earlier schematic discussions, recall how preferred embodiments of a conduit (like element 634) may be made flexible and/or include a flexible swivel joint or the like. In essence, this permits several configurations in which a fuel supplier can be moved away from the cooktop after use. If a removable burner assembly was fastened to its fuel supplier, it could be similarly moved away. In other instances, the removable burner may be moved by one or more degrees of movement, i.e. by translation and rotation so that the fuel supplier and burner, or at least portions thereof, can be stowed after removal. That would permit the cooktop surface with its convertible area to be more thoroughly cleaned and used for food preparation.

One embodiment of this disclosure addresses a removable burner that can be moved away from the cooktop area, but left partially attached to the appliance. Such movement is facilitated with a type of a hinge mechanism interlock. The latter can assume several forms. A "hinged" interlock can be a separate functional element or made integral with one or more other elements of the appliance or removable burner as schematically shown in FIGS. 7, 8, and 9. For instance, it is conceivable to incorporate such an interlock design together with the fuel supplier and fuel supplier mate. Configurations like these are especially advantageous in small kitchens with a limited amount of storage space. In those environments, total removal of the removable burner from the appliance proper may be available but impractical as the loss of space from storing removed burners elsewhere may outweigh the advantages of easy cleanup and/or added worktop surfaces.

FIG. 13A shows a gas-to-air type fuel supplier 1322 with a portion of a removable burner assembly 1336 operably installed by an interlock to receive fuel mixture from fuel supplier 1322. More particularly, connection 1395 permits removable burner assembly 1336 to move mechanically in multiple degrees of movement. Once the removable burner is moved, convertible area 1301 will be freed from obstruction thereby allowing easier cleaning of the underlying cooktop.

If connection 1395 was raised straight up (i.e. substantially vertically using just one degree of movement) and away from groove 1394, removable burner assembly 1336 could be fully removed from its cooktop as best seen in the start of that direction of movement in accompanying FIG. 13B. Although not shown, it will be understood that still other connections which provide at least one degree of movement for an interlock may be used. For instance, a horizontal track or groove may be substituted for the vertical groove 1394 shown. Such movement constitutes one mechanical degree of movement for the removable burner assemblies of this disclosure. One degree of movement, shown as mostly linear, can free the removable burner assembly from its fuel supplier without having to first flip the unit upwards. That would be a preferred movement for cleaning a spill, especially if that removable burner unit contained a heat shield that at least partially contained such a spill. By keeping a soiled removable burner substantially horizontal, the removable burner and its spillage can be lifted away while being kept relatively "flat". The unwanted contents of that removable burner can then be dumped remotely before a more thorough cleaning is performed.

A flipping or mere axial rotation of removable burner assembly 1336 is the other or "second" degree of movement. That motion is partially depicted in accompanying FIG. 13C. Note, that both degrees of movement are independent of one another. They can also be combined for near simultaneous motion in both directions. As previously stated, other connections that provide at least one degree of movement for an interlock may be used. Such interlocks are preferred in this disclosure as they fulfill the need to prevent movement of the removable burner assemblies during normal usage, especially when a vessel gets dragged across the grate. FIG. 13A shows an interlock that requires only one degree of movement (though more can be used) to remove or install a removable burner assembly. The flip up movement of FIG. 13C, on the other hand, shows that a removable burner need not be completely removed from the appliance for providing a workspace.

Figure 14A:
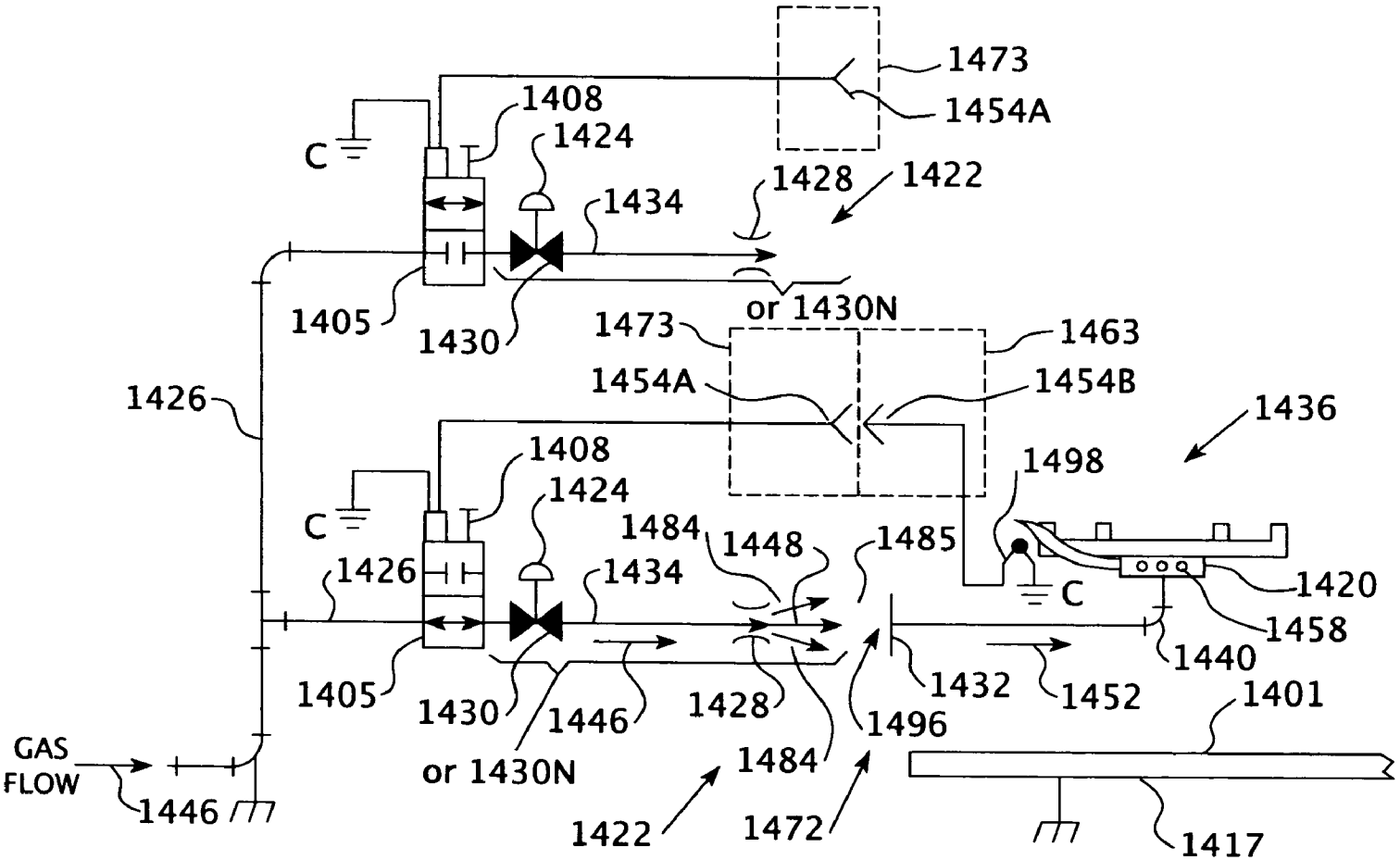
FIG. 14A is a detailed fuel circuit with an electromagnetic gas shutoff.

FIG. 14A is a fuel circuit with a gas shutoff 1405. That same shutoff device can be added to this and other fuel circuit schematics of this invention in a like manner, but would require positioning upstream of fuel suppler 1422. As shown, shutoff 1405 is a normally "closed" valve. Such devices are commercially available and either mechanically or electrically operated. Element 1408 represents a mechanical means to actuate shutoff to an open state before the flame current produces enough voltage to keep shutoff 1405 "open". Particularly, element 1408 can be a hand operated device for initially opening the valve. Alternately, element 1408 may be electrical means for initially actuating shutoff to an open state. As shown, shutoff device 1405 is in proper communication with the fuel supplier 1422 ending at orifice 1428.

As schematically shown, a representative sensor 1498 like element 1098 in FIG. 10A, can serve as a thermocouple equivalent with its current/voltage connected, directly or indirectly, to an electromagnetic valve. In FIG. 14A, sensor 1498 is a thermocouple that connects directly to shutoff device 1405 through sensor connector 1454A on electric supplier 1473 and through sensor connector mate 1454B on electrical receiver 1463. Other sensor types may require additional signal conditioning prior to connection to element 1405.

For a "gas-to-air" type fuel supplier, electric supplier 1473 and electrical receiver 1463 can be used for properly setting the distance between orifice 1428 and entrance 1432 of distribution conduit 1440. Thus, if an electrical supplier mate 1463 for removable burner assembly 1436 was not "proper"

with respect to electric supplier 1473, fuel supplier mate 1472 would not be proper relative to fuel supplier 1422 and a voltage/current would NOT be supplied to shutoff device 1405. That, in turn, would keep its electromagnetic valve 'closed' (electrical circuit open) and prevent gas 1446 from flowing through the system.

The present disclosure enables a 'flame safety' shutoff device to be used to stop gas flow by using the electrical connector (like element 1054 in FIGS. 10A and 10B) as a trigger device for a gas shutoff such as 1405. Also note that a needle type gas control 1430N in combination with an orifice 1422 can be used with gas shutoff 1405 if the gas shutoff is upstream of the gas control 1430N as shown.

Other known means for gas shutoff can be employed besides that shown in FIG. 14A. For example, an electromagnetic, electric solenoid or mechanical shutoff device may be used. Any such device should permit gas flow ('open' position) when its removable burner assembly is properly located to the appliance. Otherwise, that device will stop gas flow (revert to 'closed') if said removable burner is relocated or otherwise improperly installed. This is a preferred shutoff means if flame detection is not required.

The supplemental use of a gas control as an 'on-off' valve or dedicated gas shutoff device is further schematically shown in accompanying FIGS. 14B, 14C, 14D, 14E and 14F. All show a fuel circuit similar to FIGS. 6A and 6D, with the same elements being commonly numbered with the same last two digits in the series. Additional features or elements have been added to the fuel circuit, however, so that gas flow is stopped when the removable burner is not properly installed.

Figure 14B:
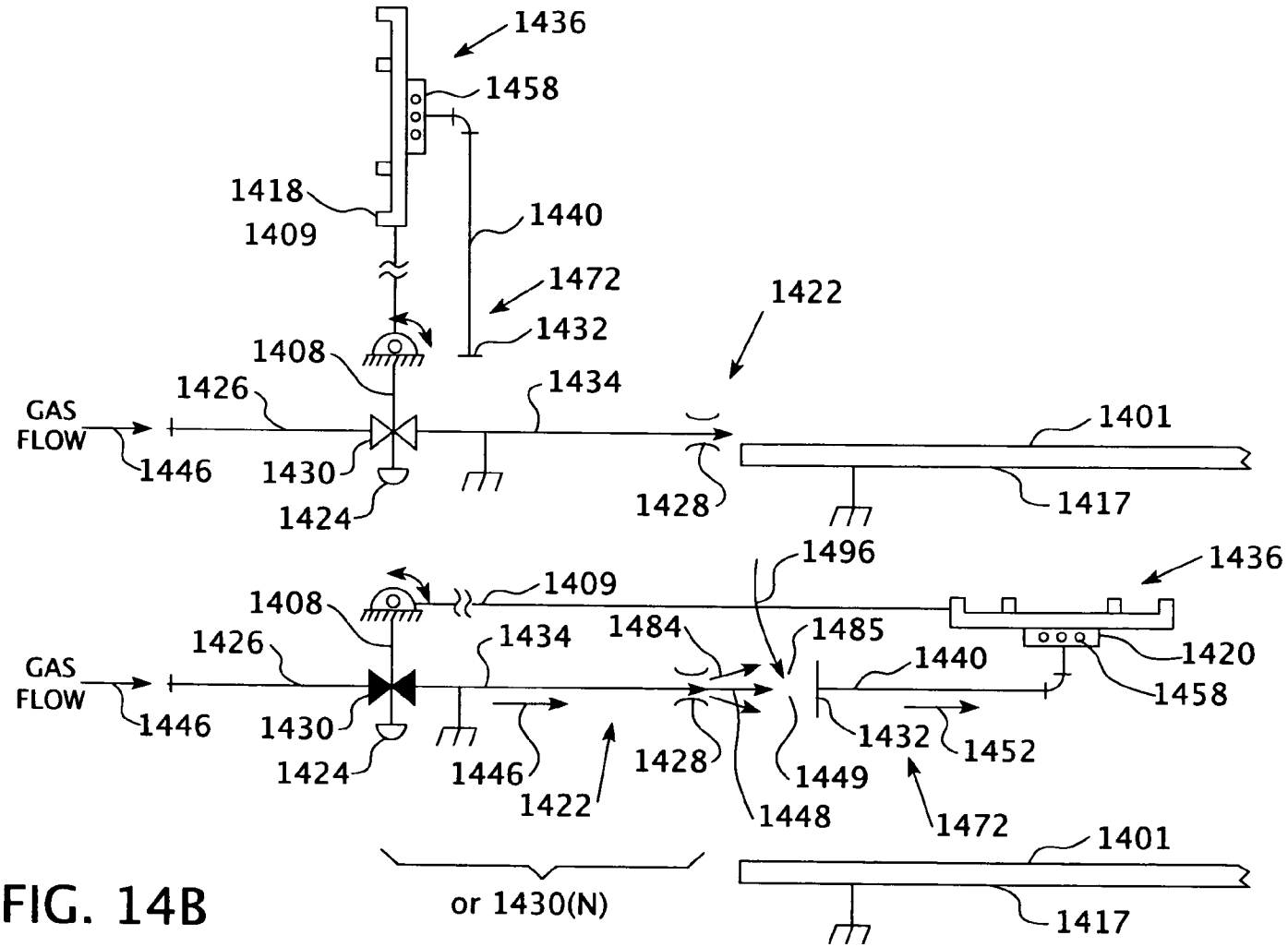
FIG. 14B is a detailed fuel circuit with a first alternative gas shutoff.

FIG. 14B shows the supplemental use of a gas control as an 'on-off' valve for use with a removable burner that can be rotated when relocated from the convertible area 1401. Gas control valve 1430 (or 1430N) is closed ('off') preventing the gas from being turned on. Such methods have been employed for lids that cover conventional burners; but here the removable burner 1436, if hinged to the appliance, accomplishes this function. As indicated in the schematic, when the removable burner 1436 is mounted above cooktop surface 1417, and in proper fluid communication with fuel supplier 1422, gas control 1430 can be used for controlling gas flow 1446 to the fuel supplier 1422. However, when the removable burner 1436 is relocated, rotation of the trigger 1409 causes element 1408 to actuate the gas control 1430 to be in an "off" position. Element 1409 can be a mechanical linkage, electrical connection, or any other means that jointly cooperates with element 1408 to actuate gas control 1430 via burner relocation.

Figure 14C:
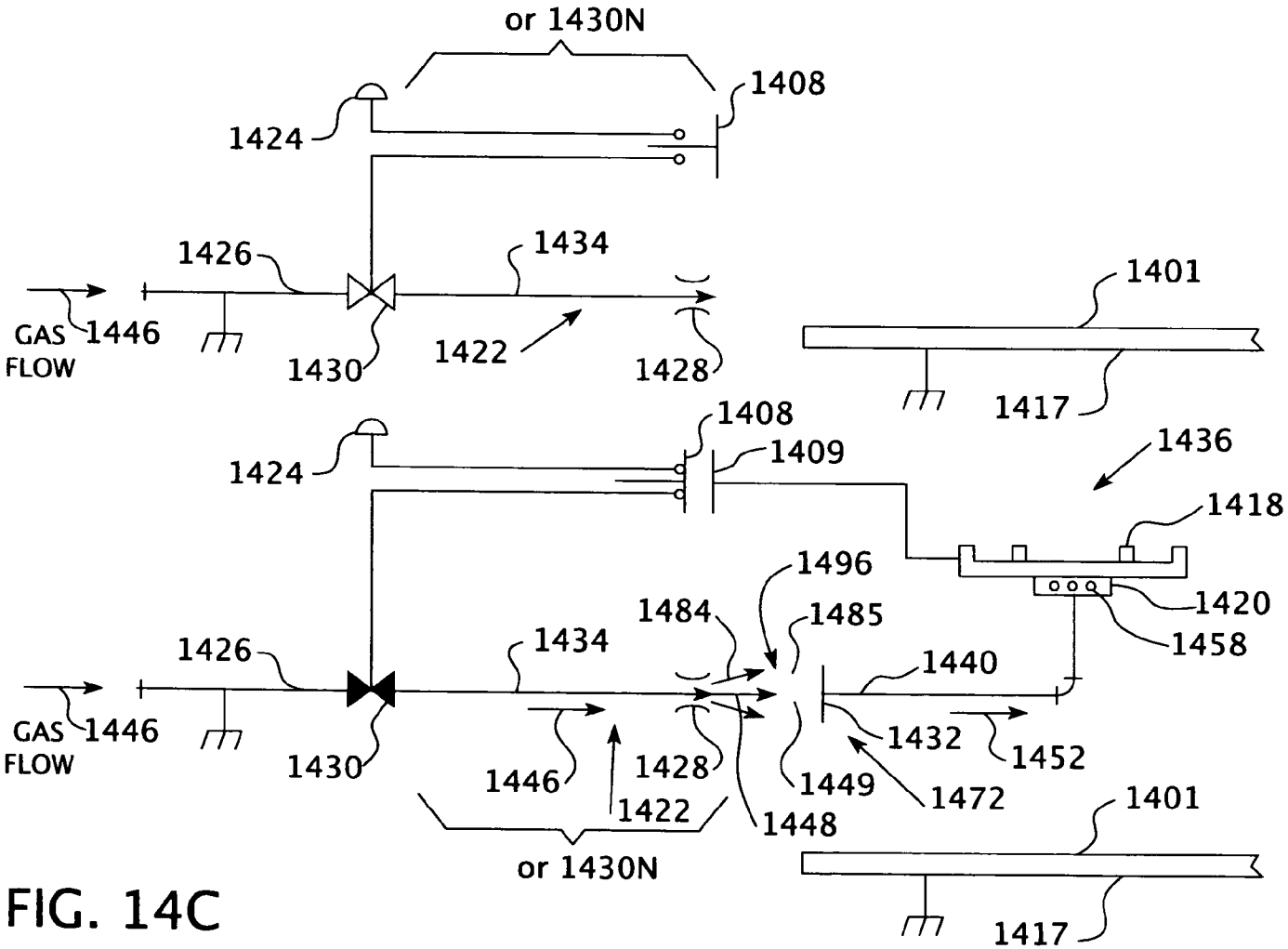
FIG. 14C is a detailed fuel circuit with a second alternative gas shutoff.

FIG. 14C shows a similar fuel circuit schematic to FIGS. 6A and 6D as well. Herein, the control 1430 (or 1430N) is shown as a gas control that further serves as a gas shutoff device. The fuel circuit and supplier of FIG. 14C are similar to that from FIGS. 6A and 6D except that an actuator 1408 and a trigger 1409 similar in function and description to those shown in FIG. 14B have been added for removable burner assembly 1436. That system will permit gas flow ('on') at gas control 1430, but only when fuel supplier 1422 and fuel supplier mate 1472 are duly engaged, shown schematically as the 'toggle' on the gas control 1430. More importantly, gas control 1430 will turn 'off' if the removable burner assembly is relocated from convertible area 1401. Thus, trigger 1409 on the removable burner assembly acts indirectly to enable gas flow. This fuel circuit is ideal for electronic style gas controls that are normally closed. The trigger 1409 and actuator 1408 need not be in physical contact. An electric type switch can be employed for actuator 1408, but a non-contacting switch could also be employed that detects the physical presence of the removable burner assembly 1436 and actuates the gas shutoff device.

Figure 14D:
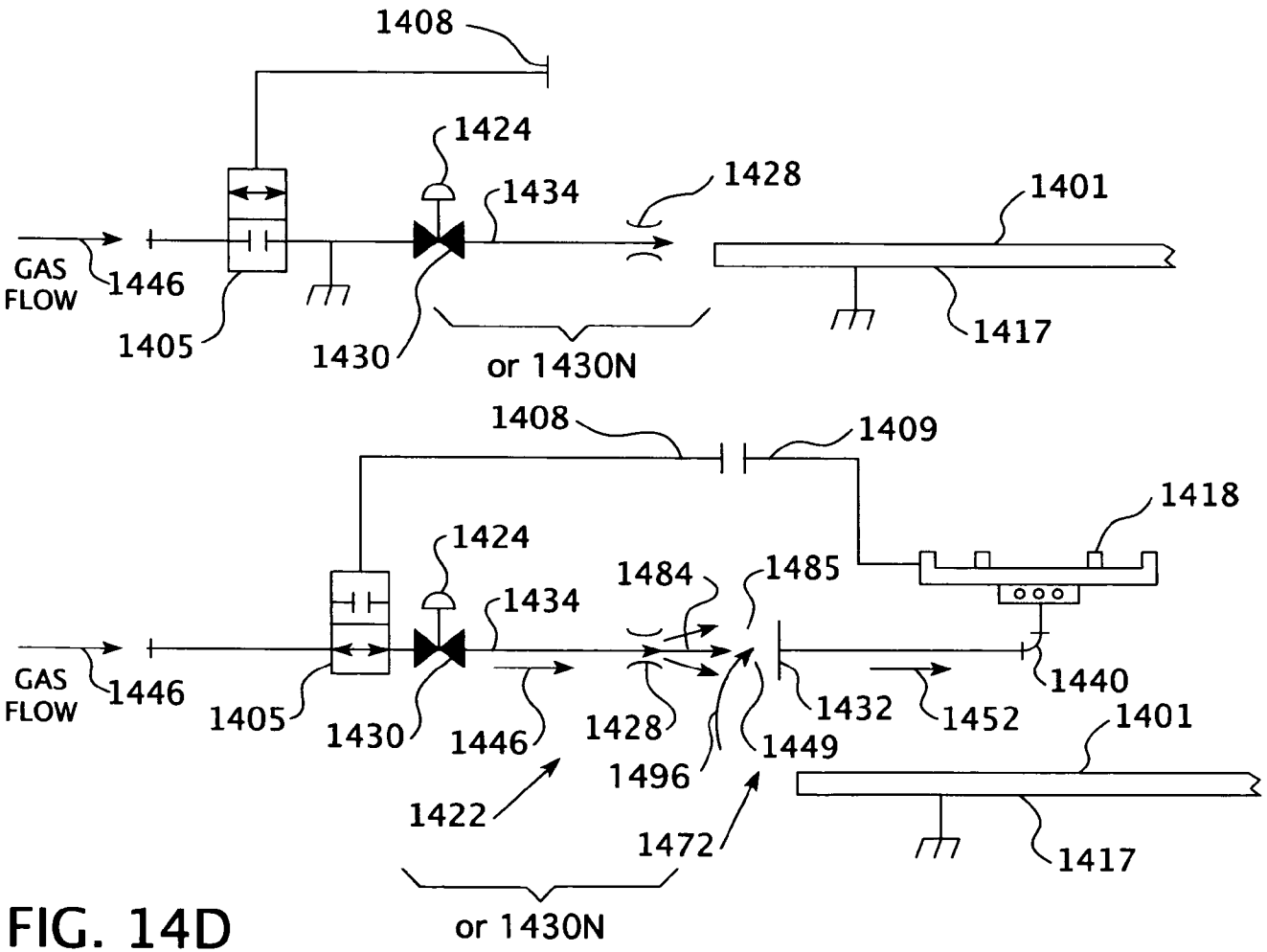
FIG. 14D is a detailed fuel circuit with a third alternative gas shutoff.

FIG. 14D shows a dedicated gas shutoff device 1405 added to the fuel circuit of FIGS. 6A and 6D. Dedicated gas shutoff 1405 is in proper fluid communication with fuel supplier 1422. It is shown upstream of gas control 1430, but can be downstream of gas control 1430 if not a needle type, gas control. In that case, element 1430N could replace equivalent elements 1430 and 1434. As shown, shutoff device 1405 is in an 'on' position when the removable burner assembly 1436 is properly installed (operable); and 'off' when the latter assembly is not operable. FIG. 3B showed the same sort of dedicated gas shutoff device at element 305. Such a circuit can also be employed if the removable burner assembly 1436 is only rotated away from the convertible area 1401, but not fully removed therefrom. When the burner is only rotated and not completely removed, trigger 1409 would cause element 1408 to actuate gas shutoff device 1405 and stop gas flow.

Figure 14E:
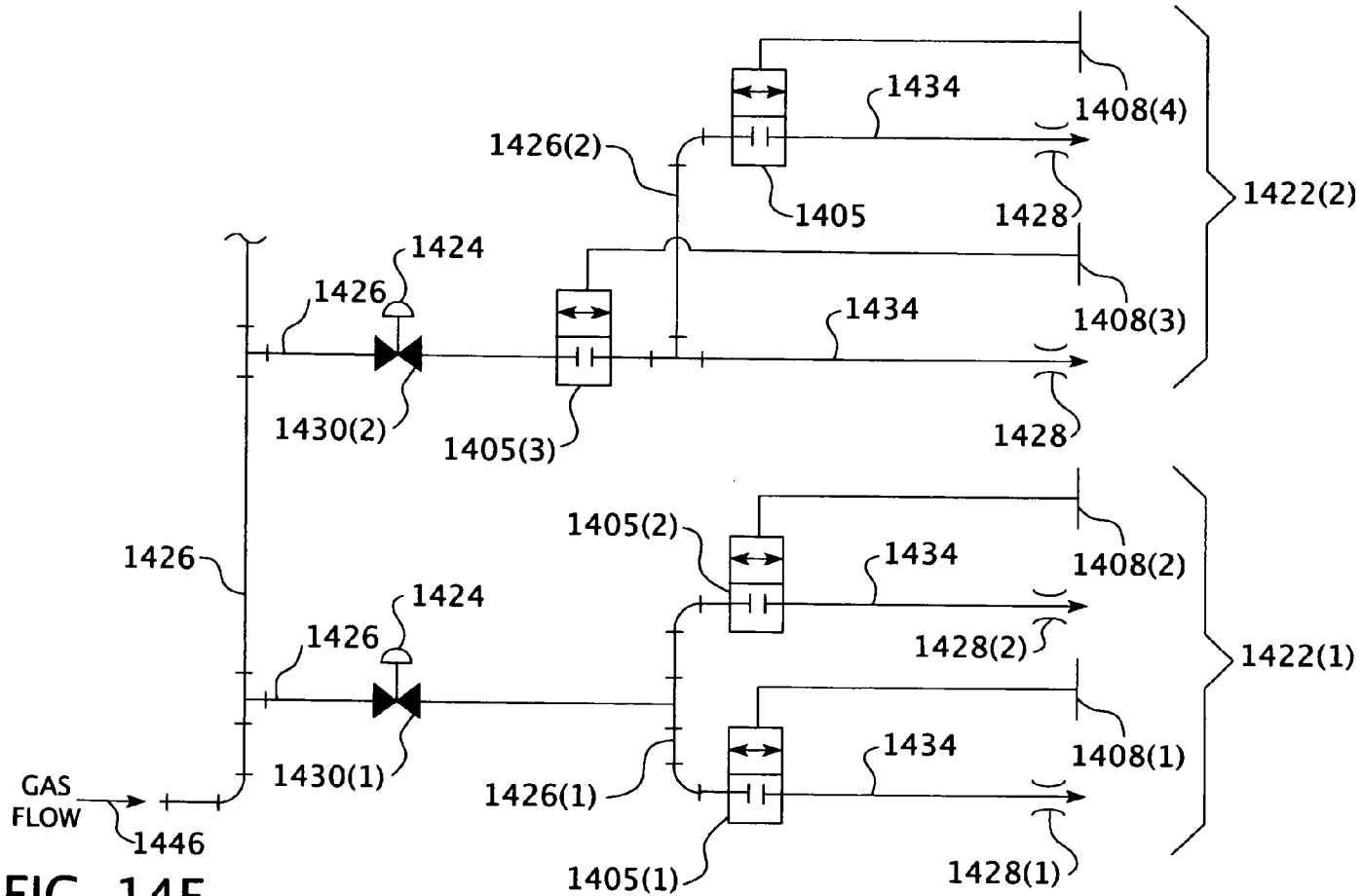
FIG. 14E is a detailed fuel circuit from FIG. 14D with additional gas shutoffs incorporated.

FIG. 14E is similar to FIG. 6B but with gas shutoffs added to the fuel circuit which are selectively 'on' when a removable burner is installed. FIG. 14E demonstrates the flexibility of the previous fuel circuits. Here gas controls are identified as elements 1430(1) and 1430(2). In that embodiment, after passing through first control 1430(1), gas will travel into a secondary manifold 1426(1) that feeds a plurality of branches (two are shown). Each branch has a dedicated gas shutoff device 1405 and orifice 1428. It should be noted that orifices 1428(1) and 1428(2) do not have to be similarly sized. In that manner, control 1430(1) can regulate different burners with different maximum firing rates. Particularly, shutoff 1405(1) can be actuated by element 1408(1) while actuator 1408(2) is left deactivated and gas shutoff 1405(2) remains 'off'. That would produce a first, 'maximum' firing rate. In the alternative, shutoff 1405(2) can be actuated, and shutoff 1405(1) deactivated, resulting in a second 'maximum' firing rate. Finally, if both shutoffs 1405(1) and 1405(2) were actuated, a third 'maximum' firing rate would result. The preceding principles can be extended to still other gas supply branches. In FIG. 14E, a second fuel supplier 1422(2) and corresponding gas supply circuit part illustrate other possible locations for gas shutoffs shown here as 1405(3) and 1405(4). In any event, they should all be located downstream of gas control 1430 if burner firing rates are to be regulated by selecting different orifice sizes via actuators 1408(3) and 1408(4). Note that if a needle type gas control, like element 630N in FIG. 6D, were used, the FIG. 14E schematic would have less utility as a gas control. Such a needle type alone can advantageously limit maximum firing rates for different burners. For that sort of arrangement, only one gas shutoff would be required upstream of a gas control like that shown as element 1430N in FIG. 14D.

Figure 14F:
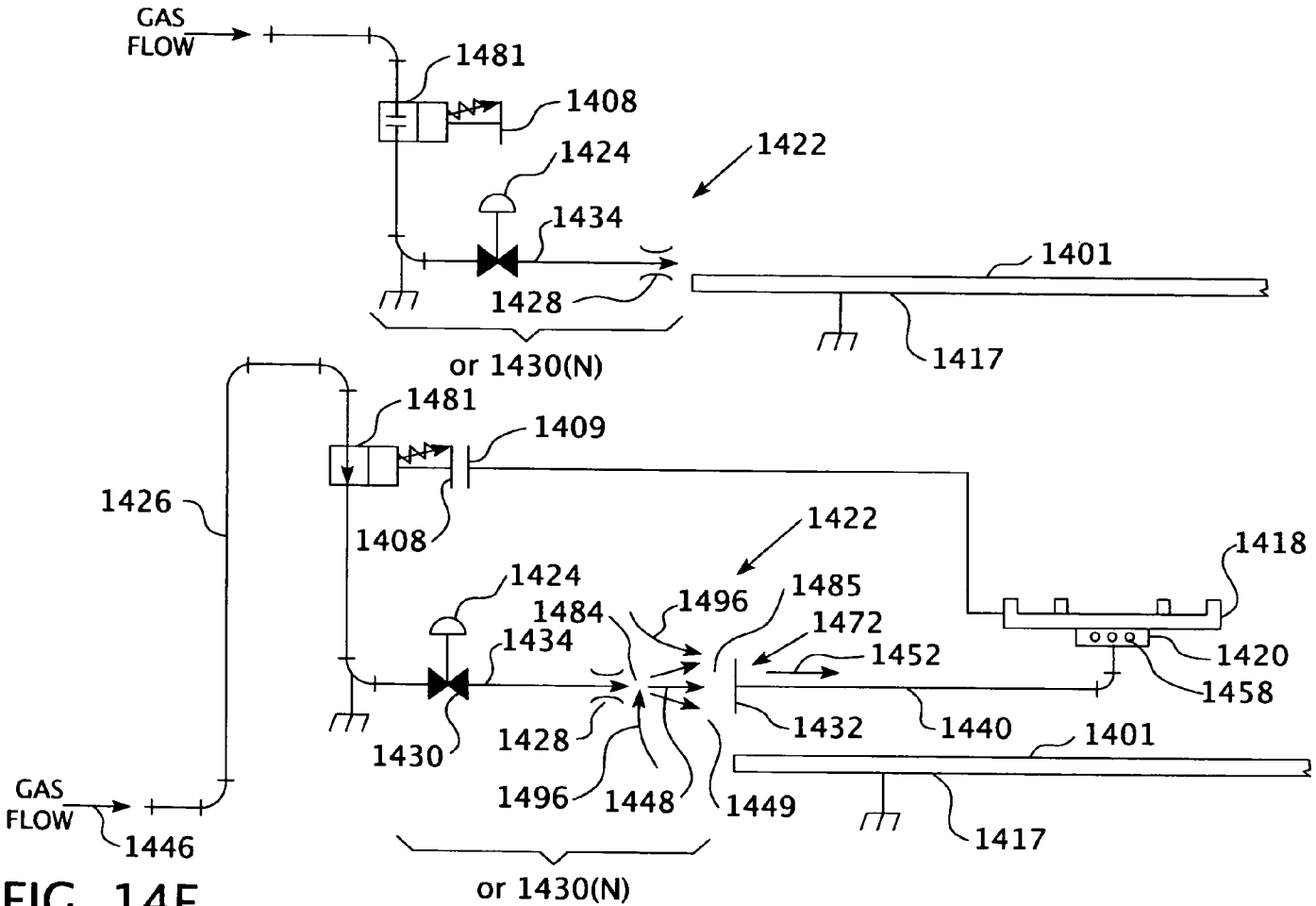
FIG. 14F is a detailed fuel circuit having a fourth alternative gas shutoff.

FIG. 14F schematically shows a dedicated pressure regulator 1481 in its fuel circuit. Prior to this embodiment, all past fuel circuits have been pressure pre-regulated. If not pre-regulated, it may be advantageous to require a regulator to also serve as a gas shutoff device in addition to pressure regulating. That function could be served by relieving its regulating force, most commonly, a spring, to near zero with an actuator like element 1408 as shown. In that manner, element 1409 would not actuate (trigger) element 1408 when fuel supplier 1422 and fuel supplier mate 1472 are disengaged (or "off"). But when fuel supplier 1422 and fuel supplier 1472 are engaged, actuator element 1408 and trigger 1409 will engage causing a regulating force to be applied to pressure regulator 1481 (switching it to "on"). The pressure regulator in the fuel circuit of FIG. 14F is illustrative only. This disclosure addresses still other manners of use and/or locations for same.

Figure 14G:
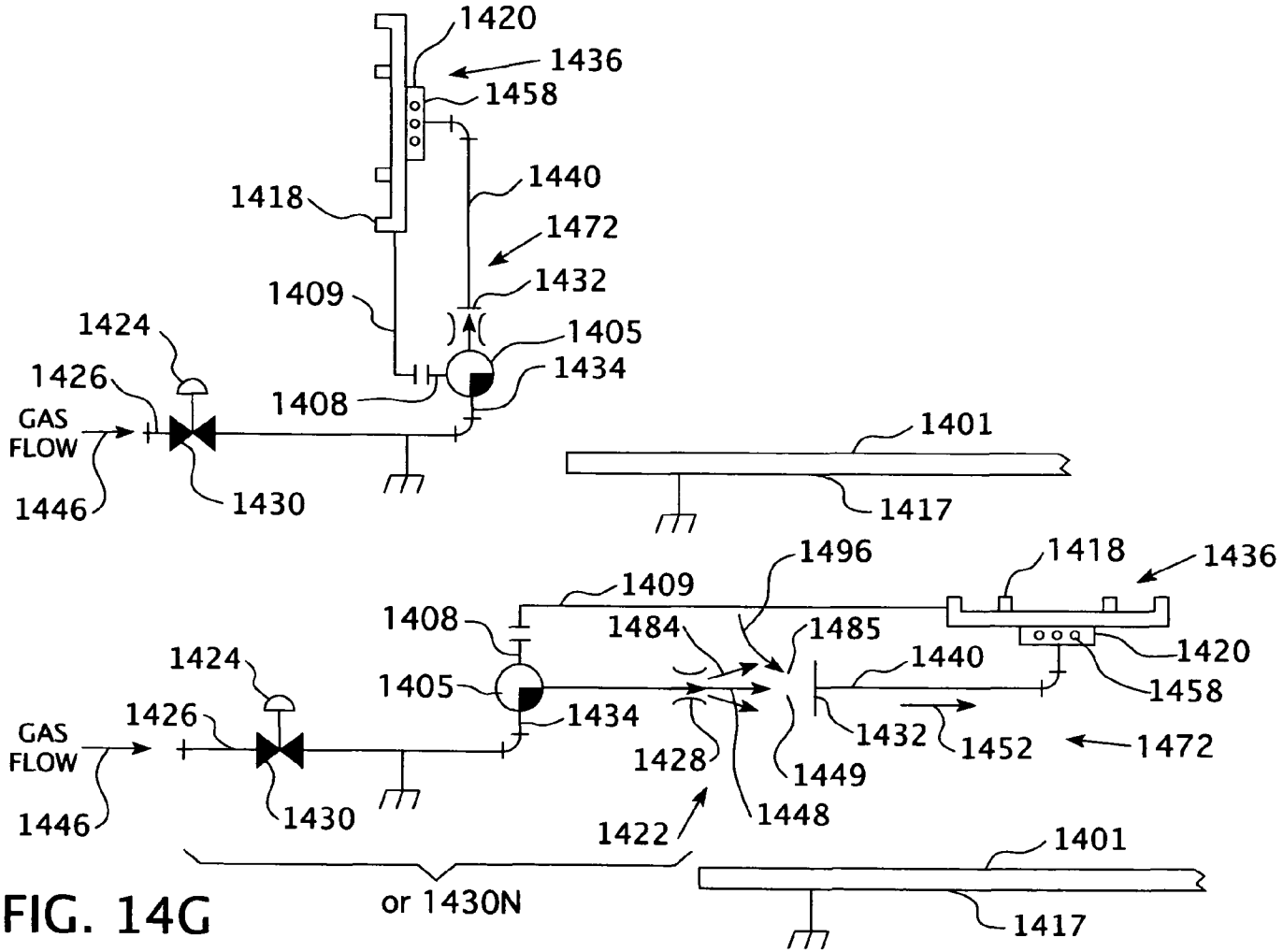
FIG. 14G is a detailed fuel circuit with a fifth alternative gas shutoff.

FIG. 14G schematically shows a fuel circuit having a dedicated, 'rotating type' gas shutoff device 1405. Device 1405 shuts off gas flow when the removable burner assembly 1436 is removed from convertible area 1401 by rotation. Trigger 1409 then causes actuator 1408 to stop gas flow at gas shutoff device 1405. Note that with this embodiment, the fuel supplier rotates with the removable burner assembly. Though not shown, a needle type gas control 1430N can be used here if located downstream of gas shutoff device 1405.

Figure 14H:
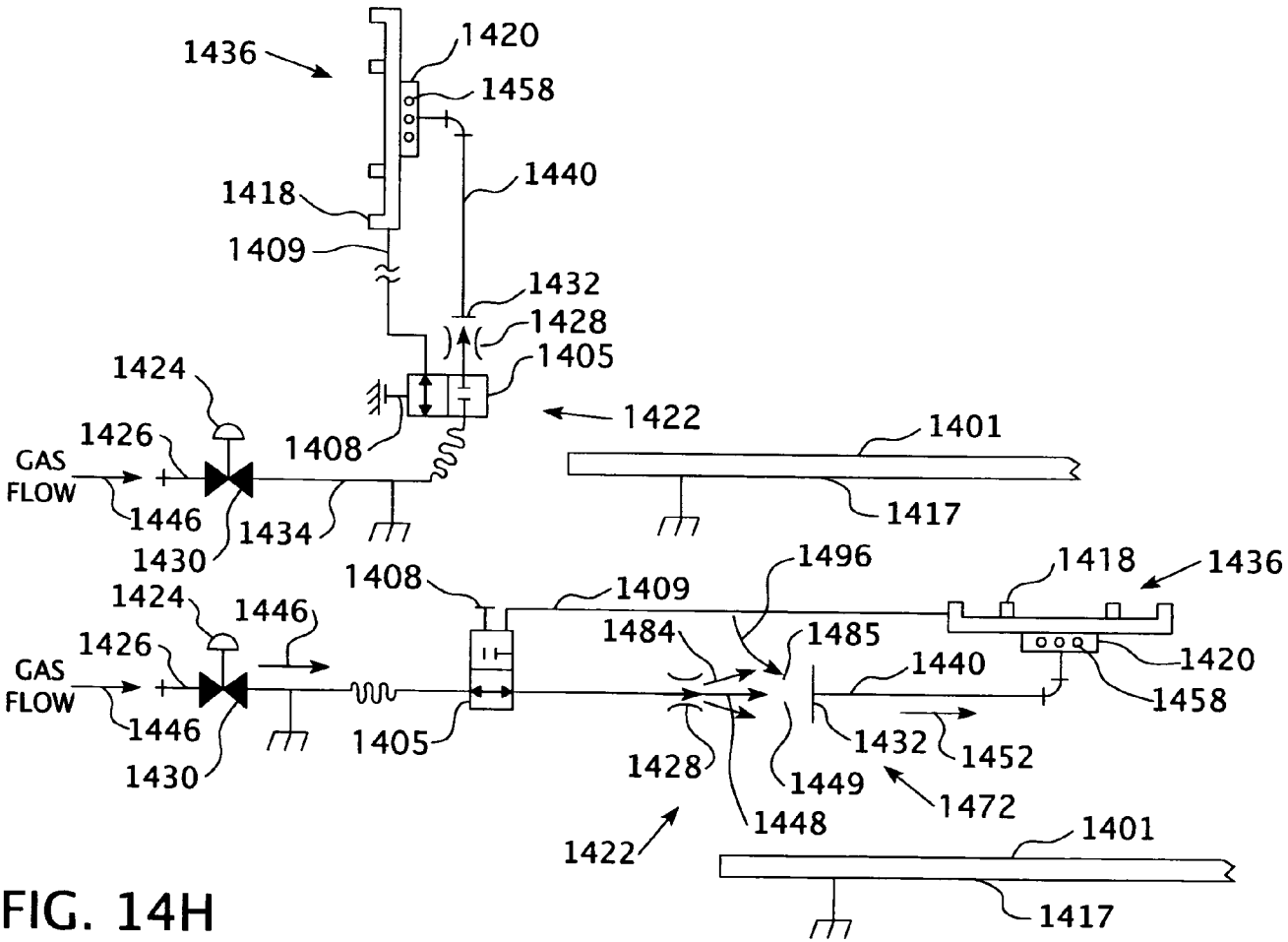
FIG. 14H is a detailed fuel circuit with a sixth alternative gas shutoff.

FIG. 14H shows the same fuel circuit schematic of FIG. 14D but with a dedicated, positionally-activated gas shutoff device 1405. The latter device is intended to shut off gas flow when the removable burner assembly 1436 is positionally removed from convertible area 1401. Depending on the type of gas control employed, 1430 or needle style gas valve 1430N (not shown), gas conduit 1434 or gas manifold 1426 can be flexible. Such an arrangement lets fuel supplier 1422 rotate with the burner assembly 1436. Also in this embodiment, trigger 1409 and actuator 1408 cause gas shutoff device 1405 to stop gas flow, shown here, by rotation.

Figure 14I:
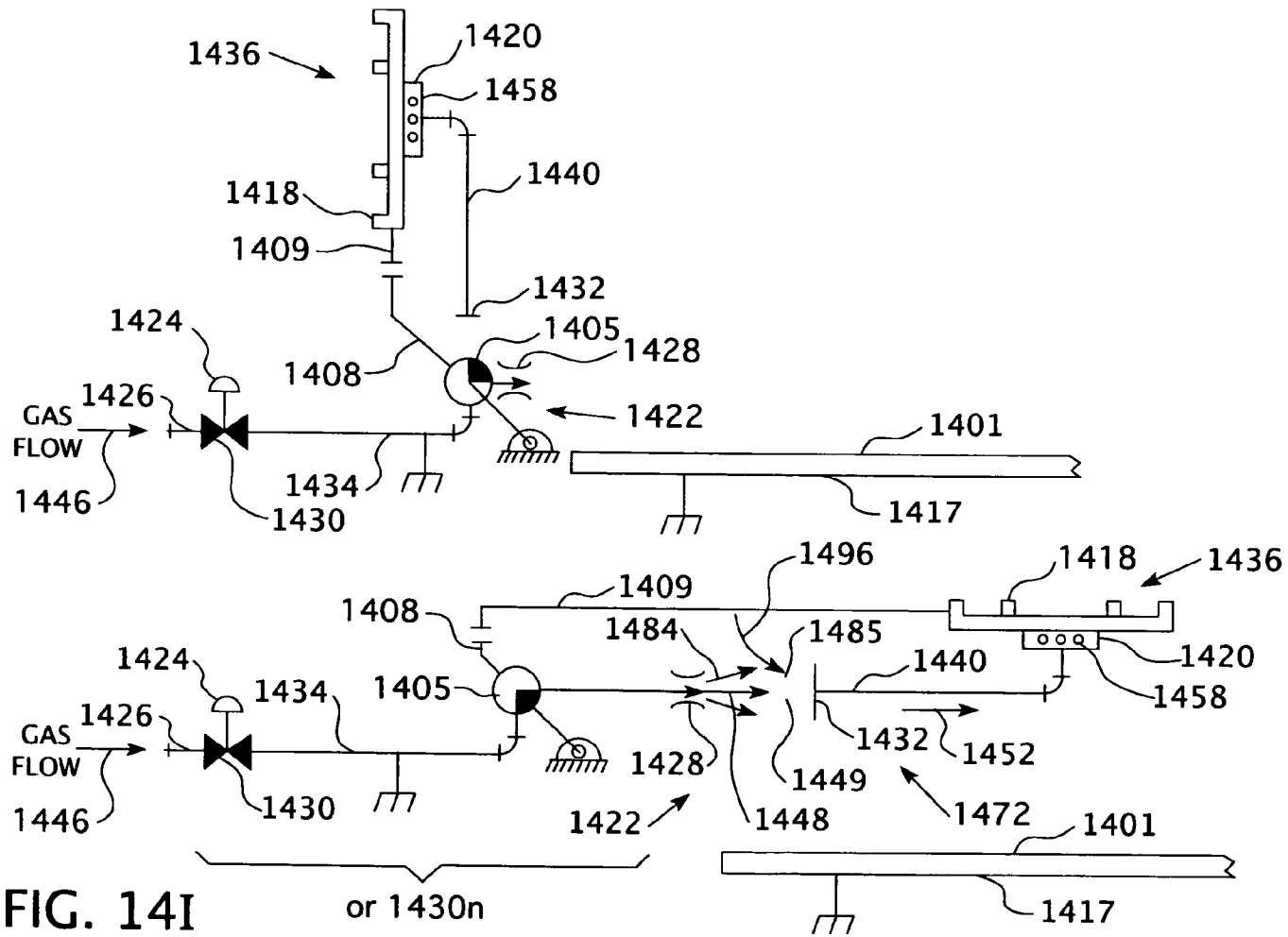
FIG. 14I is a detailed fuel circuit with a seventh alternative gas shutoff.

FIG. 14I shows a schematic of a fuel circuit having a 'rotating type', dedicated gas shutoff device 1405. That device will shut off gas flow when the removable burner assembly 1436 is removed from convertible area 1401 by rotation. Particularly, that movement causes trigger 1409 to actuate, in turn causing device 1405 to stop gas flow. Unlike in FIG. 14G, the fuel supplier of this alternative embodiment does not rotate with the removable burner assembly. Regardless, rotation of the burner assembly still triggers gas shutoff device 1405 to be 'off' when the burner assembly is no longer properly installed. Though not shown, a needle type gas control can also be used here if located downstream of gas shutoff device 1405.

In FIGS. 14A, 14B, 14C, 14D, 14E, 14F, 14G, 14H, and 14I, a gas control with a mechanical-type operator control 1424 is shown. Electronic operator controls can be employed as well as the electronic style controls previously mentioned for fuel circuits in FIGS. 6A, 6B, 6C, and 6D. As previously mentioned, electronic style gas shutoff devices can also be used, like the solenoid operated, dedicated gas shutoff device 305 shown in FIG. 3B. In these FIG. 14 alternatives, element 1408 can be an electrical non-contacting switch that gets "triggered" (element 1409) by the presence of a burner assembly. As disclosed earlier, element 1408 represent either mechanical or electrical means, contacting or non-contacting, to actuate the gas control or shutoff device shown in these figures.

Each of these fuel circuits has a gas shutoff device that can be employed in the various appliance configurations of this disclosure, including the respective drop-in, slide-in and free standing cooking appliance models. Of course, some may be more optimal depending on the manufacturing of the appliance and its overall configuration.

In another alternative embodiment, 'removable burner assembly' has been supplemented with an interface for operator controls. That operator control could be made integral with, or a separate component of, each removable burner assembly. Hereafter, such an alternative removable burner assembly will follow the same designation that has been used for the last two digits, and having a suffix of WOC indicating the removable burner as a unit 'with operator control'. Of course, a removable burner assembly with operator control can assume all prior forms like those shown earlier for all preceding Figures.

Figure 15A:
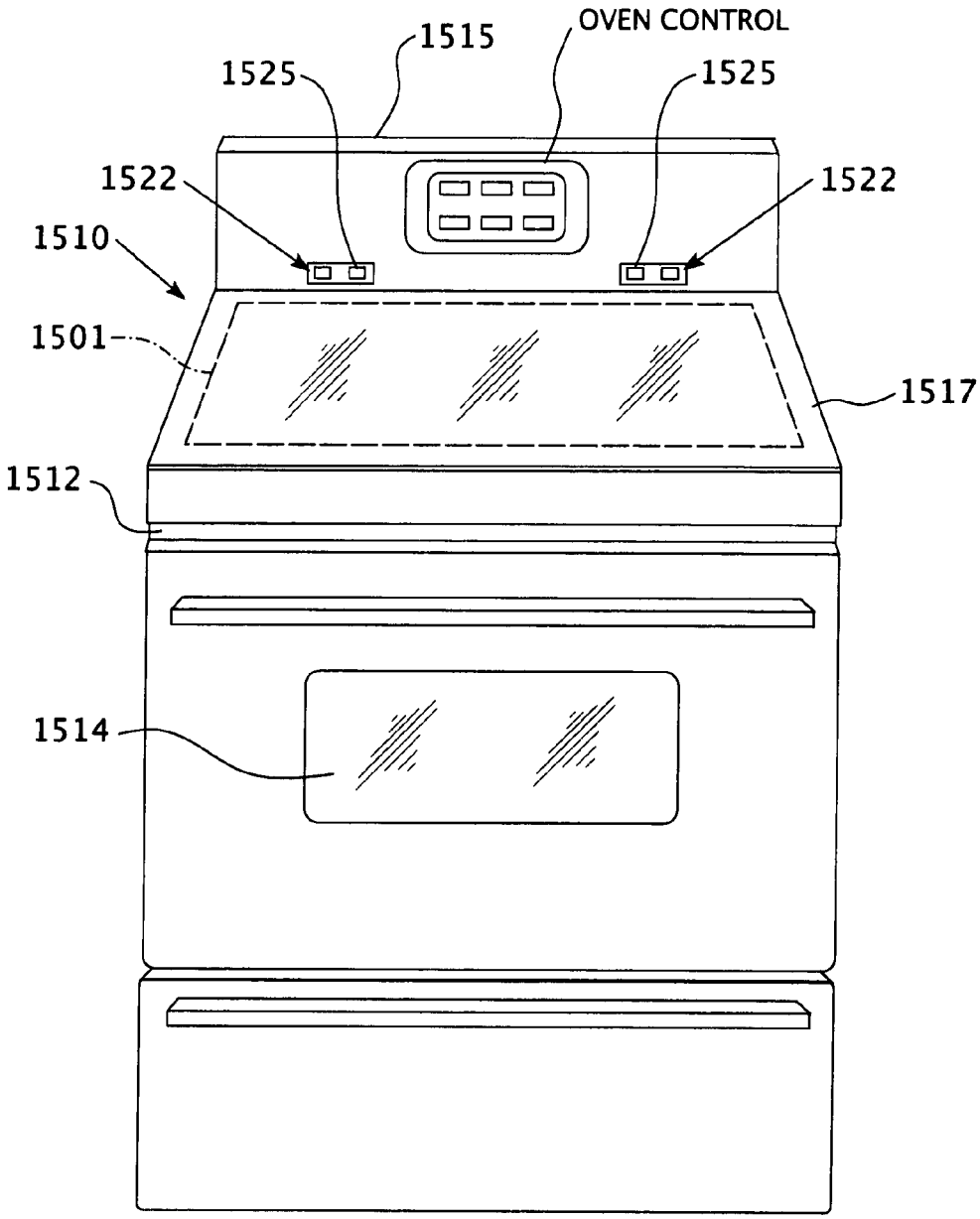
FIG. 15A is a perspective schematic view showing one embodiment of the disclosure as a freestanding cooking appliance.
Figure 15B:
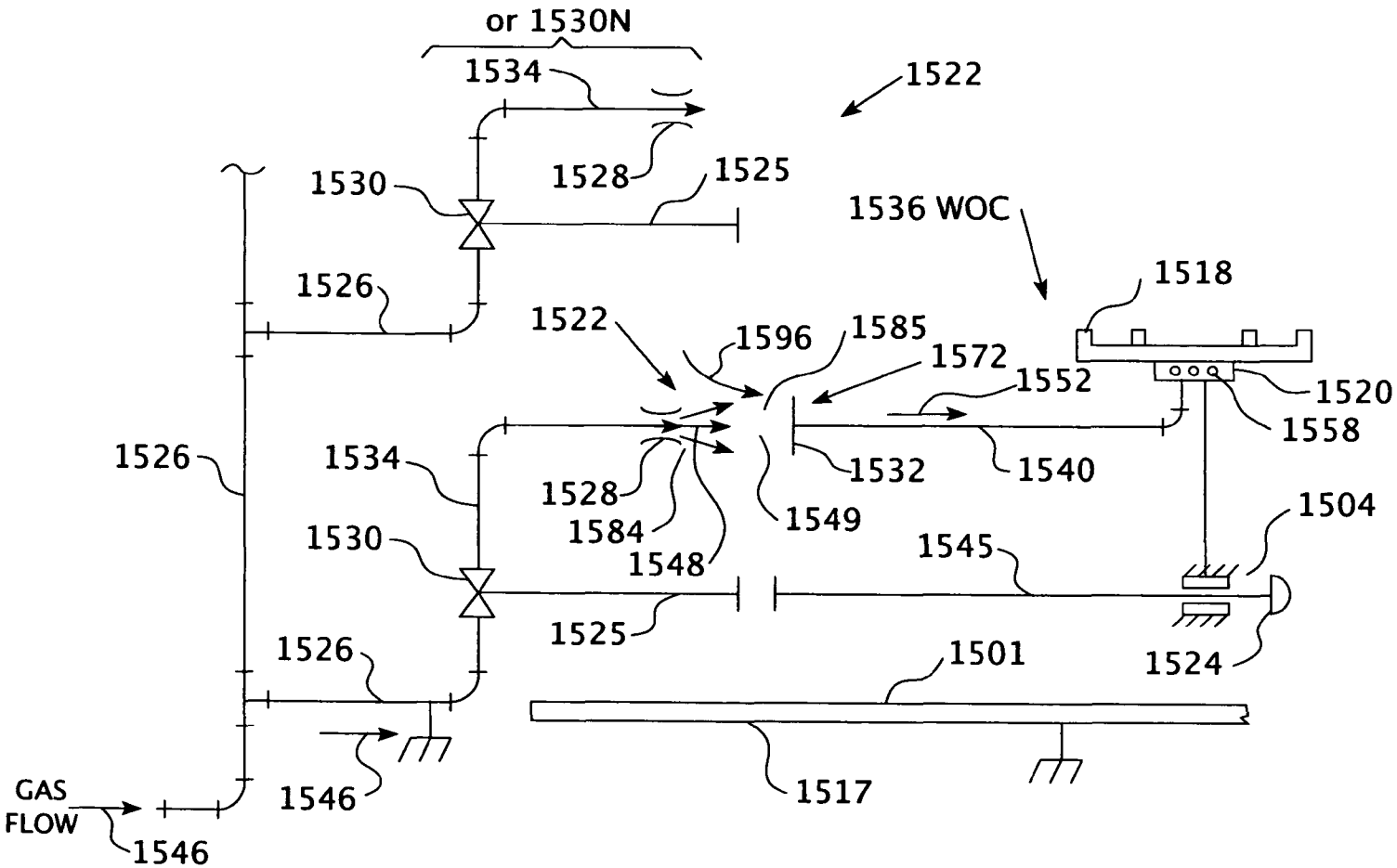
FIG. 15B is a fuel circuit for a removable burner having an operator control in accordance with one embodiment.

For the next variation of this disclosure, an operator control previously described and shown as external to convertible area 101, 201, 301, 401, 501, 601, 1101, 1301, 1401 in the previous FIGS. 1-14F, may now be included in that very convertible area. For example, FIG. 15A schematically shows a free standing range like that from earlier FIGS. 1 and 2A, except that an operator control 124 or 224 is no longer a per se part of that appliance. In FIG. 15A, the operator control element has been replaced with an operator control receiver 1525 and the operator control panel has been collocated with removable burner assembly 1536WOC as shown in FIG. 15B as element 1504. In like manner, the same configuration can be employed for a drop-in appliance, and slide-in appliance similar to those represented in FIGS. 3A, 4A, and 5, resulting in an appliance that has no operator controls.

Thus, all operator controls 124, 224, 324, 424, 524, 624, and 1424, from prior FIGS. 1 through 14I, are replaced with operator control receiver designations 125, 225, 325, 425, 525, 625, and 1425 for this new configuration. And, operator control panel 104, 204, 304, 404, and 504 from prior Figures are totally removed from the appliance proper, and now part of a removable burner assembly with an operator control, such as that shown as element 1504 in FIG. 15B burner assembly 1536WOC.

To better illustrate the new configuration, FIG. 15B shows a variation of the earlier FIG. 6A schematic but with operator control receiver 1525 connected (directly or indirectly), to gas control 1530. FIG. 15B also shows operator control receiver 1525 interfacing with an operator control transmitter element 1545. Unlike FIG. 6A, operator control 1524 and control panel 1504 are part of a newer variation of removable burner assembly 1536WOC. In FIG. 15B, therefore, control transmitter 1545 connects to its operator control 1524.

Just like before, the operator control receiver and transmitter of FIG. 15B can be physical or functional elements. If both gas control 1530 and operator control 1524 are electronic, for example, the interface between operator control transmitter 1545 and receiver 1525 could be electromagnetic and functional as in using an infrared beam. If gas control 1530 was mechanical, operator control receiver 1525 could be a valve stem, and operator control 1524 a mechanical hand knob with operator control transmitter 1545 a molded insert for stem 1525. In that arrangement, the 'hand knob insert' and 'valve stem' interface would be physical even though no additional elements are involved and no other physical components would be needed to interface between these gas and operator controls. In previous schematic representations, the gas and operator controls did not require a removable interface/connection. But in this configuration, such an interface is both necessary and critical. All other fuel circuits that have been shown can employ this configuration, if elements 1545, 1524, and 1504 are added to the burner assemblies previously shown.

A major benefit of the preceding configuration is that it can completely free an appliance of operator controls regardless of type. For mechanical controls, proper appliance cleaning can be further improved. And for mechanical or electronic controls, overall appliance aesthetics are duly enhanced. Yet another benefit is that such an arrangement provides an alternative gas shutoff device when a removable burner is not properly installed. Specifically, operator control receiver 1525 and transmitter 1545 can be interlocked thus rendering them operable only when removable burner assembly 1536WOC is properly installed. This is similar to what was shown in FIGS. 14B and 14C, but with fewer elements. Only then can the gas control 1530 of this embodiment supply gas 1546 to fuel supplier 1522. Thus, only when gas control 1530 is in an 'off' position can operator control receiver 1525 and transmitter 1545 be 'unlocked', thereby permitting removable burner assembly to be safely and properly uninstalled from this sort of appliance.

Figure 15C:
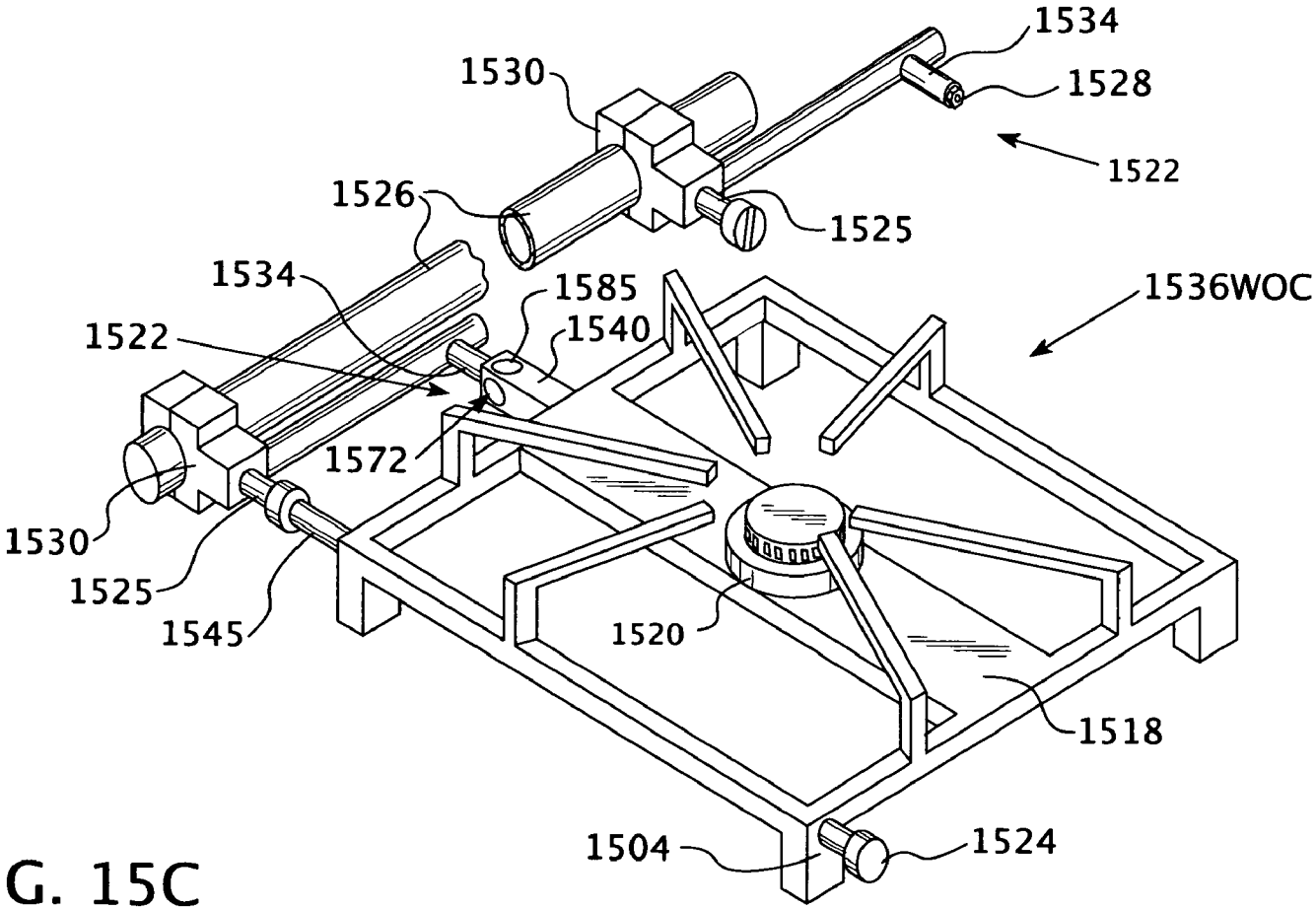
FIG. 15C is a perspective view showing an embodiment of fuel supplier and operator control receiver interfacing with a removable burner having its own operator control and transmitter.

To better illustrate the schematic of FIG. 15B, FIG. 15C schematically shows a removable burner assembly similar to that of FIG. 6G except with its removable burner assembly 1536WOC having additional elements: operator control 1524 and its control panel 1504 and an operator control transmitter 1545 for 1524, which in turn interfaces with its own controller receiver 1525. And though removable burner assembly 1536WOC is shown without a heat shield, one may be included. FIG. 15C has functional equivalents to all other elements from FIG. 6G, but with elements 1524 and 1545 added.

Still other cooking appliance configurations are possible as a result of this disclosure. For instance, the oven of cooking appliance 110 in FIG. 1 can be replaced with a gas type refrigerator as is employed by the recreational vehicle (RV) industry. For that application, the additional space beneath a cooking appliance cooktop can be used for storage and/or insulation. Such an appliance would be especially ideal for those RV's in which gas input to the refrigerator and cooktop are shared. In a similar fashion, the cooktop of this disclosure can be coupled to a gas water heater or furnace for still other RV applications.

Though not specifically stated, the cooktops from earlier FIGS. 1 through 5, and FIG. 15A can be made fully removable. Prior art cooktops, including radiant gas cooktops, were not readily customizable. With the present disclosure, manufacturers, consumer/end users can customize, i.e. improve cooktop aesthetics further by adding to their cooktop surface an image that might be otherwise damaged with high heat. Also, a glass or glass-ceramic surface can be employed with one or more prints adhesively attached, or using a heat-sustainable coating process. In the past, limited images were possible when made with certain ceramic paints. But, images using non-ceramic or high temperature coatings were not possible. The present disclosure permits the use of coatings, especially low temperature coatings, for a convertible area that is apertureless. Once applied to these surfaces, such images themselves can be rendered unobstructed by lifting and/or removing removable burner units therefrom. And, such cooking appliances need not be sold with a "forever" cooktop. Instead, they can be sold separately and incrementally, like the removable burner assemblies installed over same.

Once installed, the gas smoothtops of this disclosure can be made virtually coplanar with any surrounding countertop or adjacent, peripheral surface. This is especially beneficial, and aesthetically desirable, for countertops made from stone, granite, marble, ceramic tile, Corian® and the like. When one or more removable burner assemblies are removed from over said cooktop, a flat and relatively uninterrupted work surface will be fully exposed.

This disclosure brings with it a number of unobvious benefits besides cleaning, aesthetics and utility. As is known in the art, oxidizer is divided into primary and secondary air for most burners. Primary air is introduced to the mixture before the gas is burned. And secondary air is air entrained by the flame during burning to complete combustion if primary air falls below a stoichiometric value. All prior art cooking appliances introduced primary air (normally by gas jet entrainment) from below the cooktop proper or, from the above the cooktop, in the convertible area proper. Both have significant disadvantages, which are resolved with the present disclosure when primary aeration is taken near the periphery of the convertible area. When a cooking appliance includes a lower oven as is the case for most conventional ranges, cooktop gas burner emissions raise still other design and operation issues for arrangements having primary aeration. This disclosure overcomes such issues by its ability to introduce oxidizer (primary air) from above or at least very near the cooktop surface itself.

All previously shown configurations of this disclosure allow primary air to be drawn from above the cooktop and external to the convertible area. When entraining primary air from above (or close to the top of the cooktop surface), the burners of this disclosure are less likely to extinguish when an oven, or adjacent cabinet door, opens or closes too rapidly. By contrast, known prior art burners have extinguished prematurely, especially at low firing rates, because of a compression/rarefaction wave setup by the cooktop surface similar to a drumhead. Still further, this configuration permits primary aeration from not only above the cooktop, but external to the convertible area thereby facilitating better secondary aeration and reducing grate height requirements for proper emissions.

Still another aspect concerns the manufacturability and assembly of appliances employing the features described above. It is advantageous to avoid having to mount burners directly onto or through a cooktop made from glass or glass ceramic. Extra effort, care and expense are required to make, use, sell, transport and install appliances having one or more apertures through a ceramic glass region.

Yet another aspect arises with the subsequent servicing of these next generation appliances. With the disclosure described herein, consumer/end users will be able to self diagnose certain aspects, preliminarily by switching out burners, i.e., testing them in different positions for determining whether the problem resides with a given removable burner or the appliance proper. Ultimately, this may reduce the number of service calls required as removable burner assembly issues can be addressed by other means including mail order replacements, in store drop-offs and/or pickup points of service.

Another aspect concerns the modular nature of these cooktops. This disclosure allows replacement burners to be located in multiple sites on the same base top. Today's most common range or cooktop has a matrix of burners (2×2). But with the present disclosure, one can envision a matrix having a (1×4) or even a (1×1) burner layout. With such configurations, it may be possible to prepare food directly in front of the very removable burner that will be used for cooking same. And such food preparation can take place at a level nearly coplanar with surrounding countertops. Finally, with a removable burner orientation that allows for connections to only the rear wall/corner of a cooktop, it is less likely that young children will see the handles of a hot pot or pan, let alone reach up and pull said cooking vessel down onto themselves.

The present disclosure permits removable burner assemblies and a cooktop that may be sold separately but still permit the rigorous testing for the removable burner, cooktop, and gas cooktop appliance, i.e. the combination, to obtain the necessary gas agency approvals by the manufacturer. When first purchased, appliances can be shipped with a core structural housing that includes all the necessary wiring and gas supply components required in a particular jurisdiction or by a particular governmental agency. More and better quality components, upgrades or "options" can then be purchased to accommodate a consumer/user's changing tastes, room decors and cooking skills. For example, if the original cooktop satisfied a first color scheme but its owner wanted to change (or update) to a newer, kitchen theme/motif, a replacement cooktop can be bought and substituted for the initial model. And a damaged cooktop, especially if glass or glass-ceramic, could be more easily exchangeable at a lower 'per unit', replacement cost.

With separately purchased, replaceable and/or removable parts, and accompanying accessories, greater modularity will only enhance consumer experimentation with different styles, tastes and cooking styles. This disclosure will allow consumers to first buy what they need, with the option of later adding burners, etc. to accommodate subsequent wants. A user could add a removable wok burner for oriental cooking, fish burner for Mediterranean style cooking, and separate burners for grilling, simmering, etc. When cooking is complete, such removable burners can be removed and stowed just like a pot or pan, or moved from the convertible area while still attached to its appliance. In either case, the convertible area can be left clear and unobstructed for easier and more thorough cleaning than what is possible with today's conventional gas cooktops. This disclosure also represents an improvement over current box "cartridge" systems that although are modular, are still always installed in the appliance proper. Further, by having the burner being mounted above, atop or over the convertible area on the cooktop surface, the removable burners of this disclosure can be treated and handled more like a cooking vessel.

As this disclosure has been described, it will be apparent to those skilled in the art that the same may be varied in many ways without departing from the scope of this disclosure. Any and all such modifications or alternates are intended to be included within the scope of the appended claims and the equivalents thereof.

What is claimed is:

1. A gas cooking appliance comprising:

a structural housing;

a cooktop surface supported by said structural housing;

a convertible area defined on said cooktop surface, wherein said convertible area is imperforate; and, a gas-to-air type fuel supplier supported by said structural housing for selectively delivering a fuel and oxidizer mixture to an associated burner when said associated burner is connected to said gas-to-air type fuel supplier and wherein said fuel supplier is positioned above said convertible area.

2. The cooking appliance of claim 1, wherein said fuel supplier is positioned outside a periphery of said convertible area.

3. The cooking appliance of claim 1, wherein said fuel supplier is movable in relation to said cooktop surface.

4. The cooking appliance of claim 1, wherein said fuel supplier interlocks with said associated burner.

5. The cooking appliance of claim 1 which further comprises: a normally closed fluid flow device in communication with said fuel supplier such that fuel flow to said fuel supplier stops when said associated burner is not selectively supported above said cooktop surface.

6. A gas cooking appliance comprising:

a structural housing;

a cooktop surface supported by said structural housing;

a convertible area defined on said cooktop surface;

a fuel supplier supported by said structural housing for selectively delivering a fuel mixture above said cooktop surface to an associated burner selectively supported by said cooktop surface, said fuel supplier being spaced outwardly from an outer periphery of said cooktop surface.

7. The cooking appliance of claim 6, wherein said cooktop surface is entirely apertureless.

8. The cooking appliance of claim 6, wherein said fuel supplier, in combination with said associated burner, entrains nearly all primary air from above said cooktop surface.

9. The cooking appliance of claim 6, wherein said associated burner selectively interlocks with said fuel supplier and is selectively in fluid communication therewith.

10. The cooking appliance of claim 6 which further comprises a normally closed, fuel flow device in fluid communication with said fuel supplier, such that fuel flow to said fuel supplier stops when said associated burner is not selectively supported by said cooktop surface.

11. A gas cooking appliance comprising:

a structural housing;

a fuel supplier supported by said structural housing for selectively delivering a fuel mixture;

a burner functionally connected to said fuel supplier for receiving said fuel mixture from said fuel supplier;

a cooktop surface supported by said structural housing, said cooktop surface selectively supporting said burner, and a convertible area defined on said cooktop surface, said convertible area being useable as a work area when said burner is not being supported by said cooktop surface; and, a normally closed, fuel flow device in fluid communication with said fuel supplier, such that fuel flow to said fuel supplier stops when said burner is not selectively supported by said cooktop surface.

12. The cooking appliance of claim 11, wherein said fuel flow device includes a normally "closed" valve or regulator that actuates to an "on" position when said burner is selectively interlocked above said cooktop surface.

13. The cooking appliance of claim 11, wherein said fuel flow device includes a flame safety valve with a thermal-electric circuit that becomes electrically complete when said burner is functionally connected to said fuel supplier.

14. The cooking appliance of claim 11, wherein said fuel flow device includes an operator control receiver that interlocks to an operator control transmitter for permitting selective delivery of said fuel mixture when said burner is functionally connected to said fuel supplier.

15. The cooking appliance of claim 11, wherein the functional connection of said burner and said fuel supplier includes an interlock, with one or more degrees of movement, between said burner and said fuel supplier.

16. A gas cooking appliance that comprises, in combination:

a cooktop surface supported by an associated housing, said cooktop surface having a convertible area with no apertures extending through it;

at least one burner that, during normal operation, interlocks with said appliance and is supported above said convertible area; and a gas-to-air type fuel supplier comprising at least one orifice that delivers a fuel and an oxidizer to said burner when said burner is located above said convertible area.

17. The cooking appliance of claim 16, further comprising a first connecting element defined on said at least one burner and a second connecting element defined on at least one of said appliance and said fuel supplier n order to interlock said at least one burner with the appliance.

18. The cooking appliance of claim 16, wherein said at least one burner can be removed from said cooktop surface by rotating upwardly.

19. The cooking appliance of claim 16, wherein said at least one burner can be removed from said cooking appliance by lifting upwardly.

20. The cooking appliance of claim 19, wherein said at least one burner can be removed while it is kept in an orientation approximately parallel to said cooktop surface.

21. A gas cooking appliance comprising: a structural housing; a cooktop surface supported by said structural housing; a convertible area defined on said cooktop surface, wherein said convertible area is planar and has no apertures for passage of a gas therethrough; and, a fuel supplier supported by said structural housing, said fuel supplier having an orifice, wherein when an associated removable burner is located above said convertible area and is operational, gas egressing from said orifice is at near ambient static pressure before being delivered to said associated removable burner.

22. The cooking appliance of claim 21, wherein said associated removable burner can be fully or partially removed from above said convertible area.

23. The cooking appliance of claim 21 wherein said fuel supplier is directly supported by said cooktop surface and indirectly supported by said structural housing.

24. The cooking appliance of claim 21, wherein said convertible area is useable as a work area when said associated removable burner is not located above said convertible area.

25. The cooking appliance of claim 21 which further comprises a normally closed, fuel flow device in fluid communication with said fuel supplier, such that fuel flow to said fuel supplier stops when said associated removable burner is not supported by said cooktop surface.

* * * * *

UNITED STATES PATENT AND TRADEMARK OFFICE

CERTIFICATE OF CORRECTION

PATENT NO. : 7,881,593 B2
APPLICATION NO. : 11/985692
DATED : February 1, 2011
INVENTOR(S) : Michael J. Grassi et al.

It is certified that error appears in the above-identified patent and that said Letters Patent is hereby corrected as shown below:

On the Title Page, (75) Inventors, should read as follows:

--(75) Inventors: Michael J. Grassi, Somerset, PA (US)
Anne C. Sullivan, Duluth, MN (US)--.

Signed and Sealed this
Twenty-ninth Day of March, 2011

David J. Kappos

David J. Kappos
*Director of the United States Patent and Trademark Office*